US006994941B2

(12) United States Patent
Tanaka et al.

(10) Patent No.: US 6,994,941 B2
(45) Date of Patent: Feb. 7, 2006

(54) ELECTROPHOTOGRAPHIC PHOTOSENSITIVE MEMBER, PROCESS CARTRIDGE AND ELECTROPHOTOGRAPHIC APPARATUS

(75) Inventors: Takakazu Tanaka, Shizuoka (JP); Itaru Takaya, Kanagawa (JP); Yuka Ishiduka, Shizuoka (JP); Harunobu Ogaki, Shizuoka (JP); Kenichi Kaku, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 10/649,679

(22) Filed: Aug. 28, 2003

(65) Prior Publication Data

US 2005/0100805 A1 May 12, 2005

(30) Foreign Application Priority Data

Aug. 30, 2002 (JP) ..... 2002-253631
Aug. 21, 2003 (JP) ..... 2003-297680

(51) Int. Cl.
*G03G 5/06* (2006.01)

(52) U.S. Cl. ..... 430/75; 430/58.15; 430/58.65; 430/72; 430/73; 399/116; 399/159

(58) Field of Classification Search ..... 430/58.65, 430/58.7, 58.15, 75, 72, 73, 96; 399/116, 399/159
See application file for complete search history.

(56) References Cited

U.S. PATENT DOCUMENTS 3,265,496 A * 8/1966 Fox ..... 430/73
5,430,526 A * 7/1995 Ohkubo et al. ..... 399/159
5,733,697 A 3/1998 Endoh et al.
6,258,499 B1 7/2001 Itami ..... 430/66
2004/0048179 A1 * 3/2004 Tanaka et al. ..... 430/58.7

FOREIGN PATENT DOCUMENTS

| | | |
|---|---|---|
| JP | 61-151545 | 7/1986 |
| JP | 5-49106 | 7/1993 |
| JP | 9-292724 | 11/1997 |
| JP | 00-206721 | 7/2000 |
| JP | 01-133994 | 5/2001 |
| JP | 2001-316336 | 11/2001 |
| WO | WO 99/32537 | 7/1999 |
| WO | WO 00/78843 | 12/2000 |

OTHER PUBLICATIONS

Diamond, A.S., ed., *Handbook of Imaging Materials*, Macel Dekker, Inc., NY (1991), pp. 395-396.*
Hiromitsu Tanaka et al., "Novel Hole-Transporting Materials Based on Triphenylamine for Organic Electroluminescent Devices", *Chem. Commun.*, 1996, pp. 2175-2176, (XP-00213211).
Peter Strohreigl et al., "The Higher Homologues of Triphenylamine: Model Compounds for Poly(*N*-phenyl-1,4-phenylemneamine)", *Die Makramol. Chemie*, vol. 193, Apr. 1992, pp. 909-919.

* cited by examiner

*Primary Examiner*—Janis L. Dote
(74) *Attorney, Agent, or Firm*—Fitzpatrick, Cella, Harper & Scinto

(57) ABSTRACT

An electrophotographic photosensitive member is provided having a support and a photosensitive layer provided on the support and containing at least one kind of charge-transporting material which has a specific structure with a molecular weight of from 1,500 to 4,000, and is held in a proportion of from 90% by weight to 100% by weight based on the total weight of the charge-transporting material.

25 Claims, 4 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

This invention relates to an electrophotographic photosensitive member, a process cartridge and an electrophotographic apparatus. More particularly, it relates to an electrophotographic photosensitive member having in its photosensitive layer a specific charge-transporting material, and a process cartridge and an electrophotographic apparatus which have the electrophotographic photosensitive member.

2. Related Background Art

Image-bearing members used in electrophotographic photosensitive member include electrophotographic photosensitive members. Form the viewpoints of high productivity and future developments and easiness of material designing, organic electrophotographic photosensitive members making use of organic photoconductive materials are energetically put forward. In regard to the functionality as electrophotographic photosensitive members, electrophotographic photosensitive members superior to inorganic electrophotographic photosensitive member have come to be manufactured. It, however, is desired to achieve higher sensitivity and to improve image stability in repeated use and durability in organic electrophotographic photosensitive members.

To settle these subjects, approaches to the improvement of charge-transporting materials have been proposed (see, e.g., Japanese Patent Application Laid-open Nos. H9-292724 and 2001-133994). Japanese Patent Application Laid-open Nos. H9-292724 and 2001-133994 disclose that a charge-transporting material having three or four structures having in its molecule a tertiary amine in which phenyl groups are bonded to the nitrogen atom (hereinafter "triphenylamine structures") is used in an electrophotographic photosensitive member to achieve a higher sensitivity, and superior charge transport performance is brought out by the three or four triphenylamine structures possessed in the charge-transporting material. There, however, is no disclosure as to a charge-transporting material having five or more structures having a tertiary amine in which either of substituted or unsubstituted aromatic carbocyclic groups and substituted or unsubstituted aromatic heterocyclic groups are bonded to the nitrogen atom (hereinafter "triarylamine structures") charge-transporting material. There is also no disclosure as to the durability in mechanical strength of the electrophotographic photosensitive member.

Similarly, Japanese Patent Application Laid-open No. 2000-206721 gives an example of a charge-transporting material having therein two to four triphenylamine structures. This Japanese Patent Application Laid-open No. 2000-206721 discloses that the charge-transporting material having two to four triphenylamine structures makes the charge transport layer have higher glass transition temperature, but admits in Comparative Examples that only the incorporation of this charge-transporting material can not achieve the improvement in durability.

Thus, the improvement of charge-transporting materials have achieved a superior charge transport performance. Since, however, a low-molecular-weight charge-transporting material is mixed in a binder resin, it would be said that the inherent mechanical strength of the binder resin is not necessarily fully exhibited.

For the purpose of more preferably preventing the layer from having a low mechanical strength because of the addition of a low-molecular-weight charge-transporting material, Japanese Patent Application Laid-open No. S61-151545 and Japanese Patent Publication No. H5-49106 disclose a high-molecular-weight charge-transporting material of a polymer type which contains triarylamine structures in a large number. In these patent publications, it is disclosed that the high-molecular-weight charge-transporting material of a polymer type which contains triarylamine structures in a large number is used in an electrophotographic photosensitive member, thereby improving its durability in repeated use. According to the disclosure in these patent publications, the high-molecular-weight charge-transporting material is synthesized by polymerization reaction, and hence it is produced in the form of a mixture containing charge-transporting materials with various molecular weights. However, in Japanese Patent Publication No. H5-49106, it is also disclosed that there is little difference from a high-molecular-weight charge-transporting material having no molecular weight distribution as long as the number of times of the repetition of repeating structural units is 10 times or less.

As examples in which a high-molecular-weight charge-transporting material of a polymer type is similarly used in an electrophotographic photosensitive member, those disclosed in International Publications No. WO00/078843 and No. WO99/32537 may be given. A high-molecular-weight charge-transporting material disclosed in International Publication No. WO00/078843 is a high-molecular-weight charge-transporting material of a polymer type having a molecular weight distribution, which is produced by polymerization reaction of a low-molecular-weight monomer, showing that the use of this charge-transporting material in the electrophotographic photosensitive member enables higher sensitivity to be achieved in virtue of an improvement in durability and an improvement in charge transport performance.

Publication No. WO00/078843 further discloses a method in which a high-molecular-weight charge-transporting material of a polymer type which contains triphenylamine structures in a large number is separated into molecular-weight fractions, and also discloses that such separation into molecular-weight fractions brings an improvement in charge transport performance. International Publication No. WO99/32537 further discloses that the use of a high-molecular-weight charge-transporting material of a polymer type brings an improvement in durability of electrophotographic photosensitive members, proposing an electrophotographic photosensitive member having a high charge transport performance and a high durability.

However, even if the polymer-type charge-transporting material has a small number of times of the repetition of repeating structural units and is separated into molecular-weight fractions, it has a molecular weight distribution and contains charge-transporting materials with various molecular weights. Hence, all the polymer-type high-molecular-weight charge-transporting materials do not necessarily have sufficient mechanical strength and electrophotographic performance. Also, even when they have a certain mechanical strength, they have such a disadvantage that their manufacturing cost is so high as to be not suited for practical use.

In addition, since an improvement in wear resistance makes the depth of wear smaller, the photosensitive layer have a longer lifetime and the influence of electrical external force coming from the steps of charging, imagewise exposure, development with toner and transfer the photosensitive layer undergoes, becomes relatively large. Hence, when the photosensitive layer is repeatedly used, such influence is liable to appear. For example, smeared images may appear in a high-humidity environment due to deterioration in the electrophotographic photosensitive member surface. Thus, problems have come to arise which should be solved at the same time the durability of electrophotographic photosensitive members is improved.

SUMMARY OF THE INVENTION

An object of the present invention is to provide an electrophotographic photosensitive member which has solved the problems discussed above, and has high mechanical strength such as wear resistance and scratch resistance and superior stability in repeated use in virtue of the incorporation of a binder resin and a specific charge-transporting material in a photosensitive layer.

Another object of the present invention is to provide a process cartridge and an electrophotographic apparatus which have such an electrophotographic photosensitive member.

That is, the present invention provides an electrophotographic photosensitive member comprising a support and a photosensitive layer provided on the support, wherein;

the photosensitive layer contains one or two or more kind(s) of charge-transporting material(s);

at least one kind of charge-transporting material contained in the photosensitive layer is a charge-transporting material having a structure represented by the following Formula (1) and having a molecular weight of from 1,500 to 4,000; and the charge-transporting material having a structure represented by the following Formula (1) and having a molecular weight of from 1,500 to 4,000 is held in a proportion of from 90% by weight to 100% by weight based on the total weight of the charge-transporting material(s) contained in the photosensitive layer:

(1)

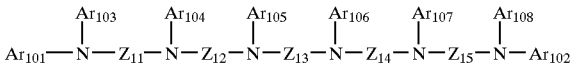

wherein $Ar_{101}$ to $Ar_{108}$ each independently represent a substituted or unsubstituted monovalent aromatic carbocyclic group or a substituted or unsubstituted monovalent aromatic heterocyclic group, and $Z_{11}$ to $Z_{15}$ each independently represent a substituted or unsubstituted divalent aromatic carbocyclic group or a substituted or unsubstituted divalent aromatic heterocyclic group.

The present invention also provides an electrophotographic photosensitive member comprising a support and a photosensitive layer provided on the support, wherein;

the photosensitive layer contains one or two or more kind(s) of charge-transporting material(s);

at least one kind of charge-transporting material contained in the photosensitive layer is a charge-transporting material having a structure represented by the following Formula (2) and having a molecular weight of from 1,500 to 4,000; and the charge-transporting material having a structure represented by the following Formula (2) and having a molecular weight of from 1,500 to 4,000 is held in a proportion of from 90% by weight to 100% by weight based on the total weight of the charge-transporting material(s) contained in the photosensitive layer:

(2)

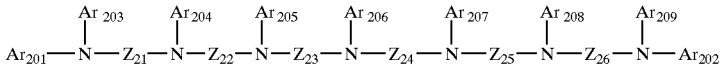

wherein $Ar_{201}$ to $Ar_{209}$ each independently represent a substituted or unsubstituted monovalent aromatic carbocyclic group or a substituted or unsubstituted monovalent aromatic heterocyclic group, and $Z_{21}$ to $Z_{26}$ each independently represent a substituted or unsubstituted divalent aromatic carbocyclic group or a substituted or unsubstituted divalent aromatic heterocyclic group.

The present invention still also provides an electrophotographic photosensitive member comprising a support and a photosensitive layer provided on the support, wherein;

the photosensitive layer contains one or two or more kind(s) of charge-transporting material(s);

at least one kind of charge-transporting material contained in the photosensitive layer is a charge-transporting material having a structure represented by the following Formula (3) and having a molecular weight of from 1,500 to 4,000; and the charge-transporting material having a structure represented by the following Formula (3) and having a molecular weight of from 1,500 to 4,000 is held in a proportion of from 90% by weight to 100% by weight based on the total weight of the charge-transporting material(s) contained in the photosensitive layer:

(3)

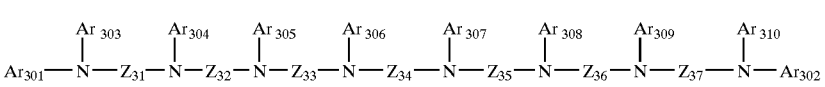

wherein $Ar_{301}$ to $Ar_{310}$ each independently represent a substituted or unsubstituted monovalent aromatic carbocyclic group or a substituted or unsubstituted monovalent aromatic heterocyclic group, and $Z_{31}$ to $Z_{37}$ each independently represent a substituted or unsubstituted divalent aromatic carbocyclic group or a substituted or unsubstituted divalent aromatic heterocyclic group.

The present invention further provides an electrophotographic photosensitive member comprising a support and a photosensitive layer provided on the support, wherein;

the photosensitive layer contains one or two or more kind(s) of charge-transporting material(s);

at least one kind of charge-transporting material contained in the photosensitive layer is a charge-transporting material having a structure represented by the following Formula (4) and having a molecular weight of from 1,500 to 4,000; and the charge-transporting material having a structure represented by the following Formula (4) and having a molecular weight of from 1,500 to 4,000 is held in a proportion of from 90% by weight to 100% by weight based on the total weight of the charge-transporting material(s) contained in the photosensitive layer:

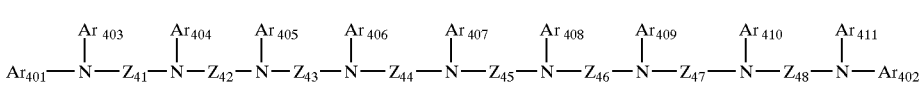

(4)

wherein $Ar_{401}$ to $Ar_{411}$ each independently represent a substituted or unsubstituted monovalent aromatic carbocyclic group or a substituted or unsubstituted monovalent aromatic heterocyclic group, and $Z_{41}$ to $Z_{48}$ each independently represent a substituted or unsubstituted divalent aromatic carbocyclic group or a substituted or unsubstituted divalent aromatic heterocyclic group.

The present invention still further provides an electrophotographic photosensitive member comprising a support and a photosensitive layer provided on the support, wherein;

the photosensitive layer contains one or two or more kind(s) of charge-transporting material(s);

at least one kind of charge-transporting material contained in the photosensitive layer is a charge-transporting material having a structure represented by the following Formula (5) and having a molecular weight of from 1,500 to 4,000; and the charge-transporting material having a structure represented by the following Formula (5) and having a molecular weight of from 1,500 to 4,000 is held in a proportion of from 90% by weight to 100% by weight based on the total weight of the charge-transporting material(s) contained in the photosensitive layer:

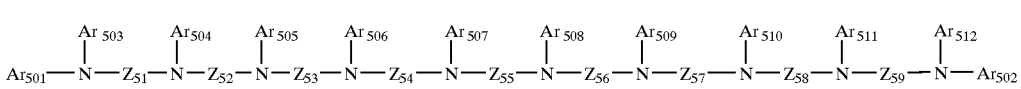

(5)

wherein $Ar_{501}$ to $Ar_{512}$ each independently represent a substituted or unsubstituted monovalent aromatic carbocyclic group or a substituted or unsubstituted monovalent aromatic heterocyclic group, and $Z_{51}$ to $Z_{59}$ each independently represent a substituted or unsubstituted divalent aromatic carbocyclic group or a substituted or unsubstituted divalent aromatic heterocyclic group.

The present invention still further provides a process cartridge which comprises any one of the electrophotographic photosensitive members described above and at least one means selected from the group consisting of a charging means, a developing means and a cleaning means, which are integrally supported; and is detachably mountable on the main body of an electrophotographic apparatus.

The present invention still further provides an electrophotographic apparatus comprising any one of the electrophotographic photosensitive members described above, a charging means, an exposure means, a developing means and a transfer means.

DESCRIPTION OF PREFERRED EMBODIMENTS

Figure 1:
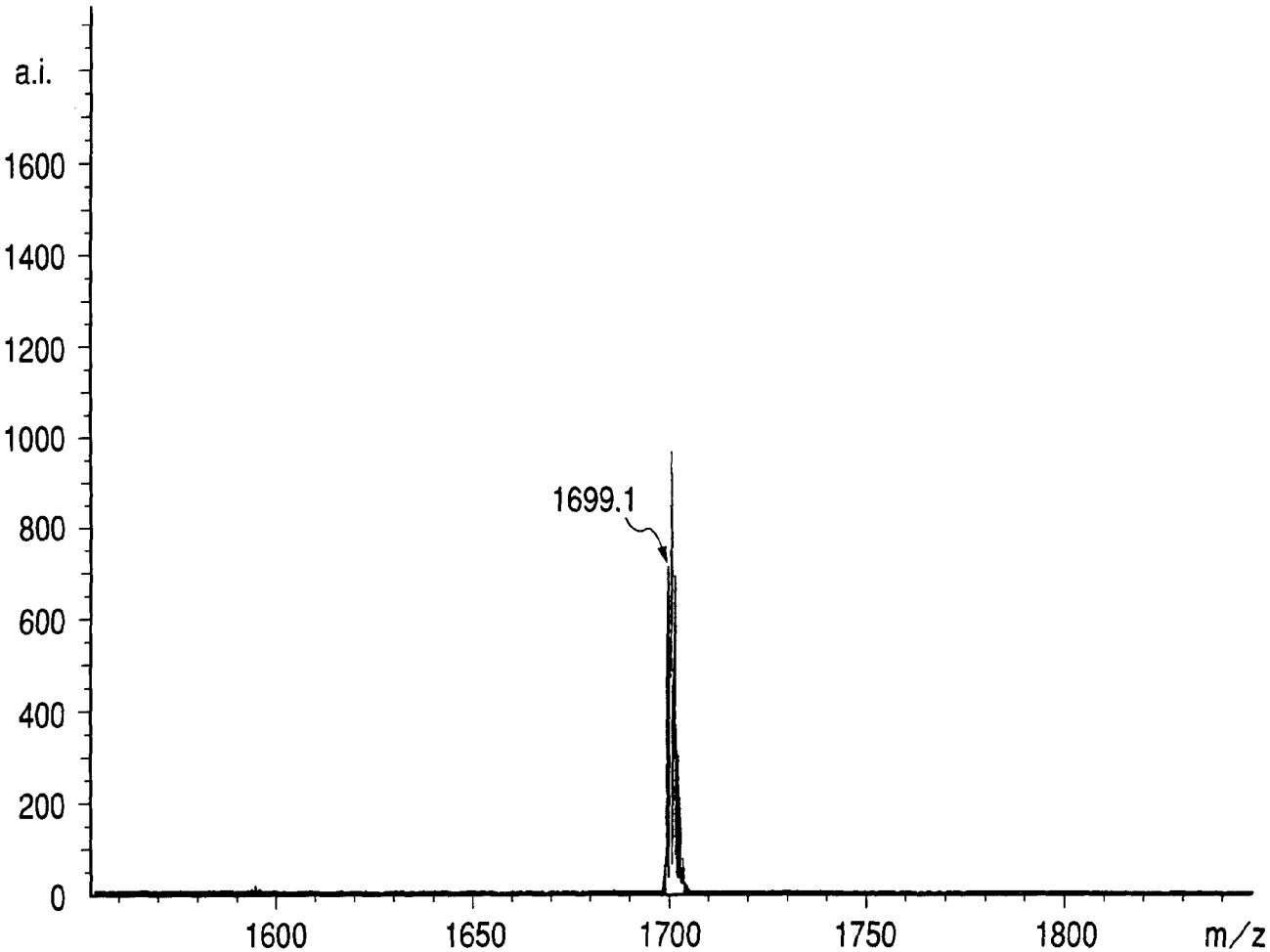
FIG. 1 shows an MALDI-TOF-MASS spectrum of an exemplary compound (CT-10) of the present invention.

The present invention is described below in detail.

The electrophotographic photosensitive member of the present invention has a support and a photosensitive layer provided on the support, and the photosensitive layer contains a charge-transporting material.

The charge-transporting material in the present invention refers to any of high-molecular-weight charge-transporting materials which can be represented by specific chemical structural formulas.

The charge-transporting material contained in the photosensitive layer is a charge-transporting material having any of structures represented by the above Formulas (1) to (5) and having a molecular weight of from 1,500 to 4,000, and in addition thereto may simultaneously contain a low-molecular-weight charge-transporting material(s) and/or other high-molecular-weight charge-transporting material(s). From the viewpoint of mechanical strength and electrophotographic performance of the electrophotographic photosensitive member, preferred is a charge-transporting material in which:

the charge-transporting material having a structure represented by the above Formula (1) and having a molecular weight of from 1,500 to 4,000 is held in a proportion of from 90% by weight to 100% by weight, more preferably from 95% by weight to 100% by weight, and still more preferably 100% by weight, based on the total weight of the charge-transporting material(s) contained in the photosensitive layer;

the charge-transporting material having a structure represented by the above Formula (2) and having a molecular weight of from 1,500 to 4,000 is held in a proportion of from 90% by weight to 100% by weight, more preferably from 95% by weight to 100% by weight, and still more preferably 100% by weight, based on the total weight of the charge-transporting material(s) contained in the photosensitive layer;

the charge-transporting material having a structure represented by the above Formula (3) and having a molecular weight of from 1,500 to 4,000 is held in a proportion of from 90% by weight to 100% by weight, more preferably from 95% by weight to 100% by weight, and still more preferably 100% by weight, based on the total weight of the charge-transporting material(s) contained in the photosensitive layer;

the charge-transporting material having a structure represented by the above Formula (4) and having a molecular weight of from 1,500 to 4,000 is held in a proportion of from 90% by weight to 100% by weight, more preferably from 95% by weight to 100% by weight, and still more preferably 100% by weight, based on the total weight of the charge-transporting material(s) contained in the photosensitive layer; or the charge-transporting material having a structure represented by the above Formula (5) and having a molecular weight of from 1,500 to 4,000 is held in a proportion of from 90% by weight to 100% by weight, more preferably from 95% by weight to 100% by weight, and still more preferably 100% by weight, based on the total weight of the charge-transporting material(s) contained in the photosensitive layer.

In the above Formula (1), Formula (2), Formula (3), Formula (4) and Formula (5), $Ar_{101}$ to $Ar_{108}$, $Ar_{201}$ to $Ar_{209}$, $Ar_{301}$ to $Ar_{310}$, $Ar_{401}$ to $Ar_{411}$, and $Ar_{501}$ to $Ar_{512}$ are each independently a substituted or unsubstituted monovalent aromatic carbocyclic (hydrocarbon ring) group or a substituted or unsubstituted monovalent aromatic heterocyclic group. The substituted or unsubstituted monovalent aromatic carbocyclic group may include a phenyl group, a naphthyl group, an anthracenyl group and a pyrenyl group, and the substituted or unsubstituted monovalent aromatic heterocyclic group may include a pyridyl group, an indole group, a quinolinyl group, a benzofuranyl group, a dibenzofuranyl group, a benzothiophenyl group and a dibenzothiophenyl group. In particular, a phenyl group, a naphthyl group, a pyridyl group, a benzofuranyl group and a benzothiophenyl group are preferred. The substituents of these groups may include a hydrogen atom, an alkyl group having 1 to 8 carbon atoms, an aromatic carbocyclic group having 3 to 12 carbon atoms, an alkoxyl group having 1 to 8 carbon atoms, a halogen atom, a fluoroalkyl group, a cyano group and a nitro group. In particular, a hydrogen atom, a methyl group, an ethyl group, a methoxyl group, a fluorine atom, a chlorine atom, a bromine atom and a trifluoromethyl group are preferred.

In the above Formula (1), Formula (2), Formula (3), Formula (4) and Formula (5), $Z_{11}$ to $Z_{15}$, $Z_{21}$ to $Z_{26}$, $Z_{31}$ to $Z_{37}$, $Z_{41}$ to $Z_{48}$, and $Z_{51}$ to $Z_{59}$ are each independently a substituted or unsubstituted divalent aromatic carbocyclic group or a substituted or unsubstituted divalent aromatic heterocyclic group. The substituted or unsubstituted divalent aromatic carbocyclic group may include a phenylene group, a biphenylene group, a terphenylene group, a fluorenylene group, a naphthylene group, an anthracenylene group and a pyrenylene group, and the substituted or unsubstituted divalent aromatic heterocyclic group may include a pyridinylene group, an indolylene group, a quinolnylene group, a benzofuranylene group, a dibenzofuranylene group, a benzothiophenylene group and a dibenzothiophenylene group. The substituted or unsubstituted divalent aromatic carbocyclic group or substituted or unsubstituted divalent aromatic heterocyclic group also may include any of the above substituted or unsubstituted divalent aromatic carbocyclic groups or substituted or unsubstituted divalent aromatic heterocyclic groups formed by bonding through a single bond, a substituted or unsubstituted alkylene group having 1 to 4 carbon atoms, an alkylidene group, a substituted or unsubstituted silylene group having 1 to 4 silicon atoms, an oxygen atom or a sulfur atom. Of these substituted or unsubstituted divalent aromatic carbocyclic groups or substituted or unsubstituted divalent aromatic heterocyclic groups, a biphenylene group, a fluorenylene group, a pyridinylene group, a dibenzofuranylene group and a benzothiophenylene group are preferred.

More preferred is that:

$Z_{11}$ to $Z_{15}$ in Formula (1) are each a substituted or unsubstituted biphenylene group, a substituted or unsubstituted dibenzofuranylene group or a substituted or unsubstituted dibenzothiophenylene group;

$Z_{21}$ to $Z_{26}$ in Formula (2) are each a substituted or unsubstituted biphenylene group, a substituted or unsubstituted dibenzofuranylene group or a substituted or unsubstituted dibenzothiophenylene group;

$Z_{31}$ to $Z_{37}$ in Formula (3) are each a substituted or unsubstituted biphenylene group, a substituted or unsubstituted dibenzofuranylene group or a substituted or unsubstituted dibenzothiophenylene group;

$Z_{41}$ to $Z_{48}$ in Formula (4) are each a substituted or unsubstituted biphenylene group, a substituted or unsubstituted dibenzofuranylene group or a substituted or unsubstituted dibenzothiophenylene group; or $Z_{51}$ to $Z_{59}$ in Formula (5) are each a substituted or unsubstituted biphenylene group, a substituted or unsubstituted dibenzofuranylene group or a substituted or unsubstituted dibenzothiophenylene group.

Still more preferred is that:

of $Z_{11}$ to $Z_{15}$ in Formula (1), one is a substituted or unsubstituted dibenzofuranylene group or a substituted or unsubstituted dibenzothiophenylene, and the others are each a substituted or unsubstituted biphenylene group;

of $Z_{21}$ to $Z_{26}$ in Formula (2), one is a substituted or unsubstituted dibenzofuranylene group or a substituted or unsubstituted dibenzothiophenylene group, and the others are each a substituted or unsubstituted biphenylene group;

of $Z_{31}$ to $Z_{37}$ in Formula (3), one is a substituted or unsubstituted dibenzofuranylene group or a substituted or unsubstituted dibenzothiophenylene group, and the others are each a substituted or unsubstituted biphenylene group;

of $Z_{41}$ to $Z_{48}$ in Formula (4), one is a substituted or unsubstituted dibenzofuranylene group or a substituted or unsubstituted dibenzothiophenylene group, and the others are each a substituted or unsubstituted biphenylene group; or of $Z_{51}$ to $Z_{59}$ in Formula (5), one is a substituted or unsubstituted dibenzofuranylene group or a substituted or unsubstituted dibenzothiophenylene group, and the others are each a substituted or unsubstituted biphenylene group.

The substituents of these substituted or unsubstituted divalent aromatic carbocyclic groups or substituted or unsubstituted divalent aromatic heterocyclic groups may include a hydrogen atom, an alkyl group having 1 to 8 carbon atoms, an aromatic carbocyclic group having 3 to 12 carbon atoms, an alkoxyl group having 1 to 8 carbon atoms, a halogen atom, a fluoroalkyl group, a cyano group and a nitro group. In particular, a hydrogen atom, a methyl group, an ethyl group, a methoxyl group, an ethoxyl group, a fluorine atom, a chlorine atom, a bromine atom and a trifluoromethyl group are preferred.

Specific examples of the charge-transporting material according to the present invention are given below, but are not necessarily limited thereto.

(CT-1)

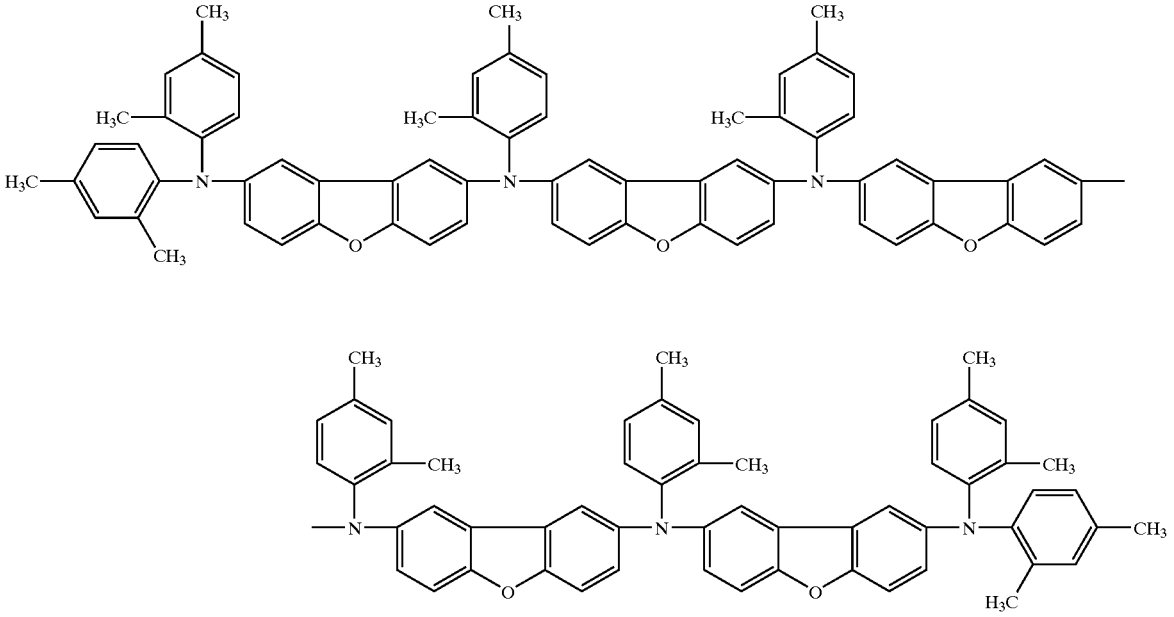

(CT-2)

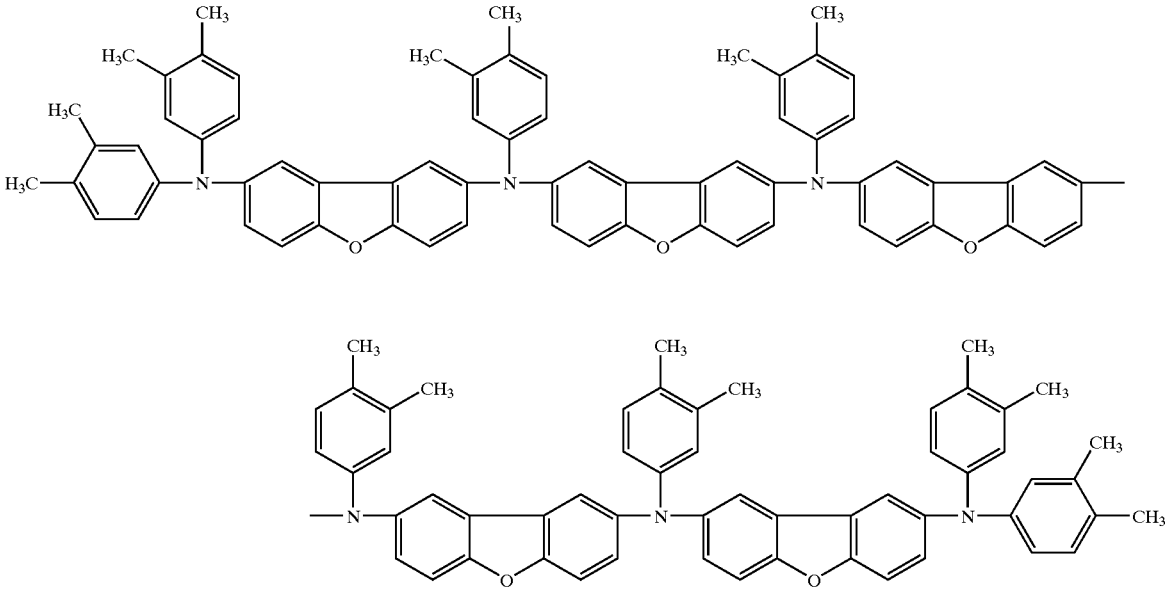

-continued
(CT-3)
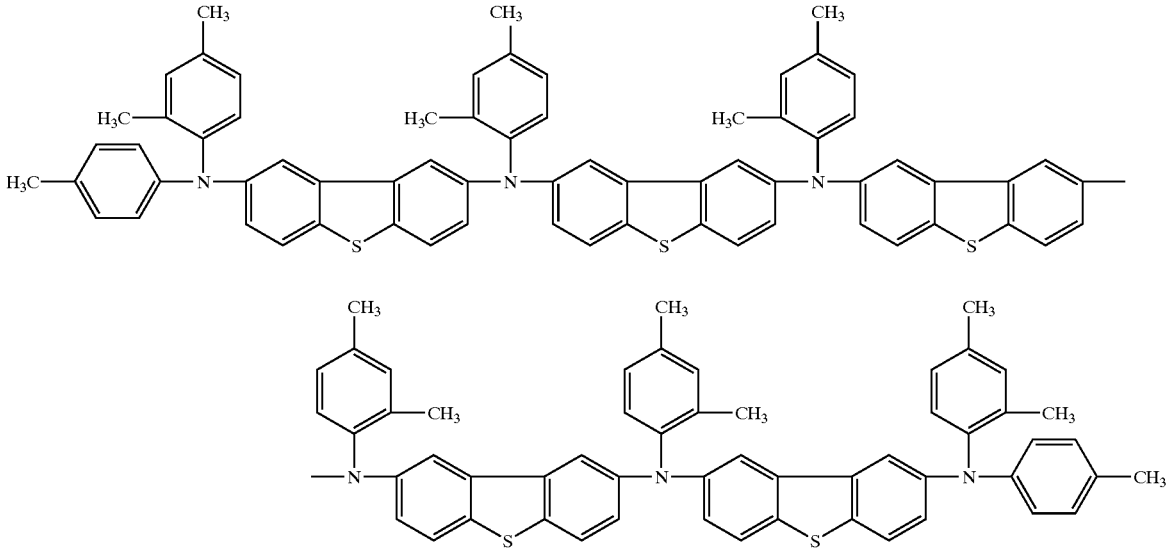
(CT-4)
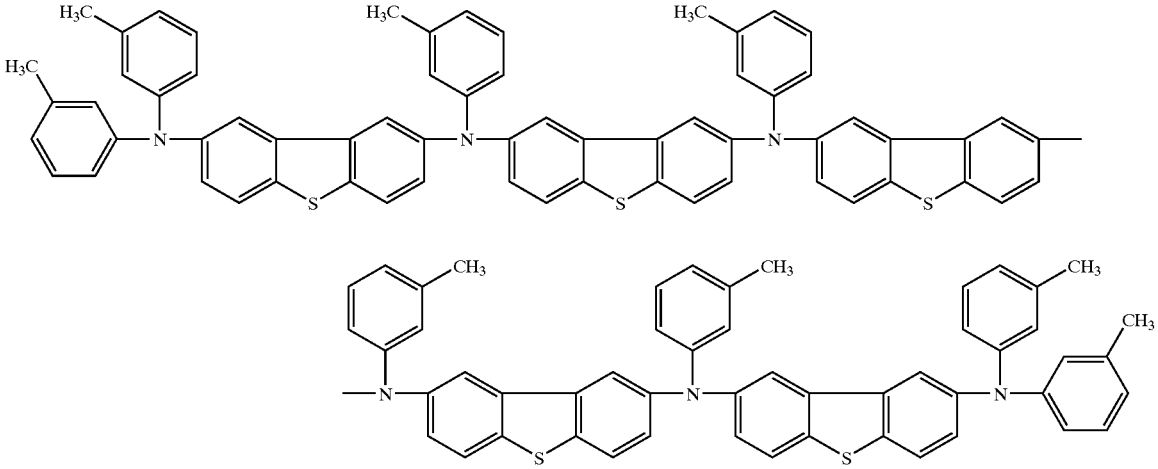
(CT-5)
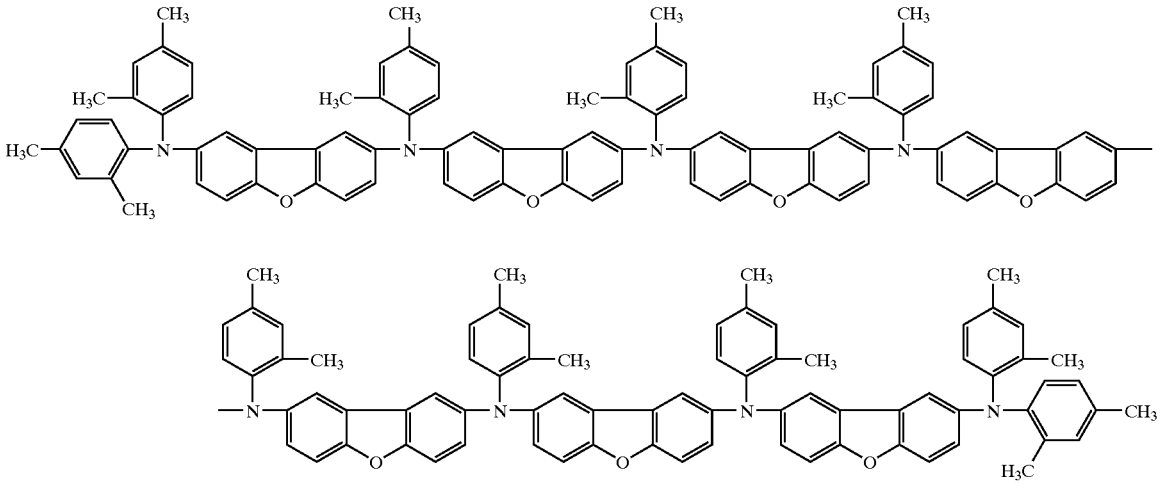

-continued
(CT-6)
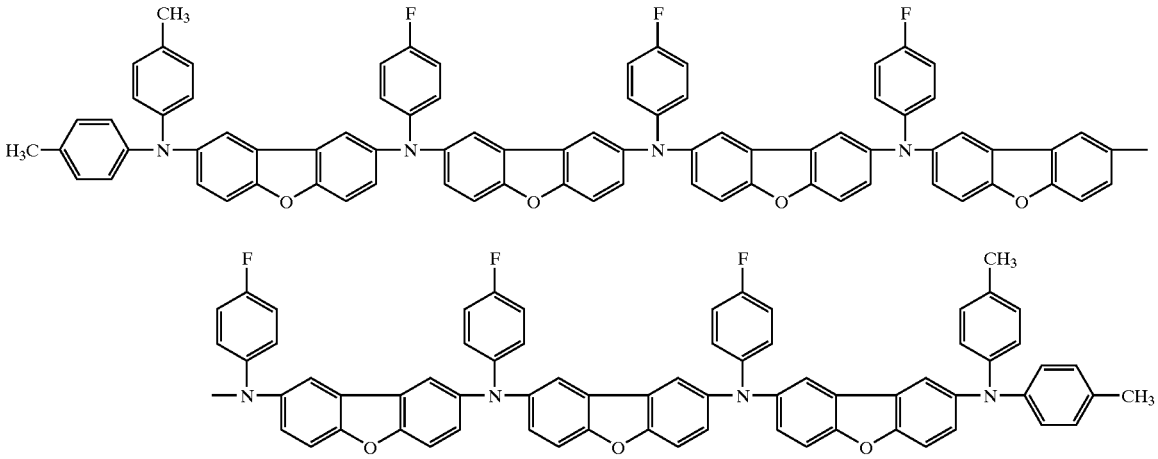
(CT-7)
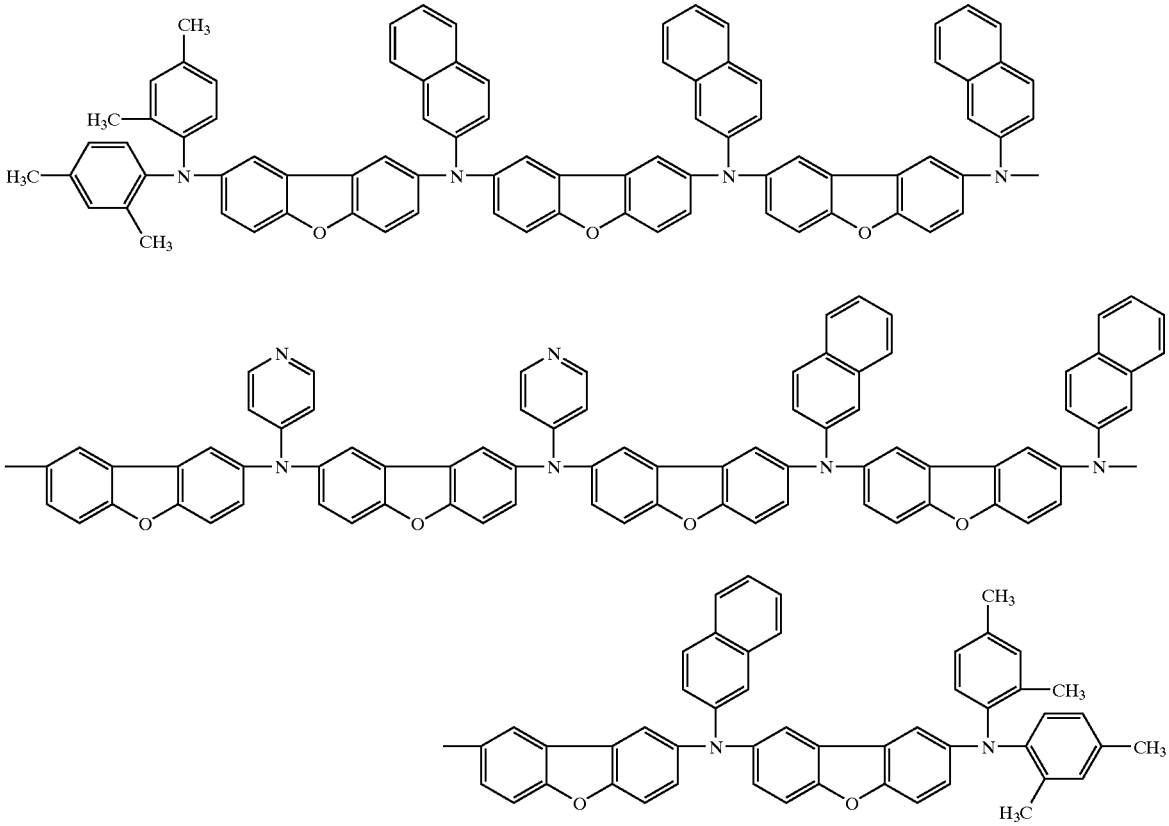
(CT-8)
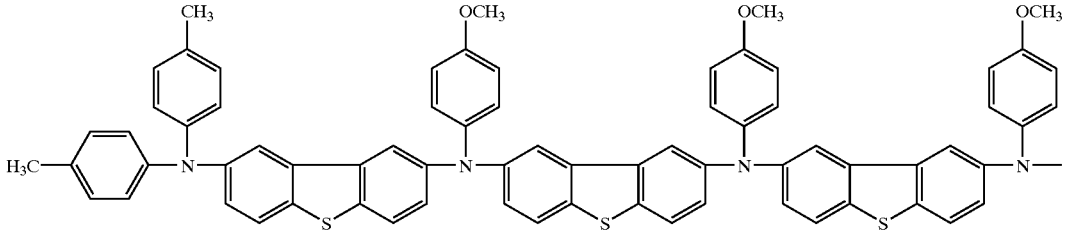

-continued
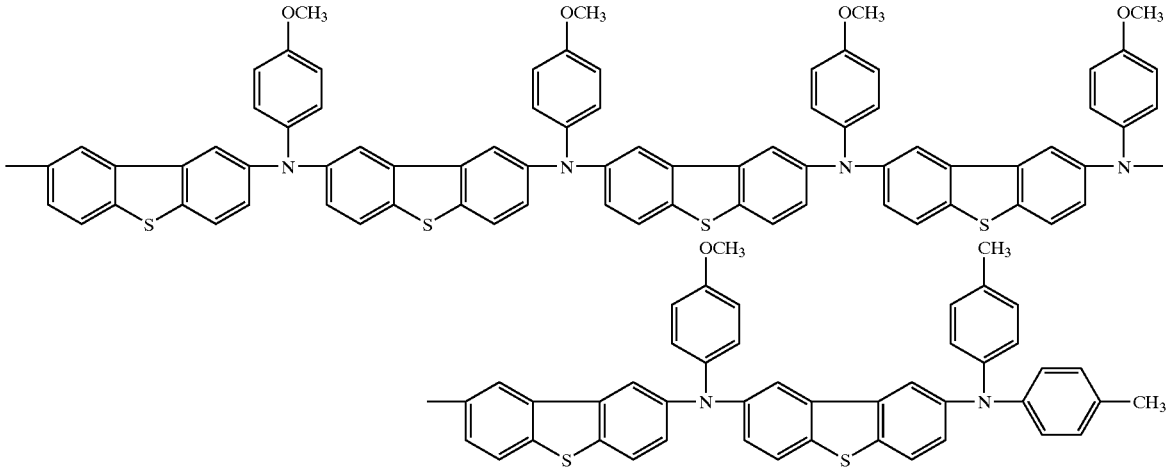
(CT-9)
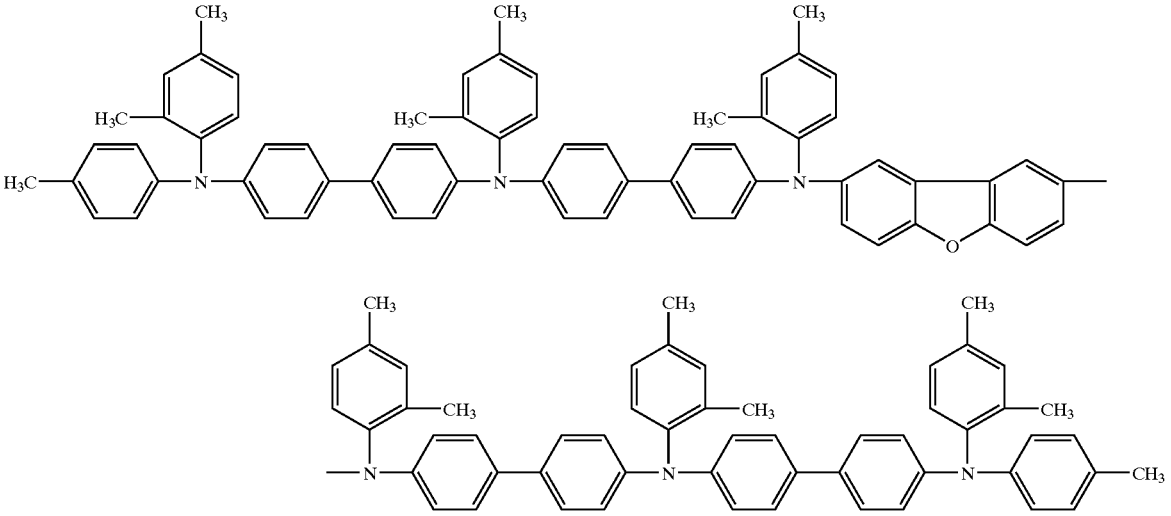
(CT-10)
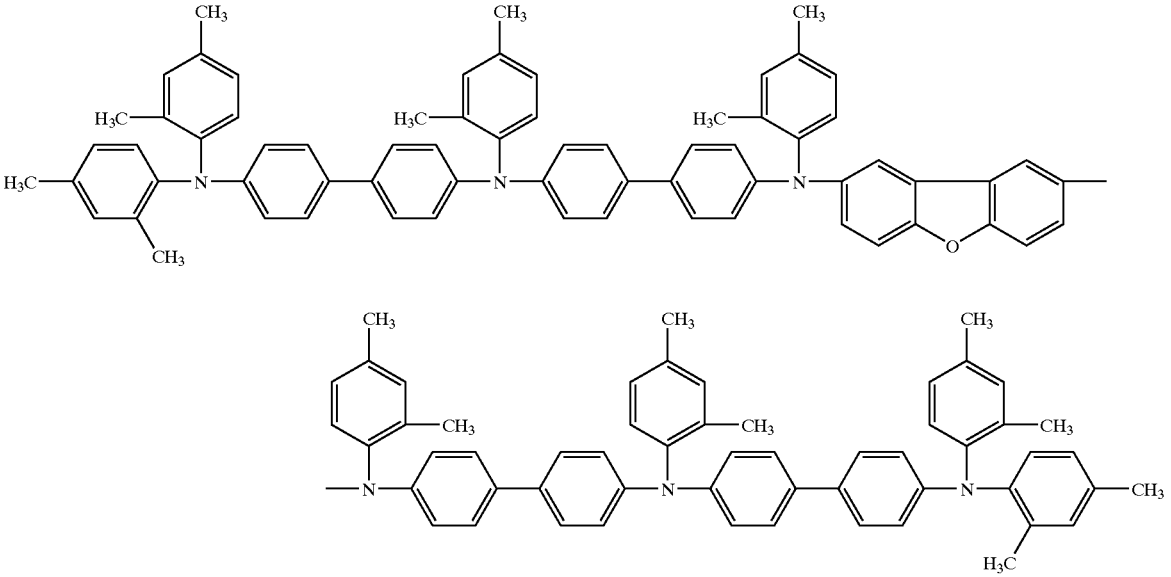

-continued
(CT-11)
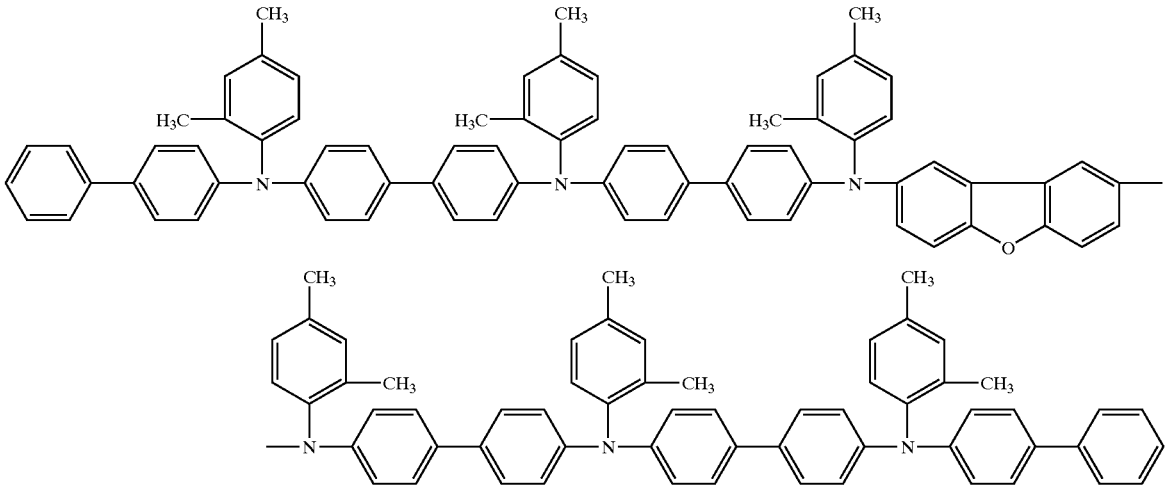
(CT-12)
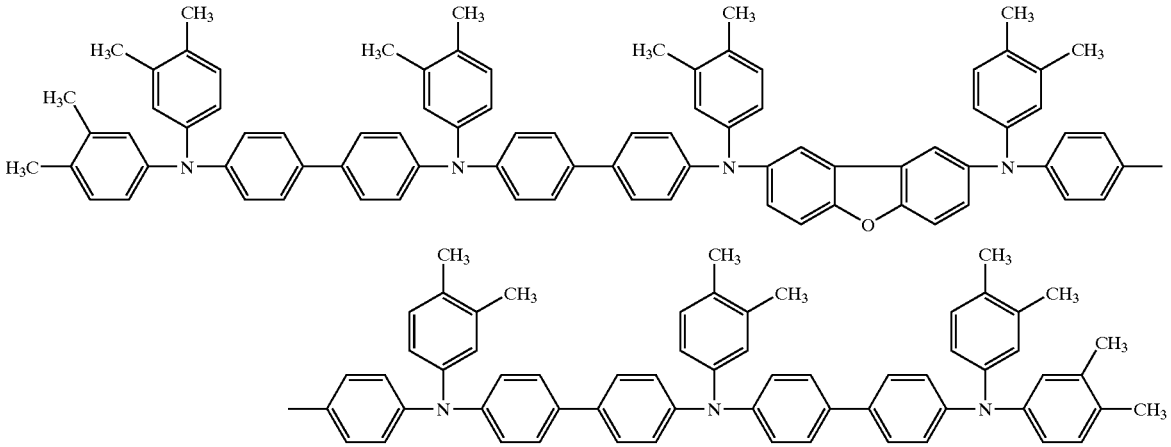
(CT-13)
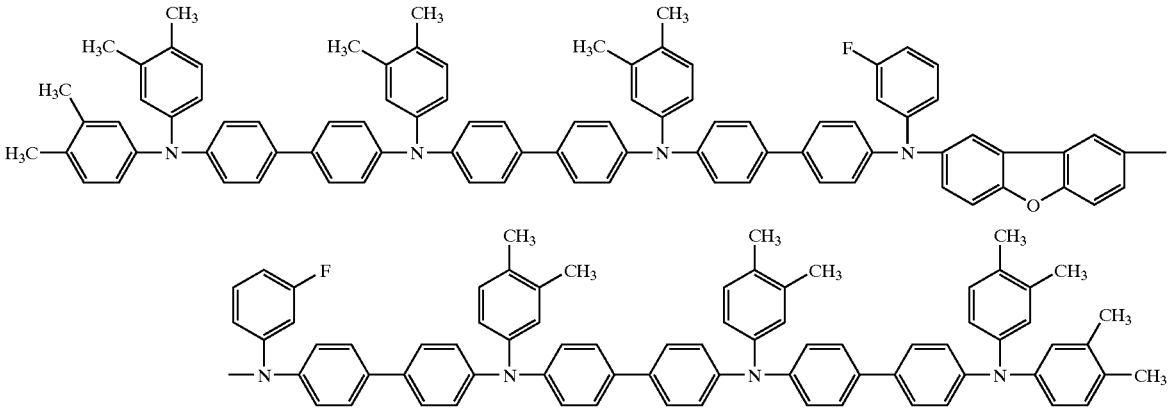
(CT-14)
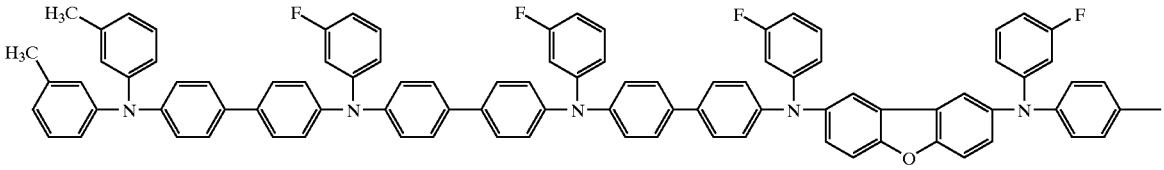

-continued
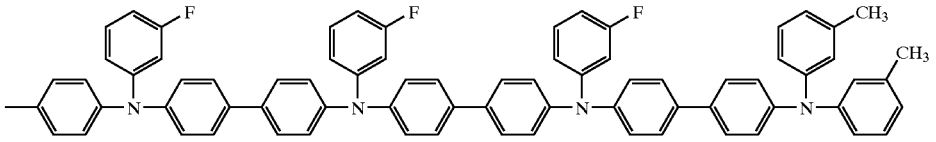
(CT-15)
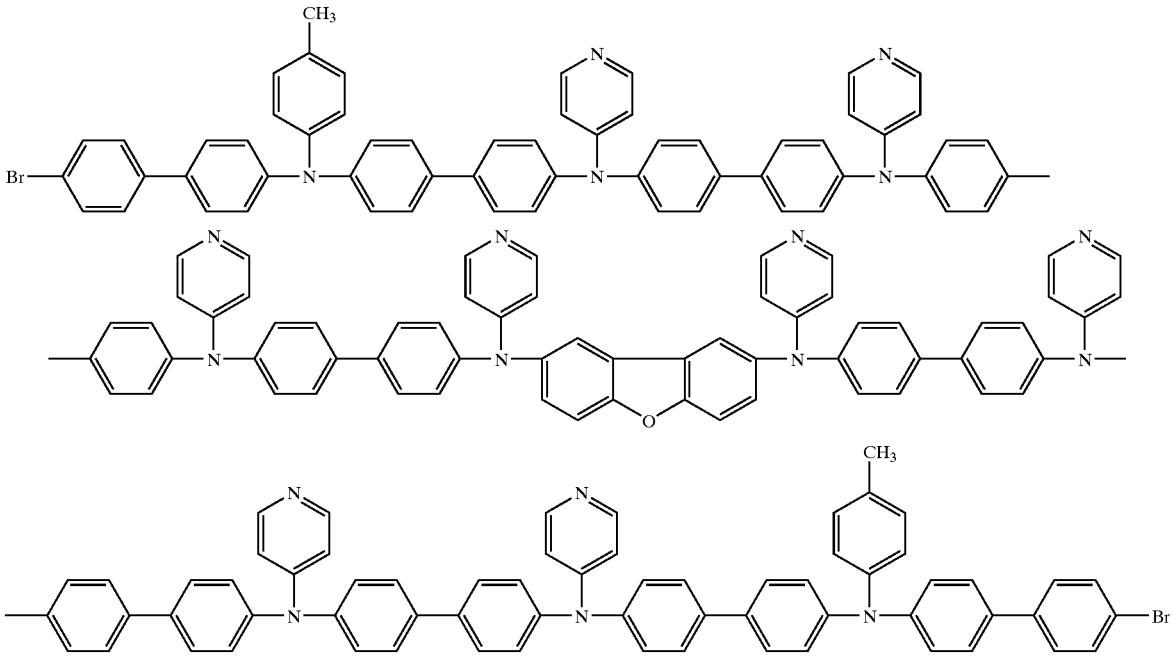
(CT-16)
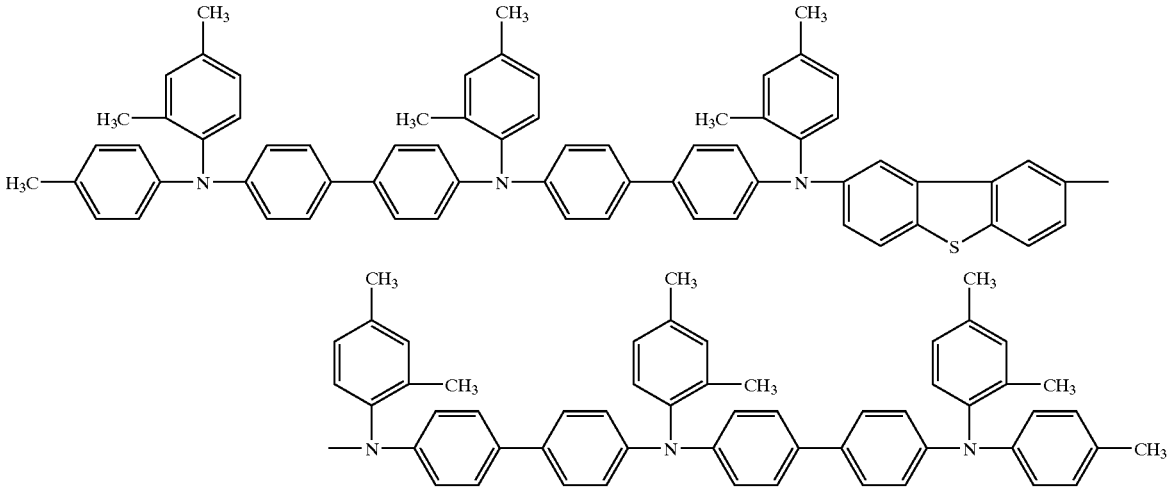
(CT-17)
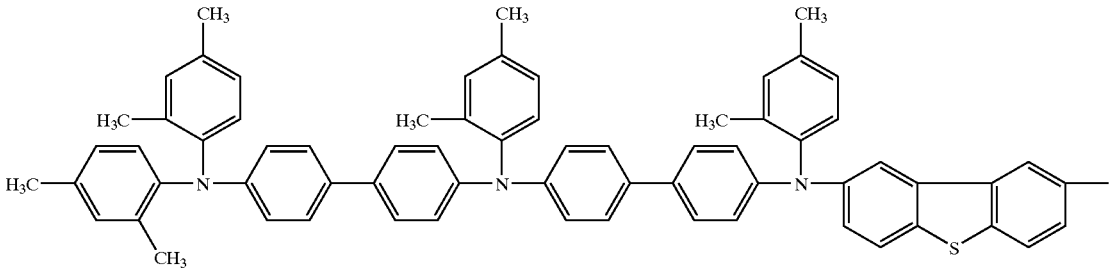

-continued
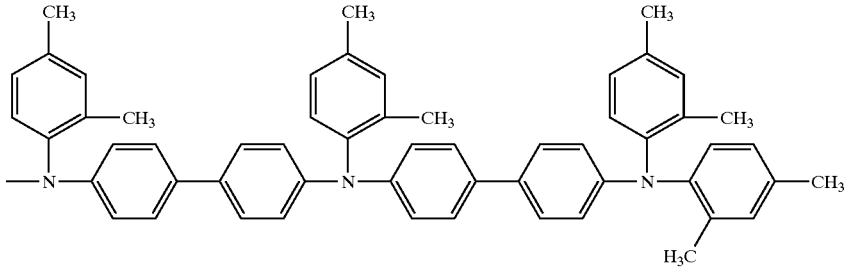
(CT-18)
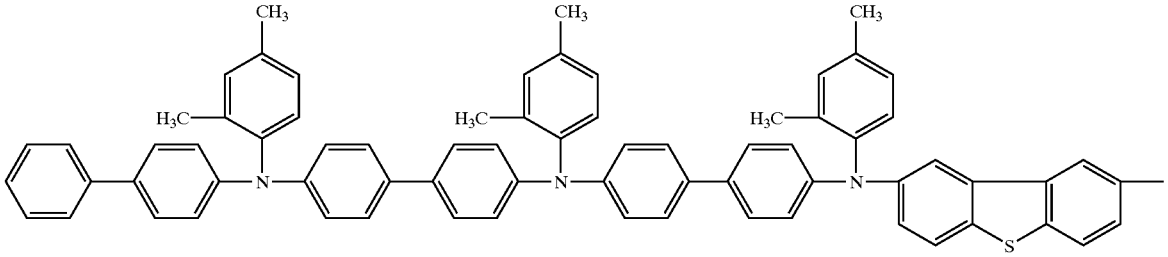
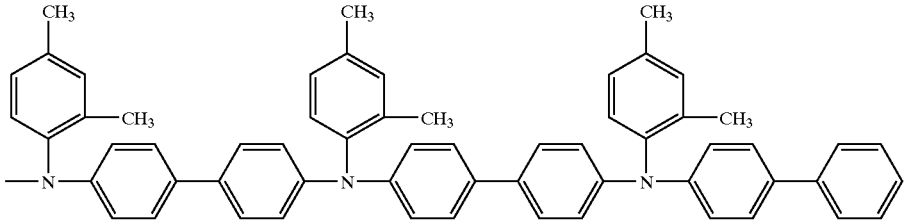
(CT-19)
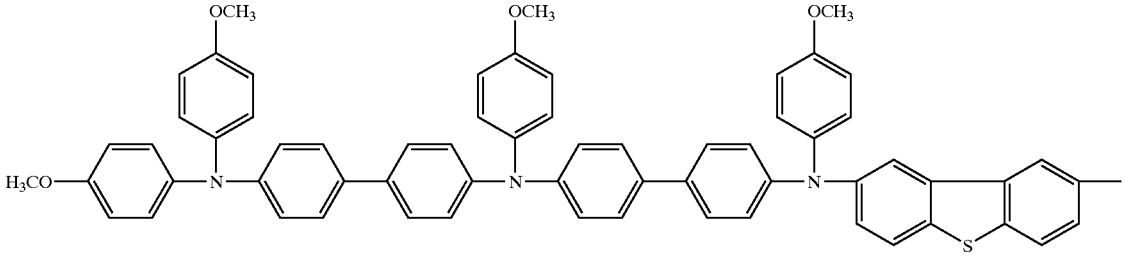
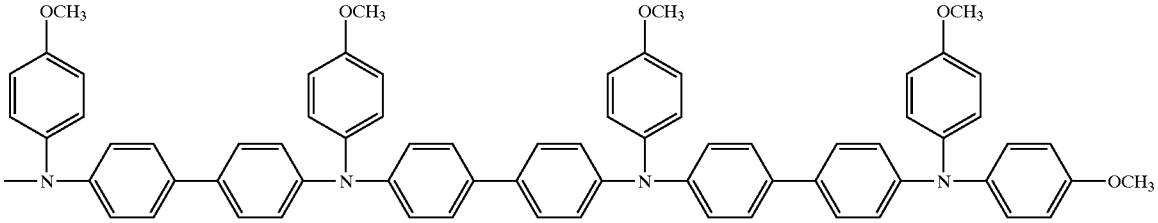
(CT-20)
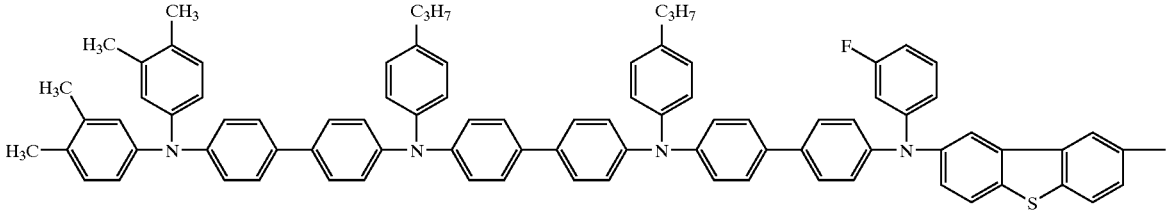

-continued
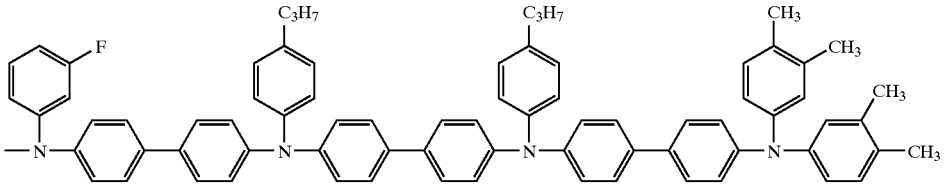
(CT-21)
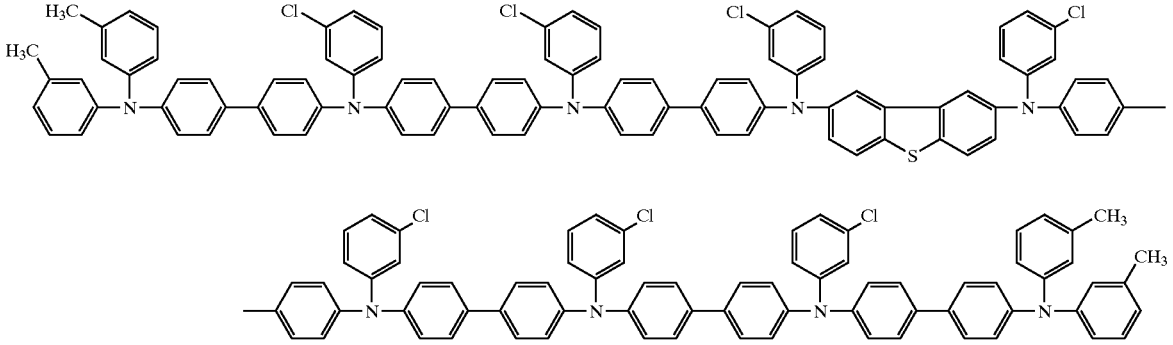
(CT-22)
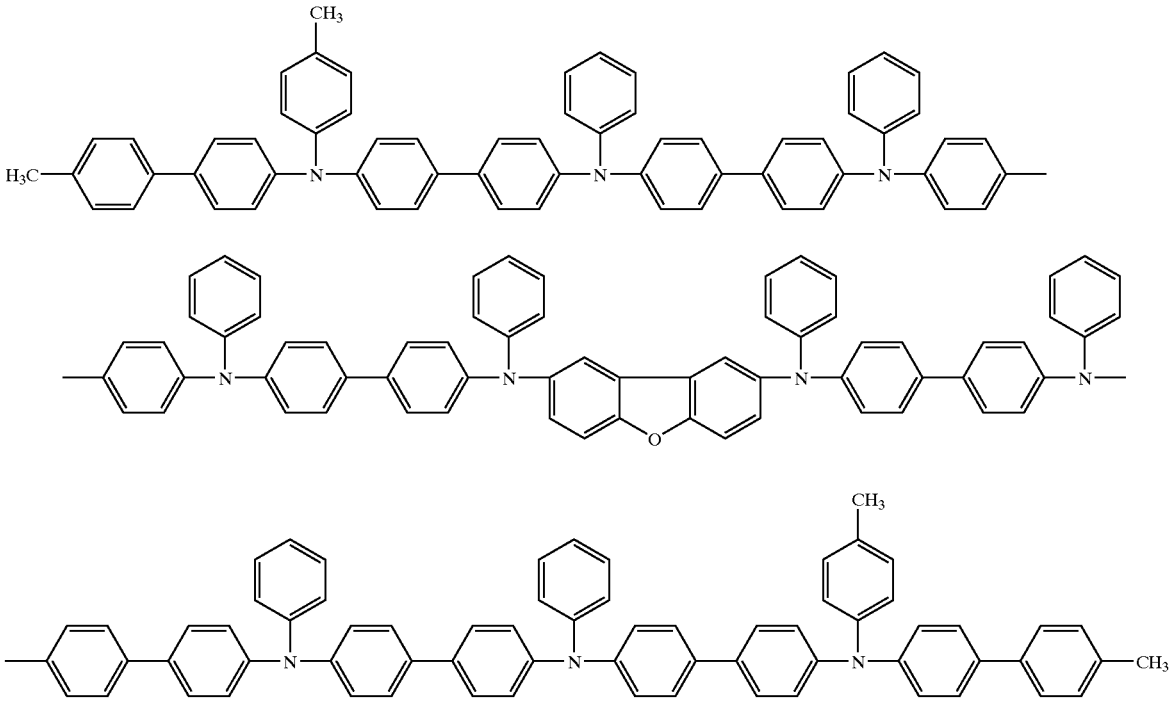
(CT-23)
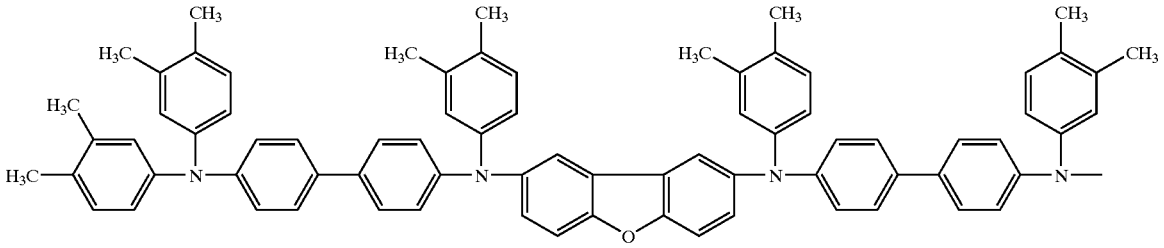

-continued
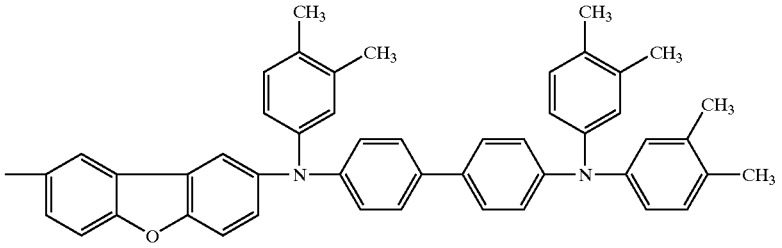
(CT-24)
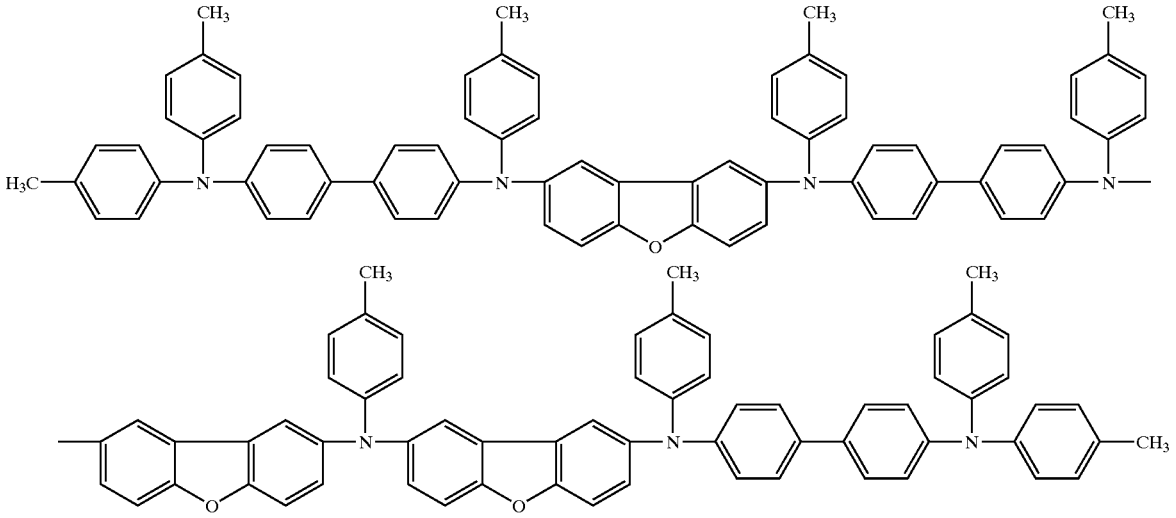
(CT-25)
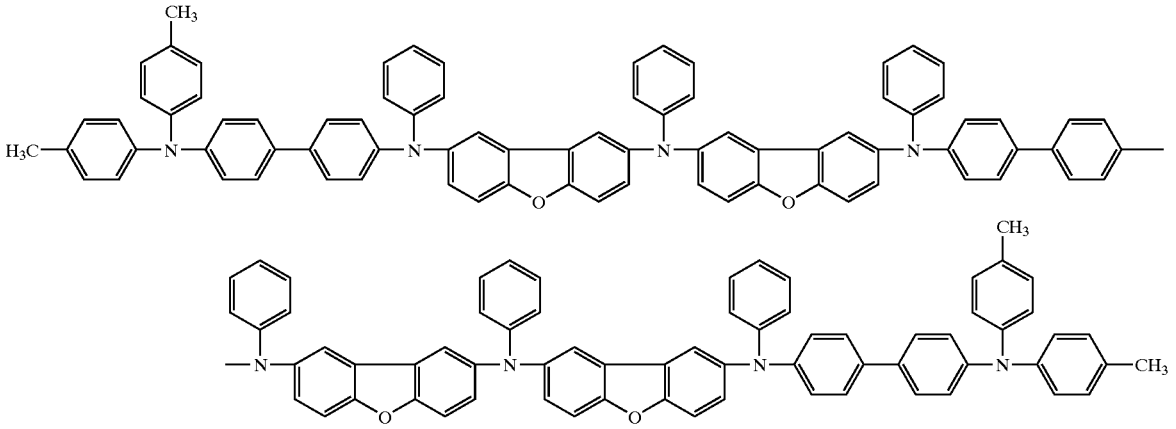
(CT-26)
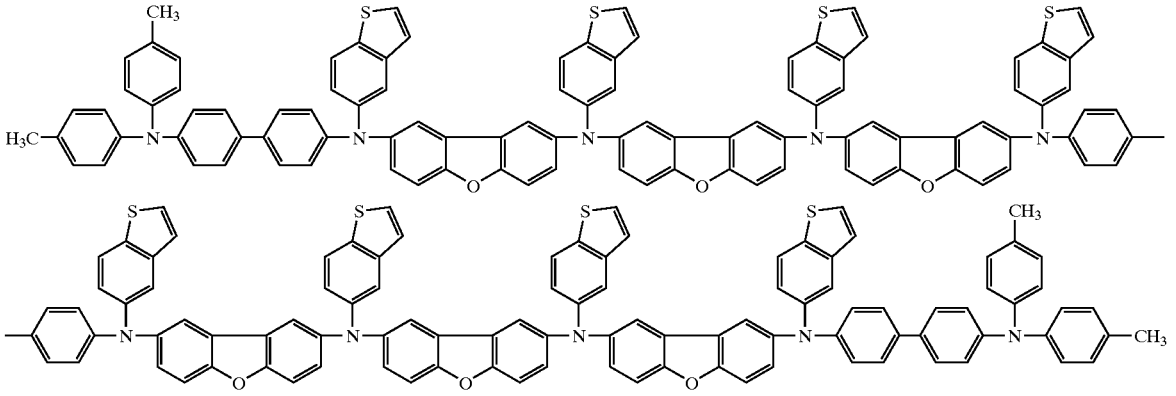

-continued
(CT-27)
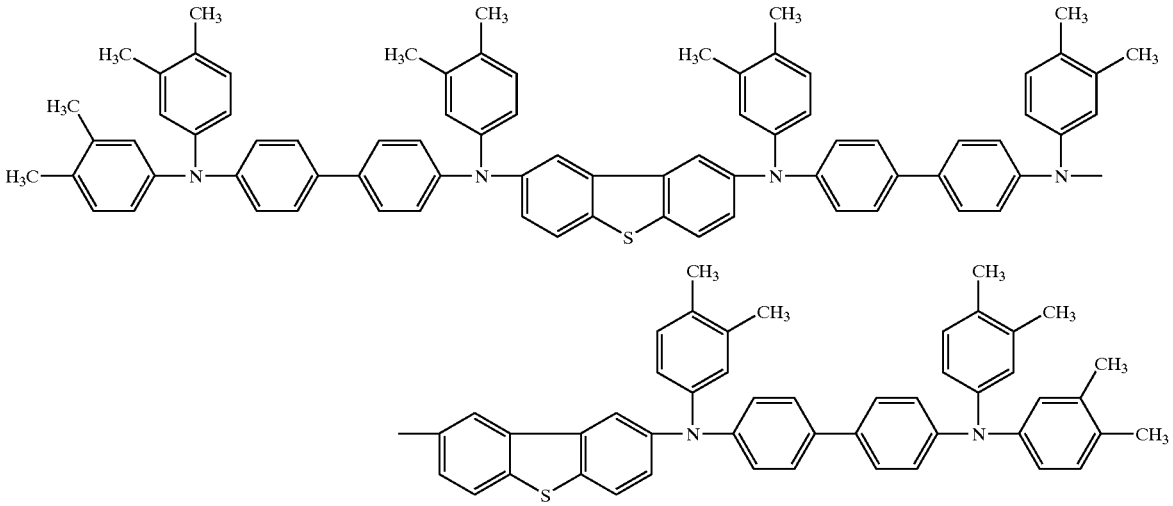
(CT-28)
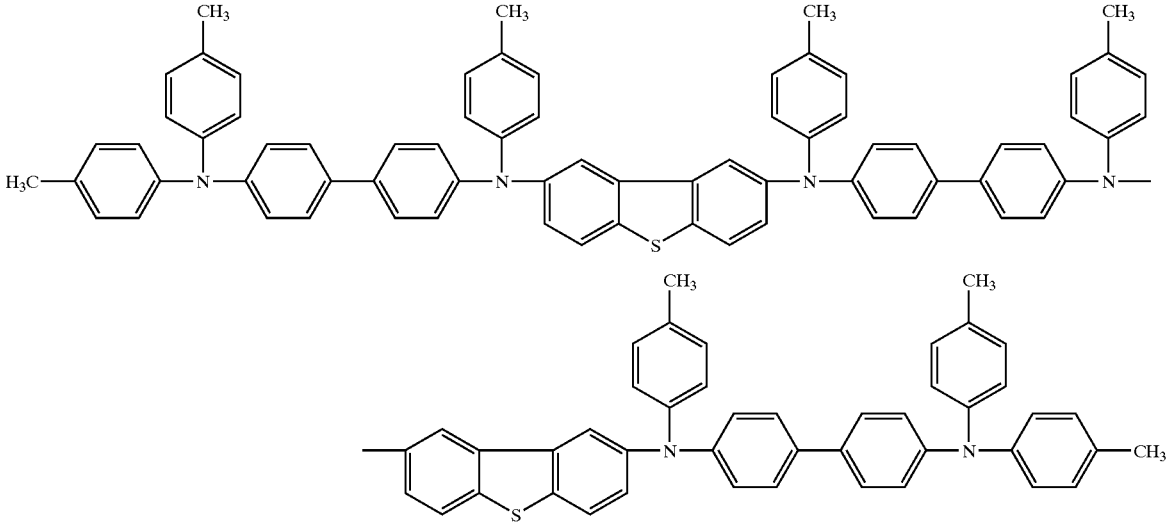
(CT-29)
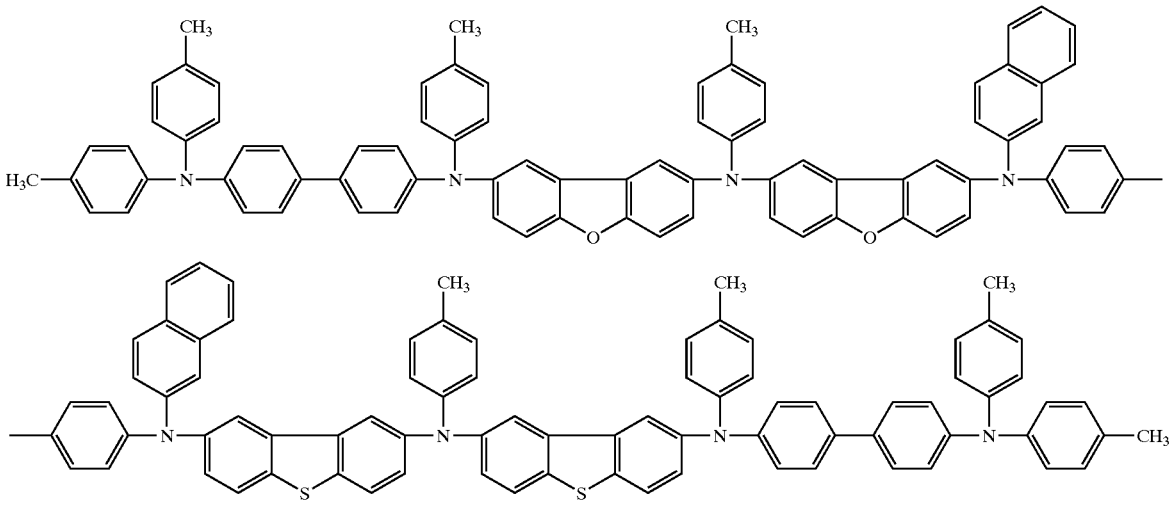

-continued
(CT-30)
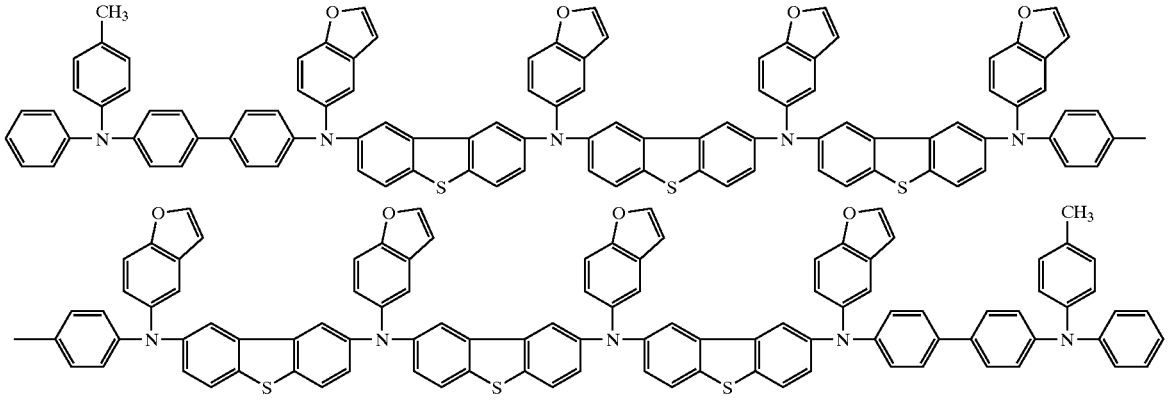
(CT-31)
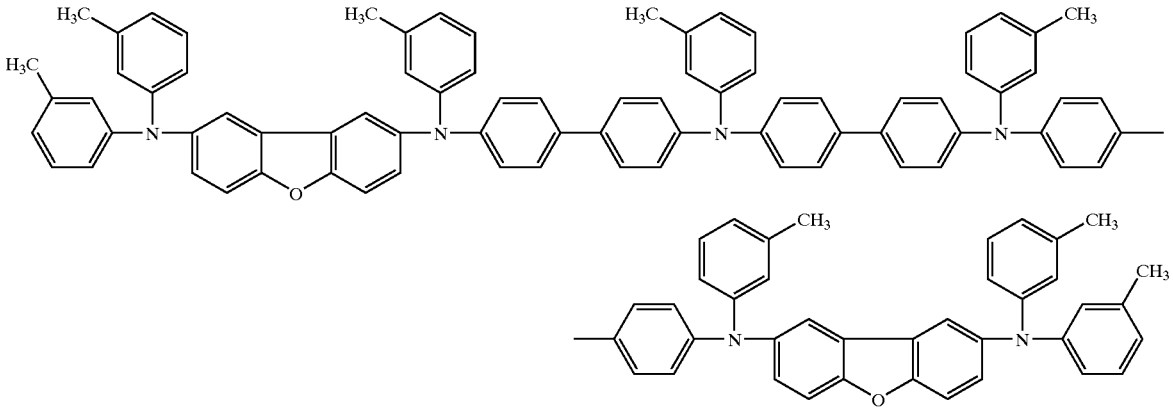
(CT-32)
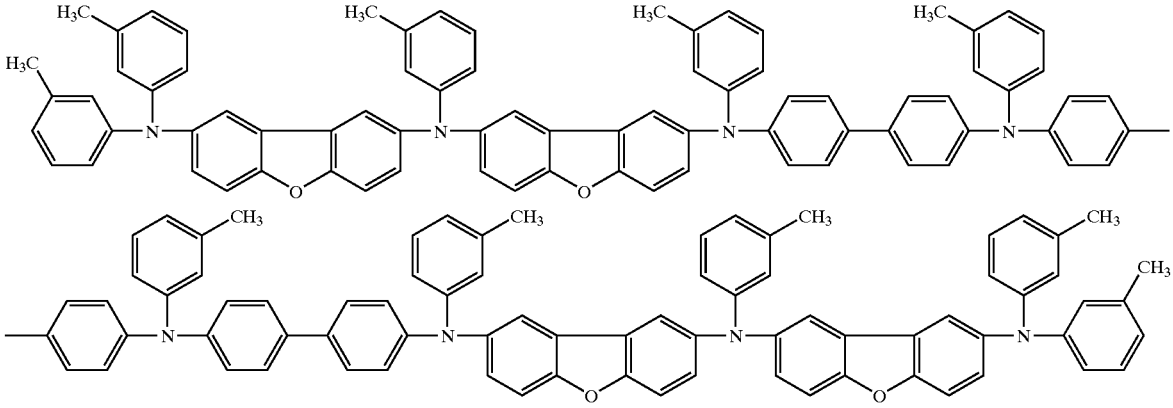
(CT-33)
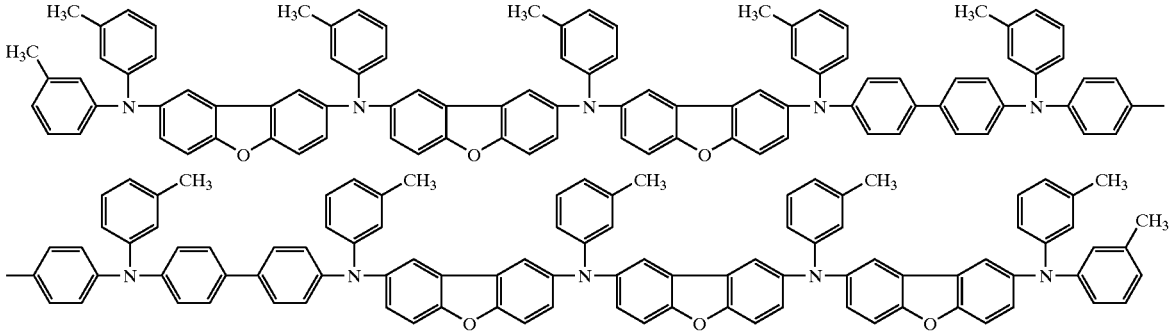

-continued
(CT-34)
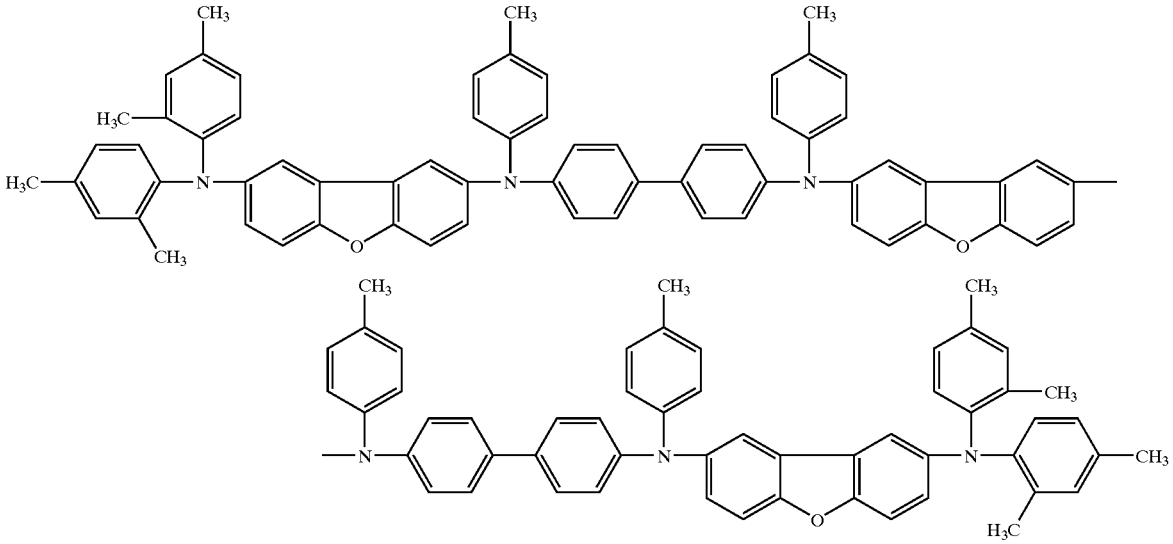
(CT-35)
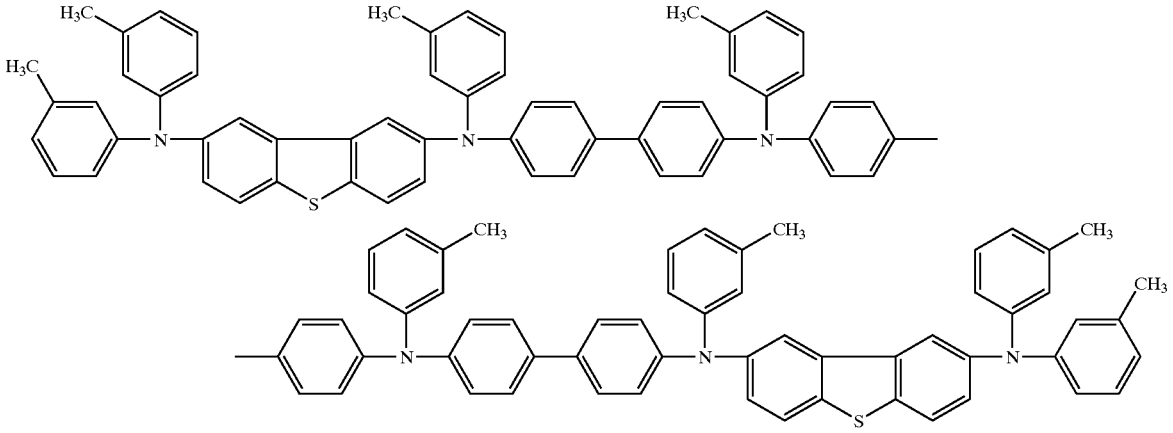
(CT-36)
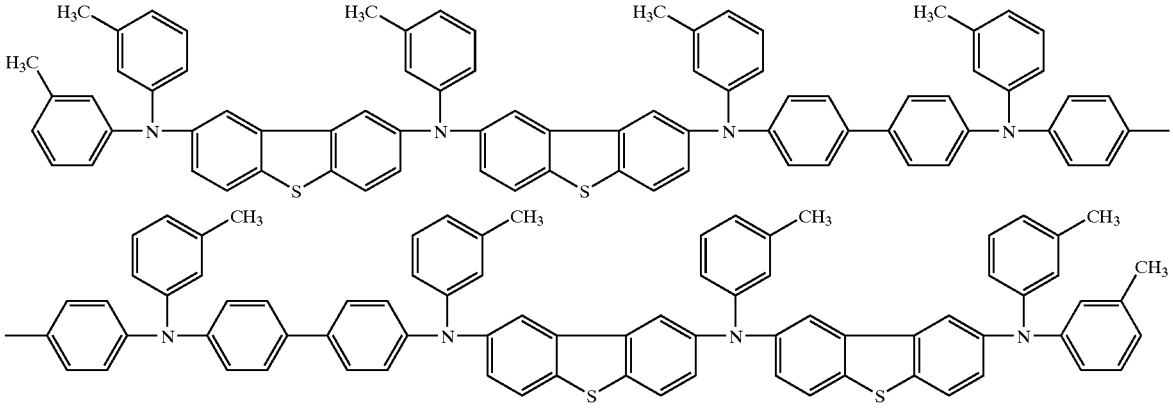
(CT-37)
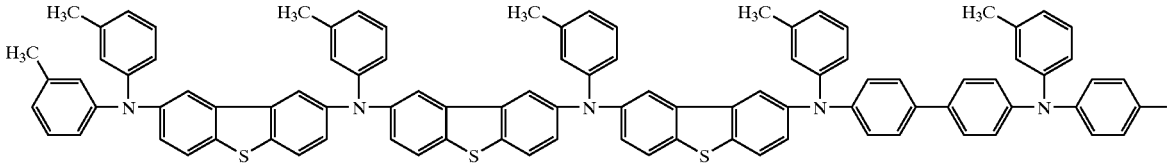

-continued
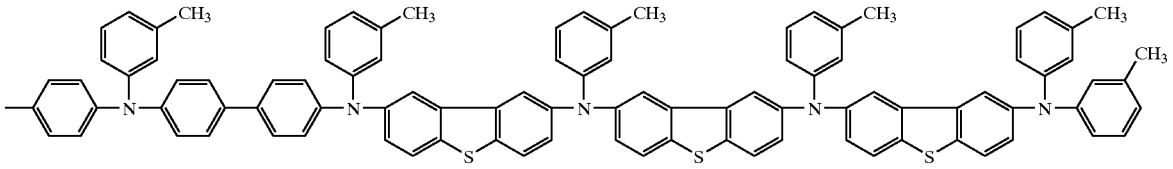
(CT-38)
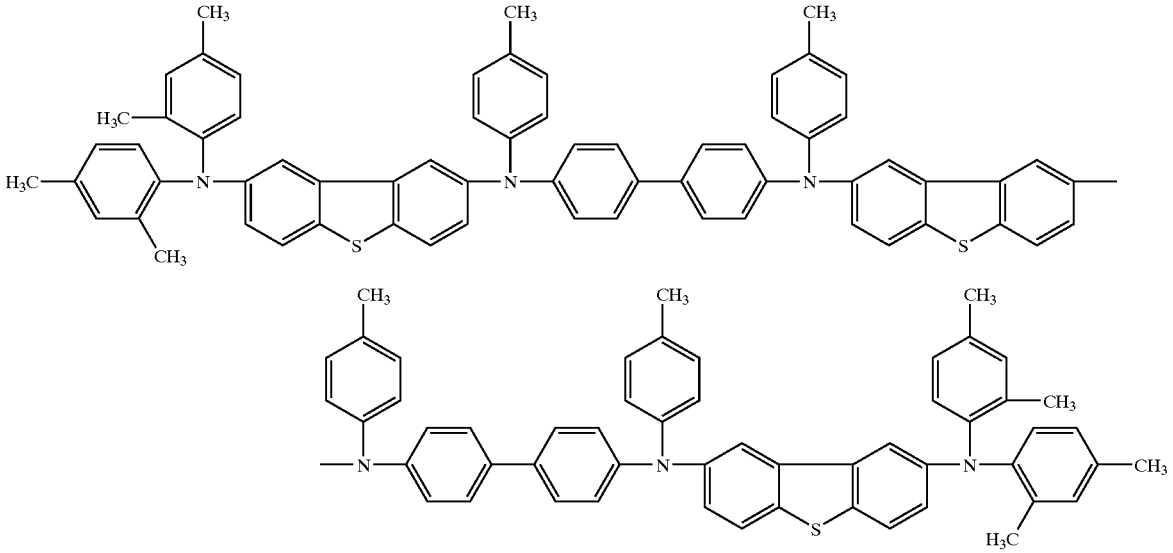
(CT-39)
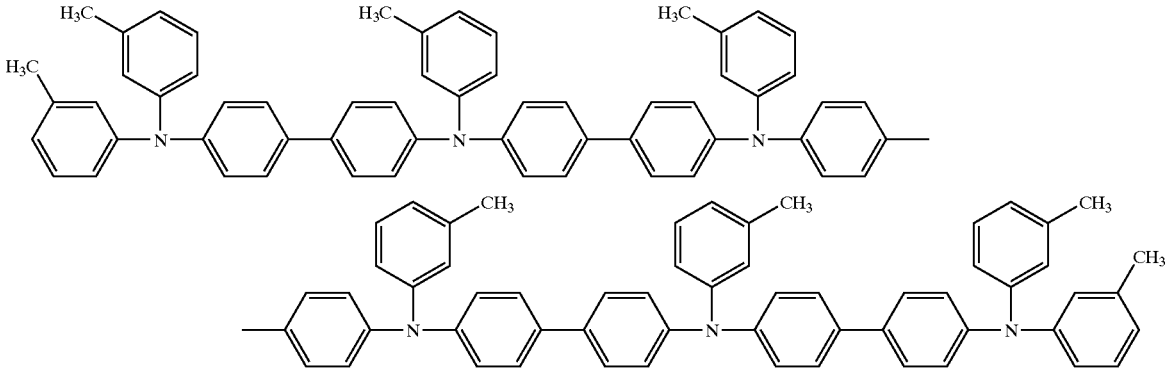
(CT-40)
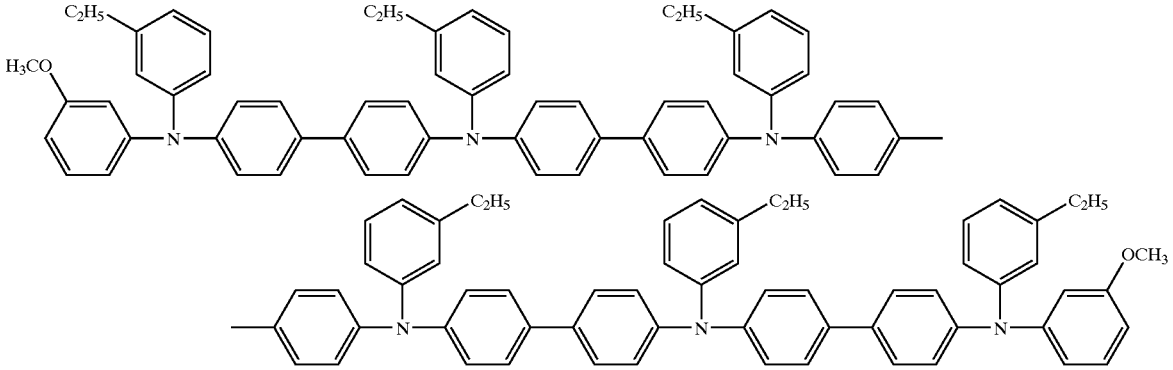

-continued
(CT-41)
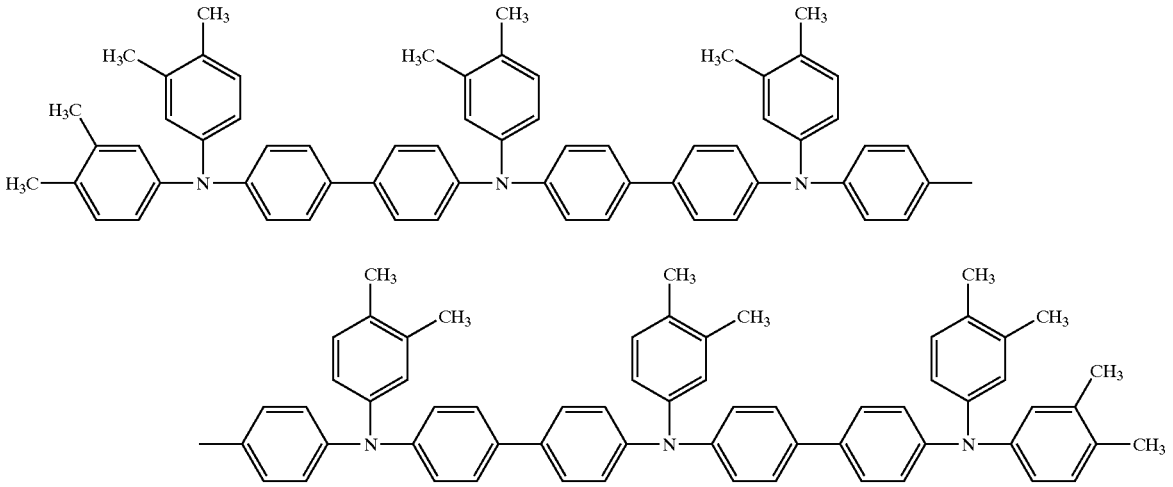
(CT-42)
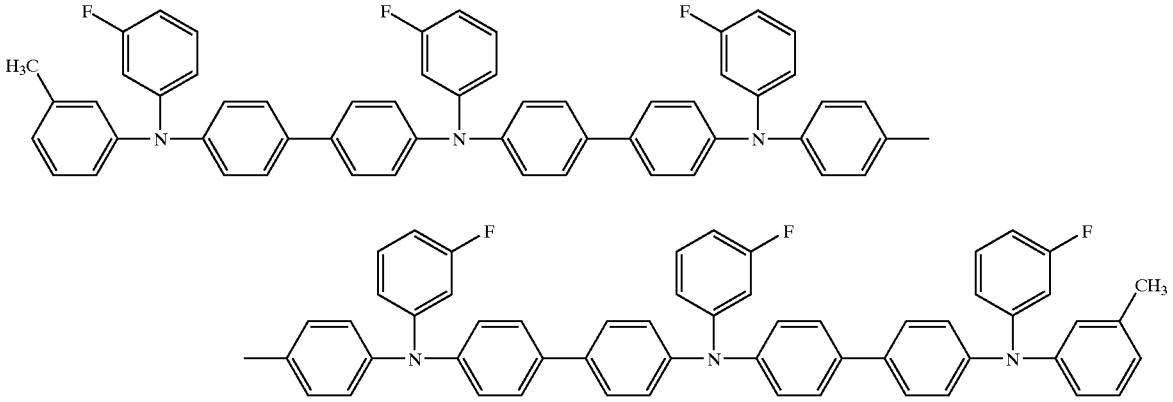
(CT-43)
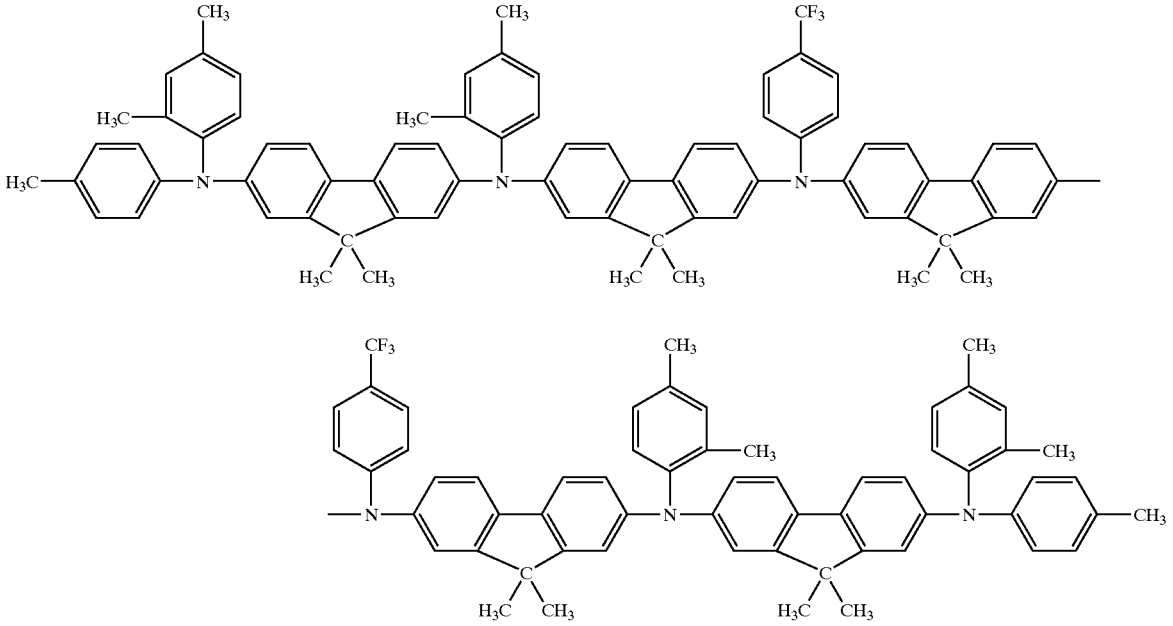

-continued
(CT-44)
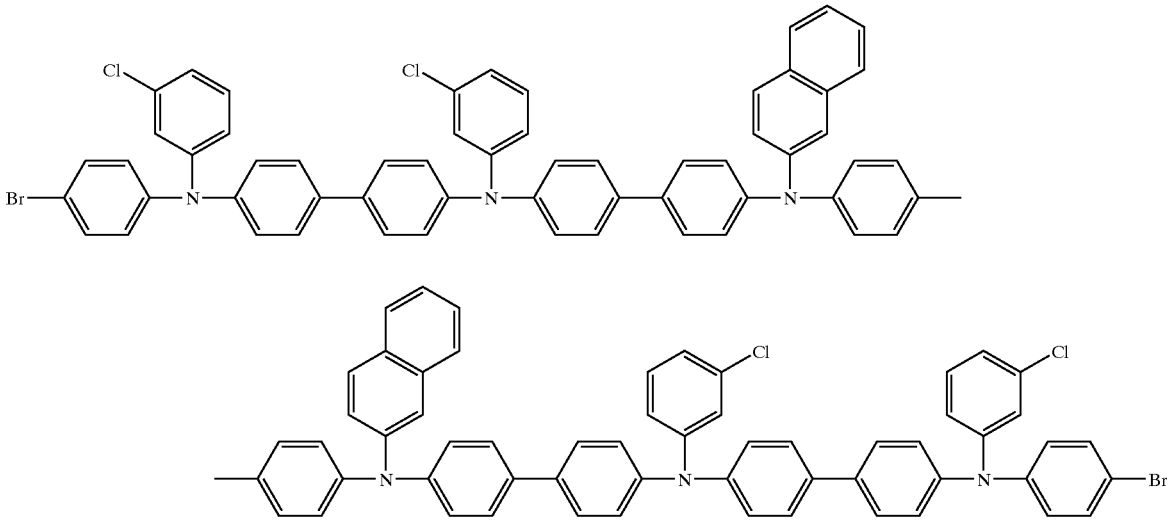
(CT-45)
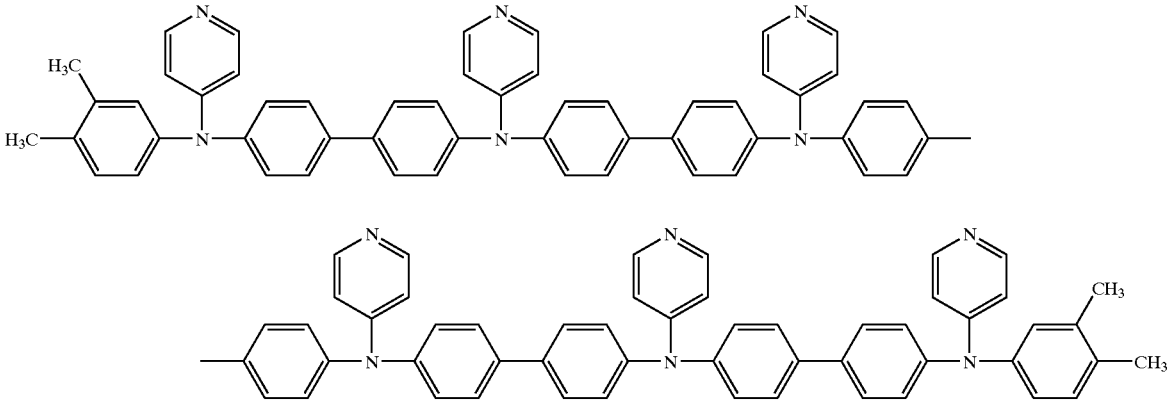
(CT-46)
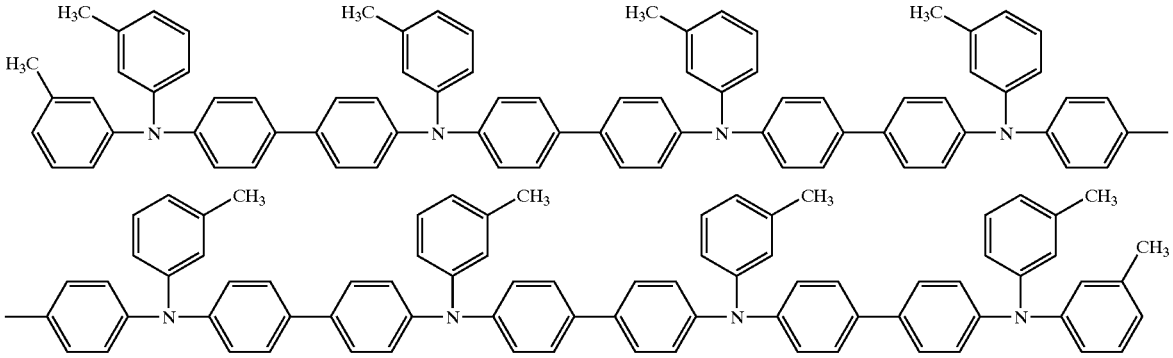
(CT-47)
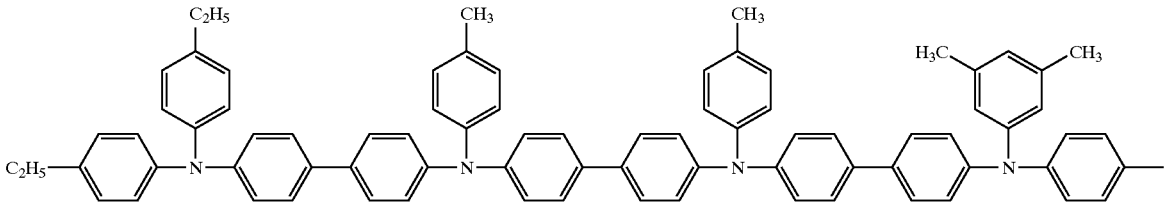

-continued
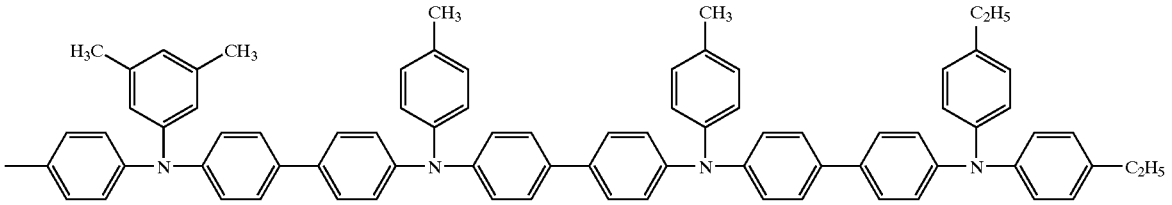
(CT-48)
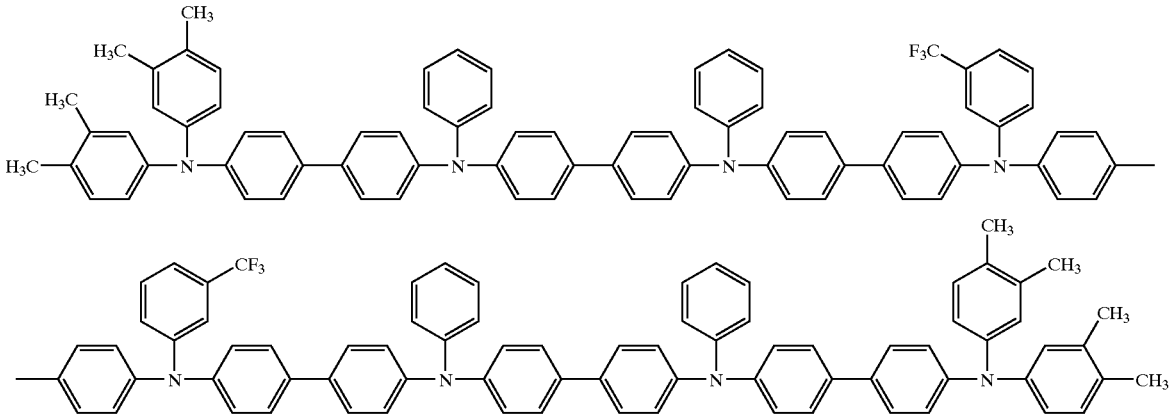
(CT-49)
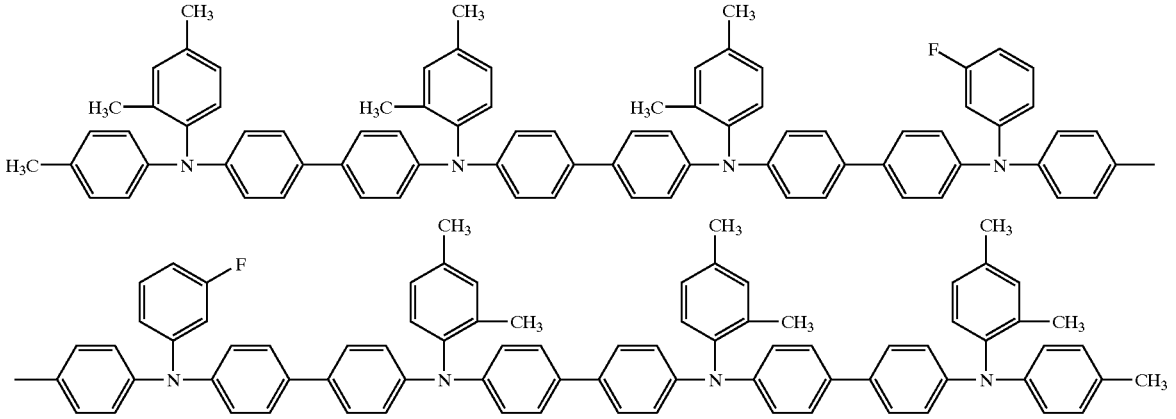
(CT-50)
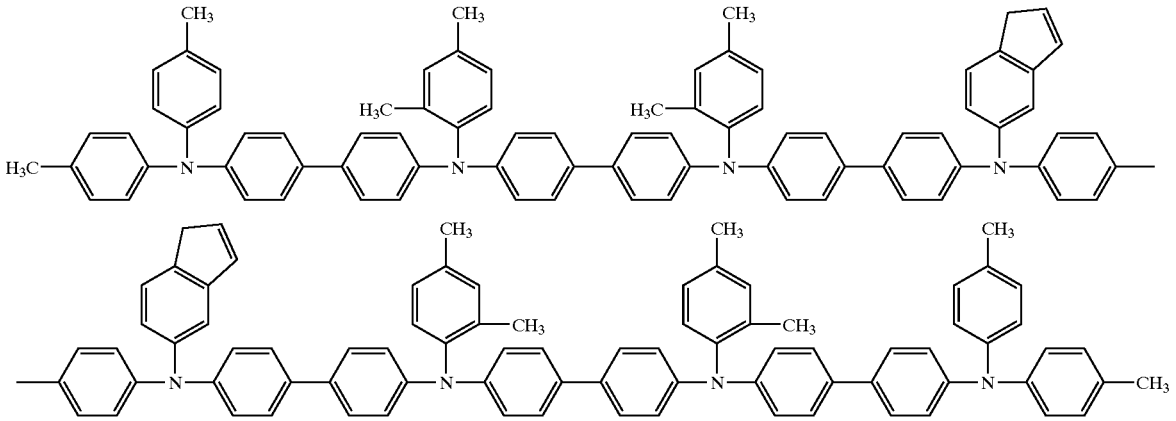

-continued
(CT-51)
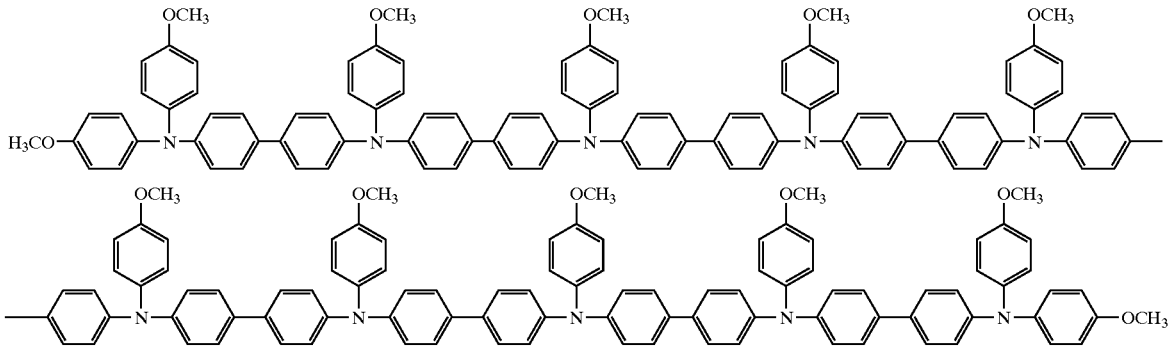
(CT-52)
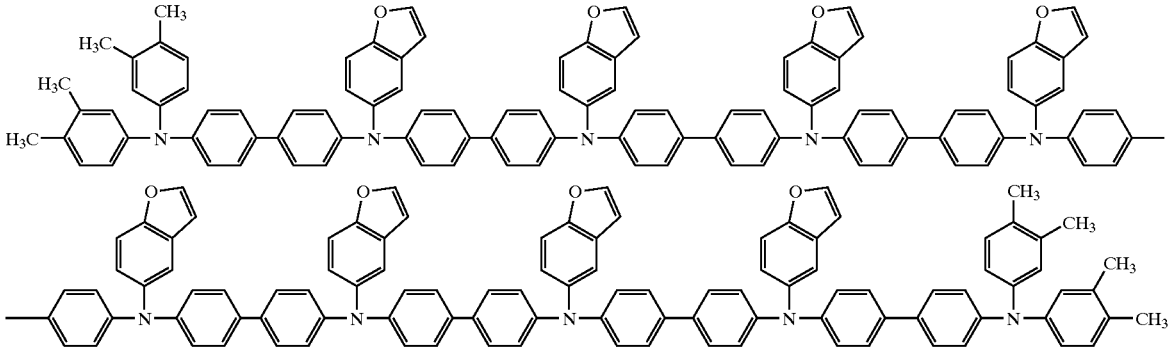
(CT-53)
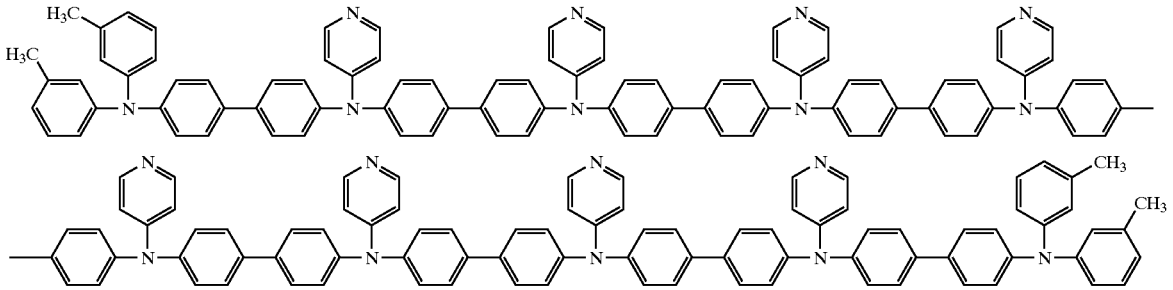
(CT-54)
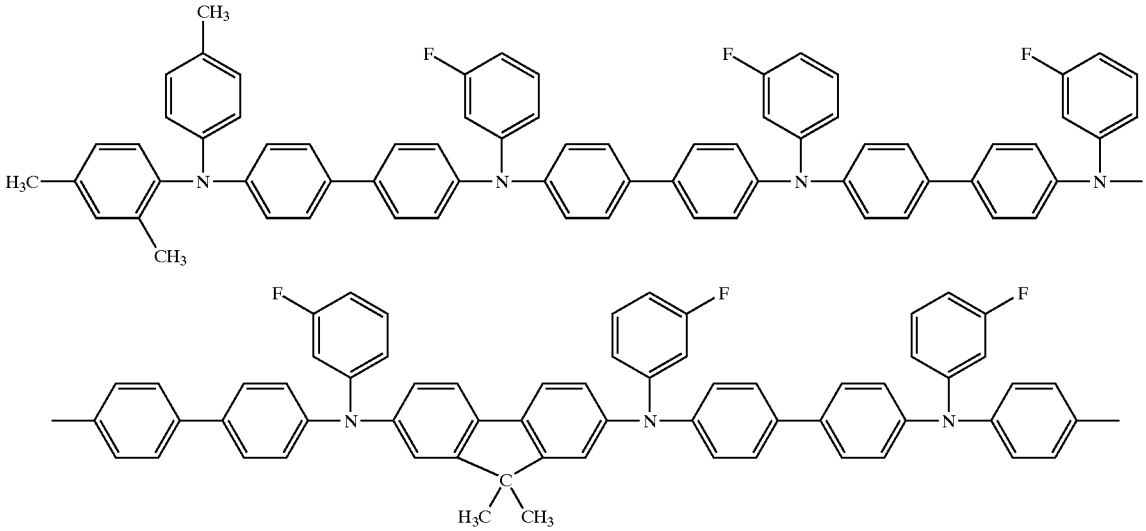

-continued
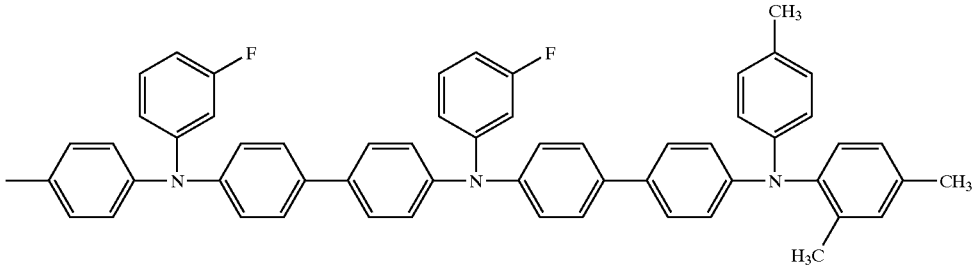
(CT-55)
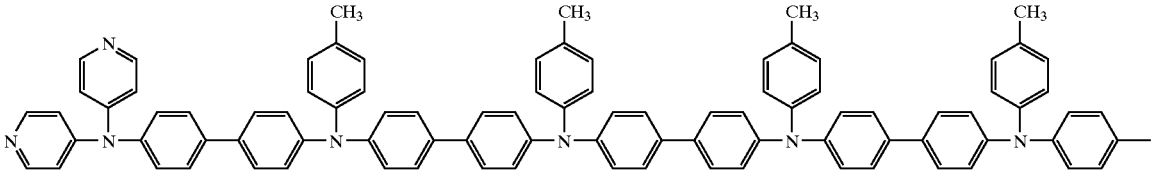
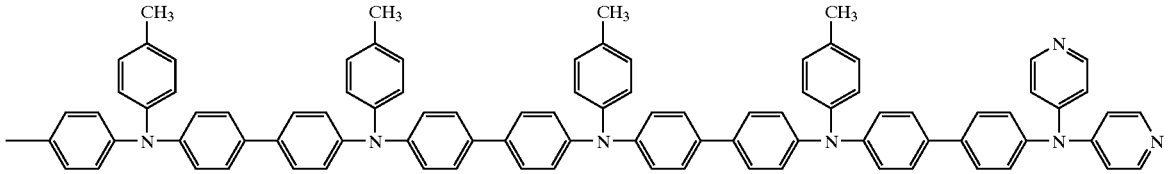
(CT-56)
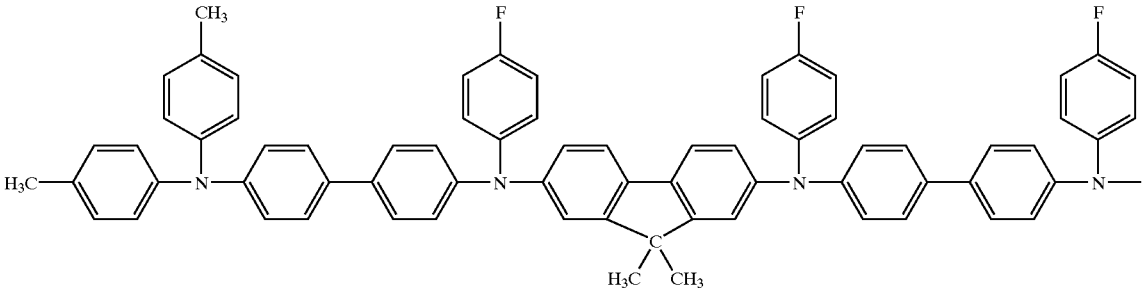
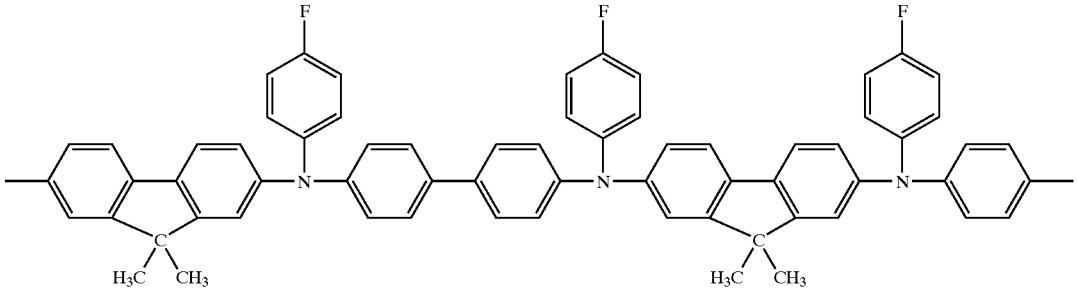
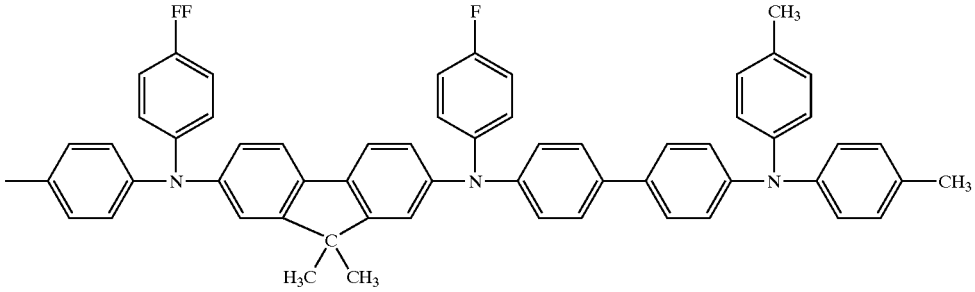

-continued
(CT-57)
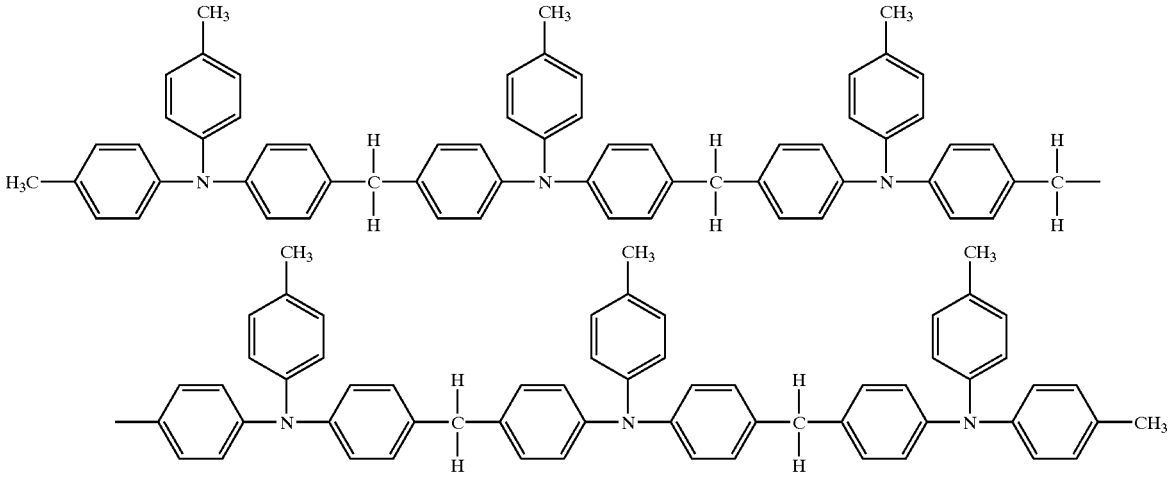
(CT-58)
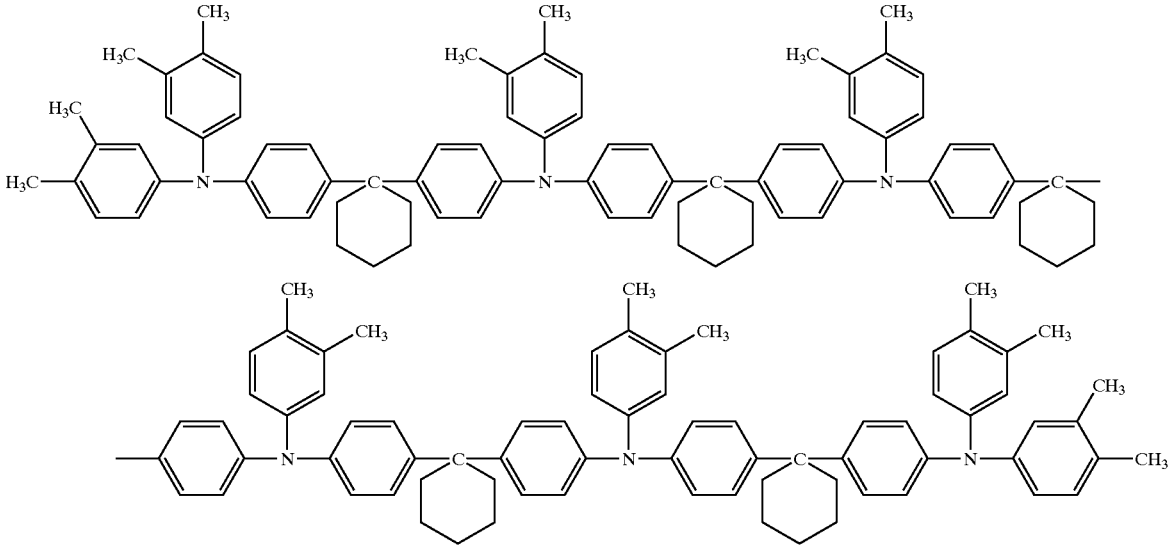
(CT-59)
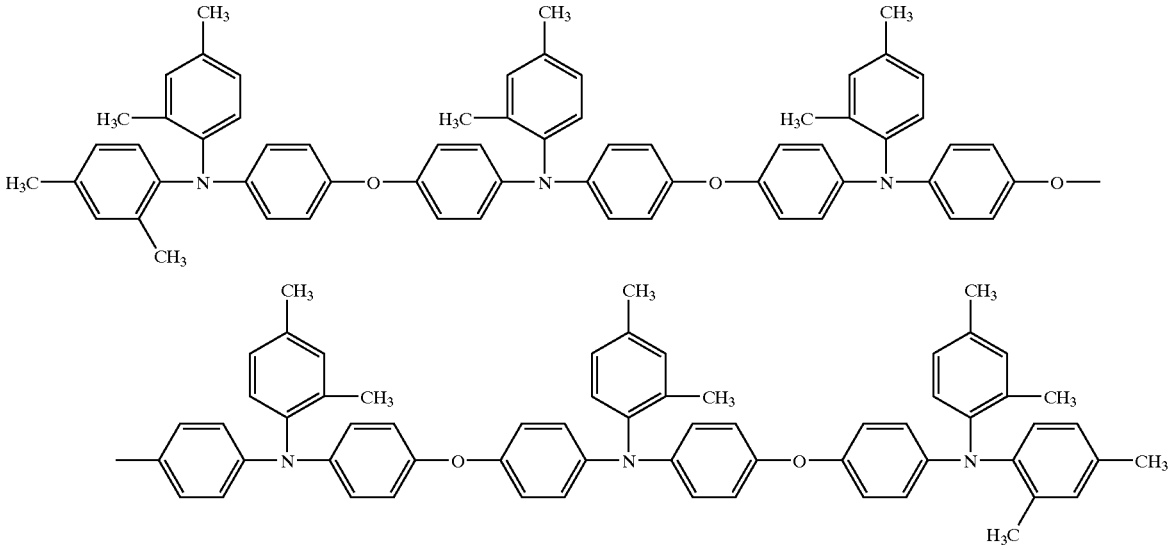

-continued (CT-60)

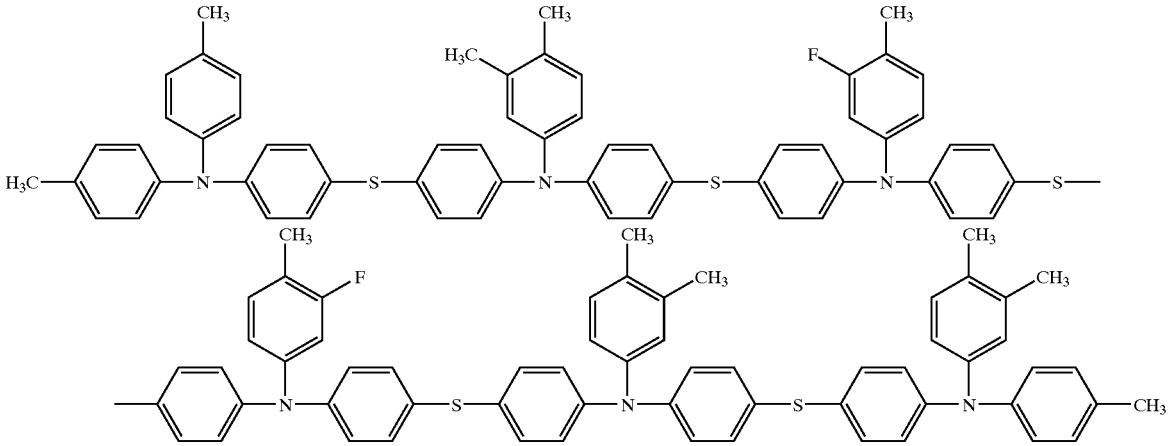

(CT-61)

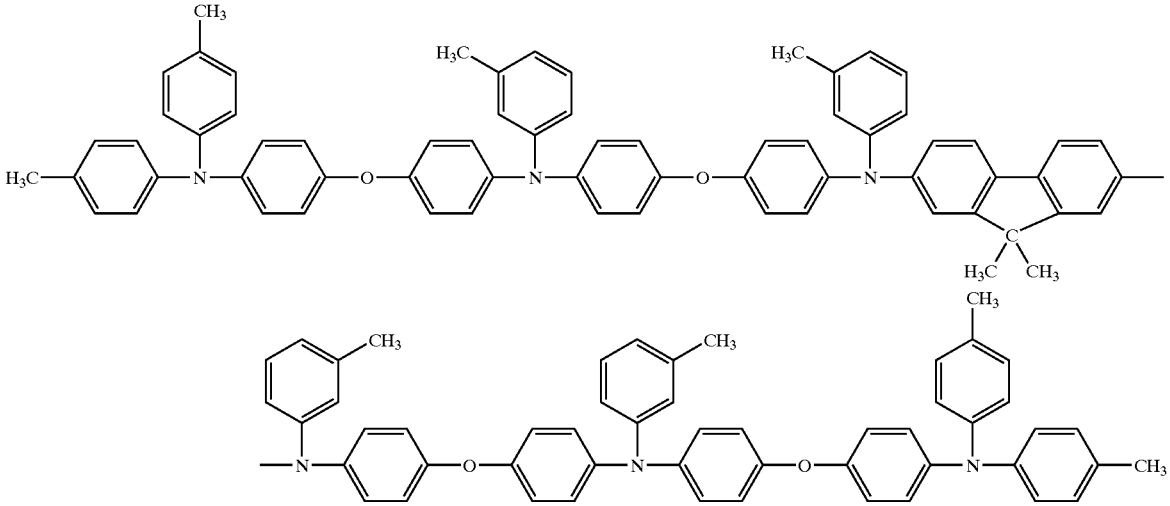

(CT-62)

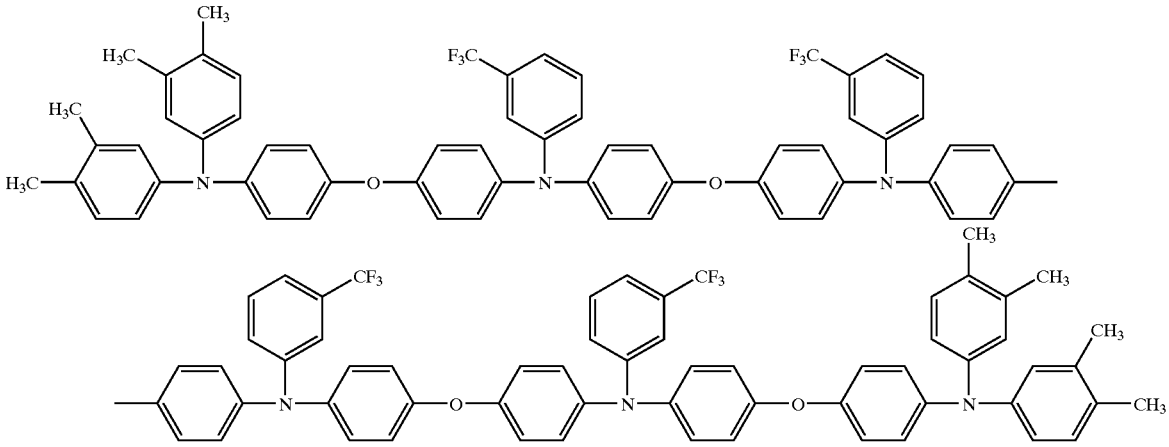

The charge-transporting material in the present invention may preferably have a molecular weight of from 1,500 to 4,000, and more preferably from 1,500 to 3,500.

The charge-transporting material in the present invention is characterized by being a high-molecular-weight charge-transporting material having a high singleness (being structurally single), represented by only a specific chemical structural formula. Hence, this charge-transporting material is difficult to produce by a production process carried out by repeated polymerization reaction of a monomer. Accordingly, it is preferable to use a charge-transporting material synthesized by a successive synthesis method which repeatedly carries out a synthesis process having conventionally been used in producing a low-molecular-weight charge-transporting material. The successive synthesis method is a method for synthesis in which the reaction of a raw material with a material to be reacted is carried out in a multi-stage process to form a single compound as a chief product. It differs from a production method of synthesizing by polymerization reaction a compound having molecular weight distribution, and enables selective production of a charge-transporting material having so high singleness as not to have molecular weight distribution.

In the synthesis reaction used in the successive synthesis method, synthesis reaction having conventionally been used in producing low-molecular-weight charge-transporting materials is used. More specifically, Ullmann reaction or synthesis using a metal catalyst is used. The multi-stage synthesis may successively be continued to produce the intended charge-transporting material, or, after one step of synthesis has been completed, the step of purification may be inserted before the step of next-stage synthesis. Any purification methods conventionally commonly used may also be used after the final step has been completed. More specifically, there may be applied means such as treatment with an adsorbent such as activated clay, activated carbon, silica or alumina, purification by column chromatography making use of silica or alumina or gel permeation column chromatography making use of fine polystyrene particles, and purification by recrystallization or crystallization.

Production Examples of the charge-transporting material in the present invention are shown below. The present invention is by no means limited to these.

PRODUCTION EXAMPLE 1

Production of Exemplary Compound (CT-10) of Charge-Transporting Material

Production of bis(2,4-dimethylphenyl)amine

Into a 1 liter three-necked reaction vessel fitted with a cooling tube and a mechanical stirrer, 133 g (1.1 mols) of 2,4-dimethylphenylamine, 185 g (1.0 mol) of 1-bromo-2,4-dimethylbenzene, 11.2 g (0.05 mol) of palladium acetate, 32.4 g (0.2 mol) of 2-tert-butylphosphinoyl-2-methylpropane, 212 g (1.0 mol) of tripotassium phosphate and 500 mL of dimethylformamide were introduced to effect reflux for 12 hours in a nitrogen gas atmosphere and with heating in an oil bath. After the reaction was completed, the reaction mixture was left to cool to room temperature, followed by extraction with toluene/water, then washing with hydrochloric acid water, and thereafter distillation of the organic layer under reduced pressure to give the desired bis(2,4-dimethylphenyl)amine. The compound obtained was in a yield of 189 g corresponding to 84%. The compound obtained was measured with an elementary analyzer (CHN CORDER MT-5, manufactured by Yanako K.K.). In the following elementary analyses, the units of the found values and calculated values are % by weight.

Found: C, 85.24; H, 8.53; N, 6.63. (Calculated: C, 85.28; H, 8.50; N, 6.22).

Production of bis(2,4-dimethylphenyl)[4-(bromophenyl)phenyl]amine

Into a 2 liter three-necked reaction vessel fitted with a cooling tube and a mechanical stirrer, 112.5 g (0.5 mol) of bis(2,4-dimethylphenyl)amine, 156 g (0.5 mol) of 4,4-dibromophenyl, 5.6 g (0.025 mol) of palladium acetate, 27.7 g (0.05 mol) of bis(diphenylphosphino)ferrocene, 63.7 g (0.7 mol) of tert-butoxysodium (sodium tert-butoxide) and 800 mL of xylene were introduced to effect reflux for 5 hours in a nitrogen gas atmosphere and with heating in an oil bath. After the reaction was completed, the reaction mixture was left to cool to room temperature, followed by extraction with toluene/water, then washing with hydrochloric acid water, and thereafter distillation of the organic layer under reduced pressure and purification with a silica gel column (developer solvent: hexane/toluene=2:1) to give the desired bis(2,4-dimethylphenyl)[4-(bromophenyl)phenyl]amine. The compound obtained was in a yield of 155.2 g corresponding to 68%. The compound obtained was measured with the same elementary analyzer as the above.

Found: C, 73.44; H, 5.62; N, 2.98. (Calculated: C, 73.68; H, 5.74; N, 3.07).

Production of bis(2,4-dimethylphenyl)(4-{4-[(2,4-dimethylphenyl)amino]phenyl}phenyl)amine Into a 1 liter three-necked reaction vessel fitted with a cooling tube and a mechanical stirrer, 91.3 g (0.2 mol) of bis(2,4-dimethylphenyl)[4-(bromophenyl)phenyl]amine, 36.3 g (0.3 mol) of 2,4-dimethylphenylamine, 2.24 g (0.01 mol) of palladium acetate, 11.1 g (0.02 mol) of bis(diphenylphosphino)ferrocene, 26.9 g (0.28 mol) of tert-butoxysodium and 500 mL of xylene were introduced to effect reflux for 3 hours in a nitrogen gas atmosphere and with heating in an oil bath. After the reaction was completed, the reaction mixture was left to cool to room temperature, followed by extraction with toluene/water, then washing with hydrochloric acid water, and thereafter distillation of the organic layer under reduced pressure and purification with a silica gel column (developer solvent: hexane/toluene=1:1) to give the desired bis(2,4-dimethylphenyl)(4-{4-[(2,4-dimethylphenyl)amino]phenyl}phenyl)amine. The compound obtained was in a yield of 83.4 g corresponding to 84%. The compound obtained was measured with the same elementary analyzer as the above.

Found: C, 87.03; H, 7.26; N, 5.71. (Calculated: C, 87.05; H, 7.31; N, 5.64).

Production of bis(2,4-dimethylphenyl)[4-(4-{(2,4-dimethylphenyl)[4-(4-bromophenyl)phenyl]amino}phenyl)phenyl]amine Into a 1 liter three-necked reaction vessel fitted with a cooling tube and a mechanical stirrer, 49.7 g (0.1 mol) of bis(2,4-dimethylphenyl)(4-{4-[(2,4-dimethylphenyl)amino]phenyl}phenyl)amine, 31.2 g (0.1 mol) of 4,4'-dibromophenyl, 1.13 g (0.005 mol) of palladium acetate, 5.54 g (0.01 mol) of bis(diphenylphosphino)ferrocene, 13.4 g (0.14 mol) of tert-butoxysodium and 300 mL of xylene were introduced to effect reflux for 5 hours in a nitrogen gas atmosphere and with heating in an oil bath. After the reaction was completed, the reaction mixture was left to cool to room temperature, followed by extraction with toluene/water, then washing with hydrochloric acid water, and thereafter distillation of the organic layer under reduced pressure and purification with a silica gel column (developer solvent: hexane/toluene=2:1) to give the desired bis(2,4-dimethylphenyl)[4-(4-{(2,4-dimethylphenyl)[4-(4-bromophenyl)phenyl]amino}phenyl)phenyl]amine. The compound obtained was in a yield of 50.9 g corresponding to 70%. The compound obtained was measured with the same elementary analyzer as the above.

Found: C, 79.26; H, 5.98; N, 3.83. (Calculated: C, 79.22; H, 5.96; N, 3.85).

Production of (2,4-dimethylphenyl){8-[(2,4-dimethylphenyl)amino]dibenzo[b,d]furan-2-yl}amine Into a 500 mL three-necked reaction vessel fitted with a cooling tube and a mechanical stirrer, 65.2 g (0.2 mol) of 2,8-dibromodibenzofuran, 72.6 g (0.6 mol) of 2,4-dimethylphenylamine, 2.24 g (0.01 mol) of palladium acetate, 12.2 g (0.04 mol) of tri(o-tolyl)phosphine, 51.8 g (0.54 mol) of tert-butoxysodium and 300 mL of xylene were introduced to effect reflux for 5 hours in a nitrogen gas atmosphere and with heating in an oil bath. After the reaction was completed, an excess amount of 2,4-dimethylphenylamine and the solvent were distilled away under reduced pressure, and the reaction mixture was left to cool to room temperature, followed by extraction with toluene/water, then washing with hydrochloric acid water, and thereafter distillation of the solvent from the organic layer under reduced pressure and also recrystallization to give the desired (2,4-dimethylphenyl){8-[(2,4-dimethylphenyl)amino]dibenzo[b,d]furan-2-yl}amine. The compound obtained was in a yield of 71.5 g corresponding to 88%. The compound obtained was measured with the same elementary analyzer as the above.

Found: C, 82.68; H, 6.44; N, 6.92. (Calculated: C, 82.73; H, 6.45; N, 6.89).

Production of Exemplary Compound (CT-10) of Charge-transporting Material

Into a 500 mL three-necked reaction vessel fitted with a cooling tube and a mechanical stirrer, 36.4 g (0.05 mol) of bis(2,4-dimethylphenyl)[4-(4-{(2,4-dimethylphenyl)[4-(4-bromophenyl)phenyl]amino}phenyl)phenyl]amine, 10.2 g (0.025 mol) of (2,4-dimethylphenyl){8-[(2,4-dimethylphenyl)amino]dibenzo[b,d]furan-2-yl}amine, 0.57 g (0.0025 mol) of palladium acetate, 3.0 g (0.01 mol) of biphenyl-2-yl-ditert-butylphosphine, 6.7 g (0.07 mol) of tert-butoxysodium and 200 mL of xylene were introduced to effect reflux for 4 hours in a nitrogen gas atmosphere and with heating in an oil bath. After the reaction was completed, the reaction mixture was left to cool to room temperature, followed by extraction with toluene/water, then washing with hydrochloric acid water, and thereafter distillation of the solvent from the organic layer under reduced pressure and purification with a silica gel column (developer solvent: hexane/toluene=1:1) to give the desired charge-transporting material shown as the exemplary compound (CT-10). The compound obtained was in a yield of 39.1 g corresponding to 89%. The compound obtained was measured with the same elementary analyzer as the above.

Found: C, 84.80; H, 5.81; N, 4.83. (Calculated: C, 84.85; H, 5.85; N, 4.79).

Mass analysis of the compound obtained was made using a laser desorption ionization time-of-flight mass (MALDI-TOF-MASS) spectrometer (REFLEX III; manufactured by Bruker Co.; matrix: 9-nitroanthracene). The mass spectrum measurement results obtained are shown in FIG. 1 where the abscissa indicates the mass-to-charge ratio [mass (m) of ions formed/valence (z) of ions formed] and the ordinate indicates the intensity of ions formed and detected.

PRODUCTION EXAMPLE 2

Production of Exemplary Compound (CT-17) of Charge-Transporting Material

Production of (2,4-dimethylphenyl){8-[(2,4-dimethylphenyl)amino]dibenzo[b]benzo[b]thiophen-2-yl}amine Into a 500 mL three-necked reaction vessel fitted with a cooling tube and a mechanical stirrer, 68.4 g (0.2 mol) of 2,8-dibromodibenzothiophene, 72.6 g (0.6 mol) of 2,4-dimethylphenylamine, 2.24 g (0.01 mol) of palladium acetate, 12.2 g (0.04 mol) of tri(o-tolyl)phosphine, 51.8 g (0.54 mol) of tert-butoxysodium and 300 mL of xylene were introduced to effect reflux for 5 hours in a nitrogen gas atmosphere and with heating in an oil bath. After the reaction was completed, an excess amount of 2,4-dimethylphenylamine and the solvent were distilled away under reduced pressure, and the reaction mixture was left to cool to room temperature, followed by extraction with toluene/water, then washing with hydrochloric acid water, and thereafter distillation of the solvent from the organic layer under reduced pressure and also recrystallization to give the desired (2,4-dimethylphenyl){8-[(2,4-dimethylphenyl)amino]dibenzo[b]benzo[b]thiophen-2-yl}amine. The compound obtained was in a yield of 71.0 g corresponding to 84%. The compound obtained was measured with the same elementary analyzer as the above.

Found: C, 79.60; H, 6.24; N, 6.52. (Calculated: C, 79.58; H, 6.20; N, 6.63).

Production of Exemplary Compound (CT-17) of Charge-Transporting Material

Into a 500 mL three-necked reaction vessel fitted with a cooling tube and a mechanical stirrer, 36.4 g (0.05 mol) of bis(2,4-dimethylphenyl)[4-(4-{(2,4-dimethylphenyl)[4-(4-bromophenyl)phenyl]amino}phenyl)phenyl]amine, 10.6 g (0.025 mol) of (2,4-dimethylphenyl){8-[(2,4-dimethylphenyl)amino]dibenzo[b]benzo[b]thiophen-2-yl}amine, 0.57 g (0.0025 mol) of palladium acetate, 3.0 g (0.01 mol) of biphenyl-2-yl-ditert-butylphosphine, 6.7 g (0.07 mol) of tert-butoxysodium and 200 mL of xylene were introduced to effect reflux for 4 hours in a nitrogen gas atmosphere and with heating in an oil bath. After the reaction was completed, the reaction mixture was left to cool to room temperature, followed by extraction with toluene/water, then washing with hydrochloric acid water, and thereafter distillation of the solvent from the organic layer under reduced pressure and purification with a silica gel column (developer solvent: hexane/toluene=1:1) to give the desired charge-transporting material shown as the exemplary compound (CT-17). The compound obtained was in a yield of 37.3 g corresponding to 87%. The compound obtained was measured with the same elementary analyzer as the above.

Found: C, 86.80; H, 6.40; N, 4.86. (Calculated: C, 86.78; H, 6.46; N, 4.90).

Figure 2:
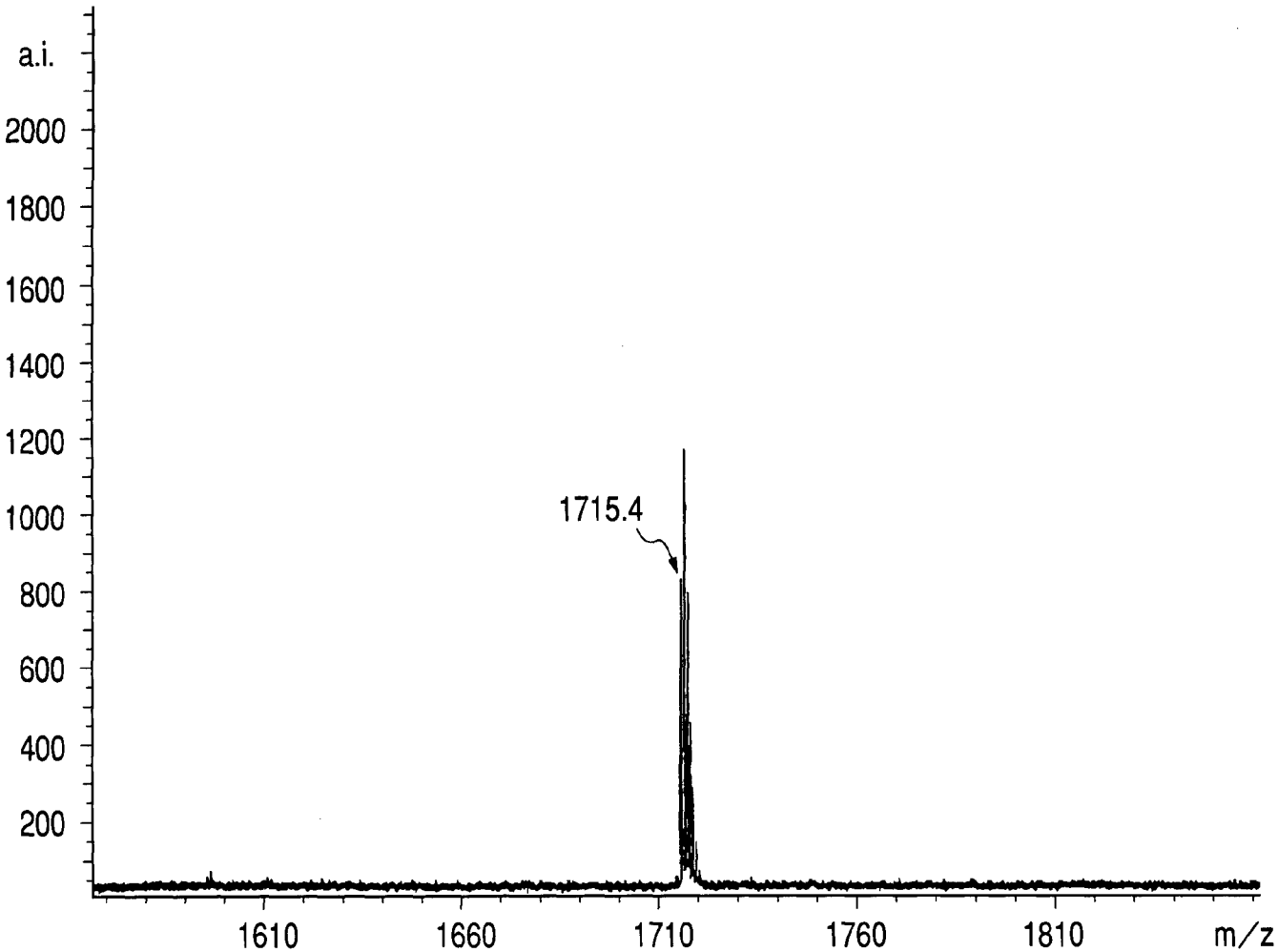
FIG. 2 shows an MALDI-TOF-MASS spectrum of an exemplary compound (CT-17) of the present invention.

Mass analysis of the compound obtained was also made using the same spectrometer as the above. The mass spectrum measurement results obtained are shown in FIG. 2.

PRODUCTION EXAMPLE 3

Production of Exemplary Compound (CT-39) of Charge-Transporting Material

Production of (2,4-dimethylphenyl)-p-tolylamine

Into a 1 liter three-necked reaction vessel fitted with a cooling tube and a mechanical stirrer, 133 g (1.1 mols) of 2,4-dimethylphenylamine, 171 g (1.0 mol) of 1-bromo-4-methylbenzene, 11.2 g (0.05 mol) of palladium acetate, 32.4 g (0.2 mol) of 2-tert-butylphosphinoyl-2-methylpropane, 212 g (1.0 mol) of tripotassium phosphate and 500 mL of dimethylformamide were introduced to effect reflux for 12 hours in a nitrogen gas atmosphere and with heating in an oil bath. After the reaction was completed, the reaction mixture was left to cool to room temperature, followed by extraction with toluene/water, then washing with hydrochloric acid water, and thereafter distillation of the organic layer under reduced pressure to obtain the desired (2,4-dimethylphenyl)-p-tolylamine. The compound obtained was in a yield of 189.5 g corresponding to 84%. The compound obtained was measured with the same elementary analyzer as the above.

Found: C, 85.27; H, 8.09; N, 6.64. (Calculated: C, 85.26; H, 8.11; N, 6.63).

Production of (4'-(bromobiphenyl-4-yl)-(2,4-dimethylphenyl)-p-tolylamine

Into a 2 liter three-necked reaction vessel fitted with an air-cooling tube and a mechanical stirrer, 105.7 g (0.5 mol) of (2,4-dimethylphenyl)-p-tolylamine, 215.4 g (0.6 mol) of 4'-bromo-4-iodobiphenyl, 50 g of copper powder, 60 g of potassium carbonate and 600 mL of o-dichlorobenzene were introduced and heated for 12 hours in an oil bath. After the reaction was completed, the reaction mixture was left to cool to room temperature, followed by removing solid matter by filtration, and thereafter extraction with toluene/water. Then, the solvent was distilled away from the organic layer under reduced pressure, followed by purification with a silica gel column (developer solvent: hexane/toluene=2:1) to give the desired (4'-(bromobiphenyl-4-yl)-(2,4-dimethylphenyl)-p-tolylamine. The compound obtained was in a yield of 165.9 and corresponding to 75%. The compound obtained was measured with the same elementary analyzer as the above.

Found: C, 73.33; H, 5.48; N, 3.17. (Calculated: C, 73.30; H, 5.47; N, 3.17).

Production of $N^4$,$N^{4'}$-bis(2,4-dimethylphenyl)-$N^4$-p-tolylbiphenyl-4,4'-diamine Into a 1 liter three-necked reaction vessel fitted with a cooling tube and a mechanical stirrer, 88.5 g (0.2 mol) of (4'-(bromobiphenyl-4-yl)-(2,4-dimethylphenyl)-p-tolylamine, 26.7 g (0.22 mol) of 2,4-dimethylphenylamine, 2.2 g (0.01 mol) of palladium acetate, 11.1 g (0.02 mol) of bis(diphenylphosphino)ferrocene, 26.8 g (0.28 mol) of tert-butoxysodium and 400 mL of xylene were introduced to effect reflux for 5 hours in a nitrogen gas atmosphere and with heating in an oil bath. After the reaction was completed, the reaction mixture was left to cool to room temperature, followed by extraction with toluene/water, then washing with hydrochloric acid water, and thereafter distillation of the organic layer under reduced pressure and purification with a silica gel column (developer solvent: hexane/toluene=1:1) to give the desired $N^4$,$N^{4'}$-bis(2,4-dimethylphenyl)-$N^4$-p-tolylbiphenyl-4,4'-diamine. The compound obtained was in a yield of 71.4 g corresponding to 74%. The compound obtained was measured with the same elementary analyzer as the above.

Found: C, 87.05; H, 7.14; N, 5.81. (Calculated: C, 87.10; H, 7.10; N, 5.80).

Production of $N^{4'}$-(4'-bromobiphenyl-4-yl)-$N^4$,$N^{4'}$-bis(2,4-dimethylphenyl)-$N^4$-p-tolylbiphenyl-4,4'-diamine Into a 2 liter three-necked reaction vessel fitted with an air-cooling tube and a mechanical stirrer, 48.3 g (0.1 mol) of $N^4$,$N^{4'}$-bis(2,4-dimethylphenyl)-$N^4$-p-tolylbiphenyl-4,4'-diamine, 39.5 g (0.11 mol) of 4'-bromo-4-iodobiphenyl, 20 g of copper powder and 200 mL of o-dichlorobenzene were introduced and heated for 12 hours in an oil bath. After the reaction was completed, the reaction mixture was left to cool to room temperature, followed by removing solid matter by filtration, and thereafter extraction with toluene/water. Then, the solvent was distilled away from the organic layer under reduced pressure, followed by purification with a silica gel column (developer solvent: hexane/toluene=2:1) to give the desired $N^{4'}$-(4'-bromobiphenyl-4-yl)-$N^4$,$N^{4'}$-bis(2,4-dimethylphenyl)-$N^4$-p-tolylbiphenyl-4,4'-diamine. The compound obtained was in a yield of 45.0 g corresponding to 63%. The compound obtained was measured with the same elementary analyzer as the above.

Found: C, 78.88; H, 5.69; N, 3.96. (Calculated: C, 79.09; H, 5.79; N, 3.92).

Production of $N^4$,$N^{4'}$-bis(2,4-dimethylphenyl)-biphenyl-4,4'-diamine

Into a 1 liter three-necked reaction vessel fitted with a cooling tube and a mechanical stirrer, 62.4 g (0.2 mol) of 4,4'-dibromobiphenyl, 72.6 g (0.6 mol) of 2,4-dimethylphenylamine, 2.24 g (0.01 mol) of palladium acetate, 12.2 g (0.04 mol) of tri(o-tolyl)phosphine, 51.8 g (0.54 mol) of tert-butoxysodium and 300 mL of xylene were introduced to effect reflux for 5 hours in a nitrogen gas atmosphere and with heating in an oil bath. After the reaction was completed, an excess amount of 2,4-dimethylphenylamine and the solvent were distilled away under reduced pressure, and the reaction mixture was left to cool to room temperature, followed by extraction with toluene/water, then washing with hydrochloric acid water, and thereafter distillation of the solvent from the organic layer under reduced pressure and also recrystallization to give the desired $N^4$,$N^{4'}$-bis(2,4-dimethylphenyl)-biphenyl-4,4'-diamine. The compound obtained was in a yield of 62.7 g corresponding to 80%. The compound obtained was measured with the same elementary analyzer as the above.

Found: C, 85.66; H, 7.18; N, 7.16. (Calculated: C, 85.67; H, 7.19; N, 7.14).

Production of Exemplary Compound (CT-39) of Charge-Transporting Material

Into a 500 mL three-necked reaction vessel fitted with a cooling tube and a mechanical stirrer, 35.7 g (0.05 mol) of $N^{4'}$-(4'-bromobiphenyl-4-yl)-$N^4$,$N^{4'}$-bis (2, 4-dimethylphenyl)-$N^4$-p-tolylbiphenyl-4,4'-diamine, 9.8 g (0.025 mol) of $N^4$,$N^{4'}$-bis(2,4-dimethylphenyl)-biphenyl-4,4'-diamine, 0.57 g (0.0025 mol) of palladium acetate, 3.0 g (0.01 mol) of biphenyl-2-yl-ditert-butylphosphine, 6.7 g (0.07 mol) of tert-butoxysodium and 200 mL of xylene were introduced to effect reflux for 4 hours in a nitrogen gas atmosphere and with heating in an oil bath. After the reaction was completed, the reaction mixture was left to cool to room temperature, followed by extraction with toluene/water, then washing with hydrochloric acid water, and thereafter distillation of the solvent from the organic layer under reduced pressure and purification with a silica gel column (developer solvent: hexane/toluene=1:1) to give the desired charge-transporting material shown as the exemplary compound (CT-39). The compound obtained was in a yield of 34.4 g corresponding to 83%. The compound obtained was measured with the same elementary analyzer as the above.

Found: C, 88.40; H, 6.51; N, 5.09. (Calculated: C, 88.37; H, 6.56; N, 5.07).

Figure 3:
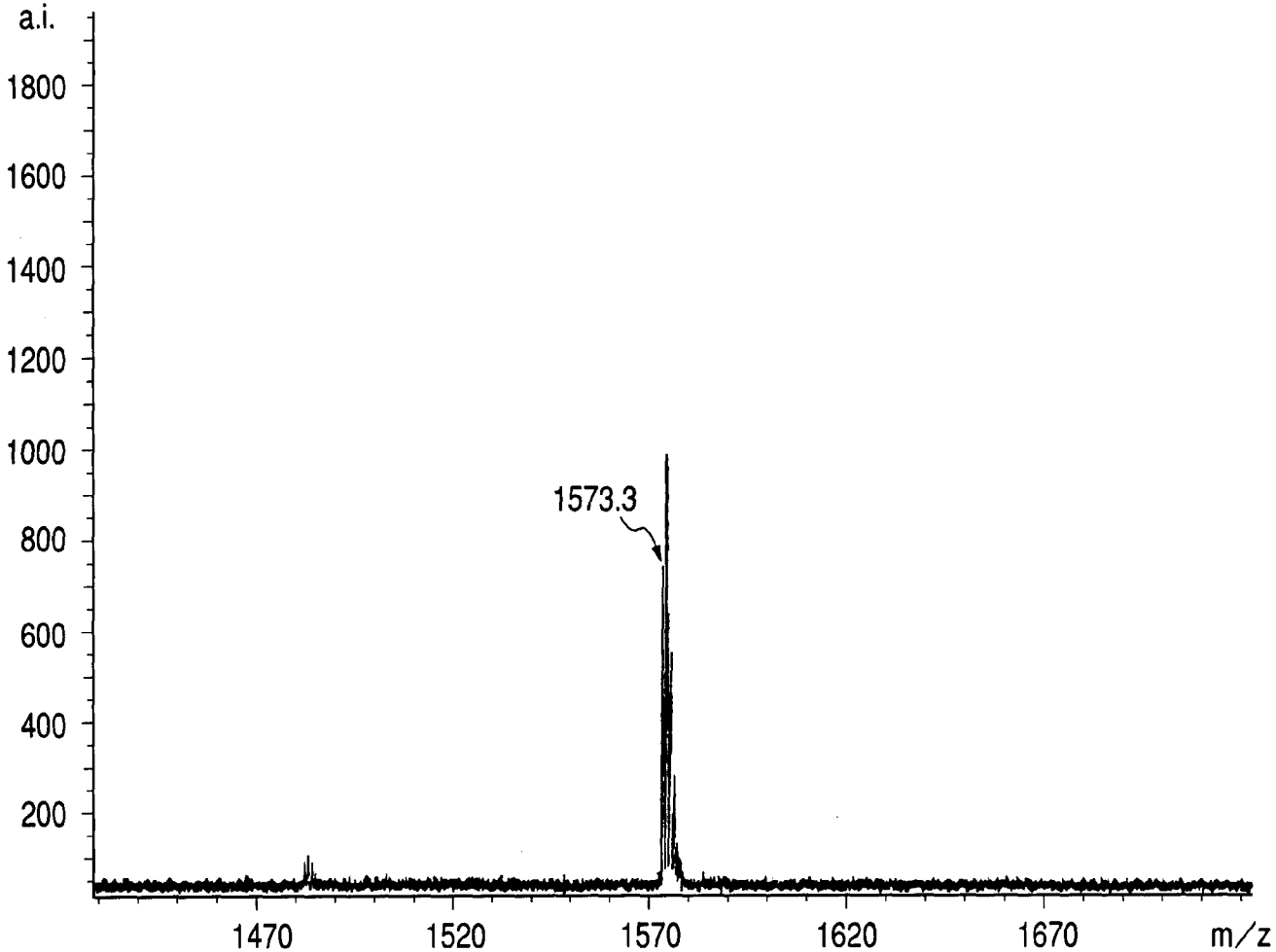
FIG. 3 shows an MALDI-TOF-MASS spectrum of an exemplary compound (CT-39) of the present invention.

Mass analysis of the compound obtained was made using the same spectrometer as the above. The mass spectrum measurement results obtained are shown in FIG. 3.

In the present invention, in respect of the improvement of running (extensive operation) lifetime of the electrophotographic photosensitive member, in particular, remarkable prevention of image quality from lowering because of scratches made on the electrophotographic photosensitive member surface, in respect of the achievement of higher sensitivity of the electrophotographic photosensitive member, and in respect of the superior image stability, these are considered in the following way.

The high charge transport performance of the charge-transporting material that contributes to the achievement of higher sensitivity of the electrophotographic photosensitive member is brought out by the tertiary amine in which either the aromatic carbocyclic groups or the aromatic heterocyclic groups are bonded to the nitrogen atom, and the charge transport performance can be made highly efficient by arranging such tertiary amines in the molecule in a large number. However, arranging the tertiary amines in the molecule in a large number tends to lower the solubility of the charge-transporting material in the solvent. This may also lower the compatibility of the charge-transporting material with the binder resin after a coating solution or dispersion for forming a photosensitive layer of the electrophotographic photosensitive member has been applied on its support, tending to form a separate state, and to make poor the performance of the resulting electrophotographic photosensitive member. In the present invention, the charge-transporting material has the tertiary amine in its molecule in an appropriate number, and hence the electrophotographic photosensitive member can be made to have higher sensitivity in virtue of its charge transport performance having been made higher efficient, without lowering the solubility of the charge-transporting material in the solvent or lowering its compatibility with the binder resin.

In addition, in respect of the remarkably improved prevention of image quality from lowering because of scratches made on the electrophotographic photosensitive member surface, this is considered to be due to the rigid molecular structure of the charge-transporting material in the present invention, coming from the structure represented by any of the above Formulas (1) to (5), and resulting in the improvement of running lifetime that has not been achievable by conventionally used electrophotographic photosensitive members in which low-molecular-weight charge-transporting material has been dispersed in the binder resin.

It is also considered that the present invention has such features that the charge-transporting material has a molecular weight of from 1,500 to 4,000 and the charge-transporting material represented by any of the above Formulas (1) to (5) is held in a proportion of from 90% by weight to 100% by weight based on the total weight of the charge-transporting material(s) contained in the photosensitive layer, thereby achieving the above improvement in performance. This is considered to be for the reason that if the proportion held by any charge-transporting material other than the charge-transporting material represented by any of the above Formulas (1) to (5) is 10% by weight or more based on the total weight of the charge-transporting material(s) contained in the photosensitive layer, the properties of the charge-transporting material according to the present invention, which contribute to the achievement of higher sensitivity, may be inhibited. For the same reason, it is considered that at the same time the charge-transporting material used in the present invention has superiority also in regard to image stability, in particular, image stability in a high humidity environment. In regard to the improvement of running lifetime of the electrophotographic photosensitive member, it is also considered that the presence of any charge-transporting materials other than the charge-transporting material represented by any of the above Formulas (1) to (5) brings about a low mechanical strength.

The electrophotographic photosensitive member of the present invention is constructed as described below.

The photosensitive layer of the present invention may be in the form of either a single-layer type in which a charge-generating material and a charge-transporting material are contained in the same layer, or a function-separated type (multi-layer type), which is functionally separated into a charge generation layer containing a charge-generating material and a charge transport layer containing a charge-transporting material. The function-separated type (multi-layer type) is preferred in view of electrophotographic performance. More preferred is a function-separated type in which the charge generation layer and the charge transport layer are formed in this order from the support side. In the following, when expressed as the function-separated type (multi-layer type), it means that the charge generation layer and the charge transport layer are formed in this order from the support side.

The support used in the electrophotographic photosensitive member of the present invention may be any materials having a conductivity, including, e.g., those obtained by molding metals such as aluminum, copper, chromium, nickel, zinc and stainless steel into drums or sheets, those obtained by laminating metal foil of aluminum or copper to plastic films, and those obtained by vacuum-depositing aluminum, indium oxide or tin oxide on plastic films.

Where images are inputted through laser light as in the case of LBP (laser beam printers), a conductive layer may be provided on the support for the purpose of preventing interference fringes due to light scattering or for the purpose of covering any scratches of the support. This layer may be formed of a binder resin in which conductive particles such as carbon black and metal particles have been dispersed.

The conductive layer may preferably have a layer thickness of from 5 $\mu$m to 40 $\mu$m, and more preferably from 10 $\mu$m to 30 $\mu$m.

On the support or conductive layer, an intermediate layer having the function of bonding may also be provided. As materials for the intermediate layer, usable are polyamide, polyvinyl alcohol, polyethylene oxide, ethyl cellulose, casein, polyurethane and polyether-urethane. Any of these may be dissolved in a suitable solvent, and the resulting solution may be applied on the support or conductive layer, followed by drying to form the intermediate layer.

The intermediate layer may preferably have a layer thickness of from 0.05 $\mu$m to 5 $\mu$m, and more preferably from 0.3 $\mu$m to 1 $\mu$m.

In the case of the function-separated type (multi-layer type) photosensitive layer, the photosensitive layer is provided on the support, conductive layer or intermediate layer.

To form the charge generation layer, the charge-generating material may be sufficiently dispersed together with a binder resin of 0.3 to 4 times the amount of that charge-generating material and a solvent by means of a homogenizer, an ultrasonic dispersion machine, a ball mill, a vibrating ball mill, a sand mill, an attritor, a roll mill, a liquid impact type high-speed dispersion machine or the like, and the dispersion obtained may be applied, followed by drying.

The charge generation layer may preferably have a layer thickness of 5 $\mu$m or less, and more preferably from 0.1 $\mu$m to 2 $\mu$m.

As the charge-generating material, those commonly known may be used, which may include, e.g., pigments such as selenium-tellurium, pyrylium, a metal phthalocyanine, metal-free phthalocyanine, anthanthrone, dibenzpirenequinone, trisazo, cyanine, disazo, monoazo, indigo and quinacridone pigments.

Any of these pigments may be sufficiently dispersed together with a binder resin of 0.3 to 4 times the amount of that pigment and a solvent by means of a homogenizer, an ultrasonic dispersion machine, a ball mill, a vibrating mill, a sand mill, an attritor, a roll mill, a liquid impact type high-speed dispersion machine or the like to prepare a dispersion. In the case of the function-separated type (multi-layer type) photosensitive layer, this dispersion may be applied on the support, conductive layer or intermediate layer, followed by drying to form the charge generation layer.

In the case of the function-separated type (multi-layer type) photosensitive layer, the charge transport layer is formed on the charge generation layer.

The charge transport layer or photosensitive layer does not necessarily require any binder resin when the charge transport layer itself has binding properties. However, from the viewpoint of mechanical strength and electrophotographic performance, it is preferable for the photosensitive layer to contain a binder resin. The binder resin may also preferably be insulating.

The photosensitive layer may also preferably be a surface layer of the electrophotographic photosensitive member.

To form the charge transport layer, the charge-transporting material described above and the binder resin may be dissolved in a solvent to prepare a coating solution, and this coating solution may be formed on the charge generation layer, followed by drying.

In the coating solution, the charge-transporting material and the binder resin may preferably be in a proportion (charge-transporting material/binder resin) of from 1/10 to 12/10 in weight ratio. From the viewpoint of charge transport performance of the electrophotographic photosensitive member or strength of the charge transport layer, it may more preferably be 2/10 to 10/10.

As the binder resin, any resins may be used as long as they are resins usually usable in photosensitive layers or charge transport layers, such as polycarbonate resins, polyarylate resins, polyester resins, polystyrene resins, polymethacrylate resins and polyacrylate resins. From the viewpoint of light transmission properties and film-forming properties of the resin, and where the photosensitive layer or the charge transport layer is the surface layer of the electrophotographic photosensitive member, also from the viewpoint of wear resistance, polycarbonate resins or polyarylate resins are preferred.

The polycarbonate resin may preferably have a viscosity-average molecular weight (Mv) of from 20,000 to 80,000.

The divalent organic residual group moiety included in the polycarbonate resin may have any structure as long as it is a divalent organic residual group such as a substituted or unsubstituted divalent biphenyl residual group, a substituted or unsubstituted divalent bisphenyl residual group, a substituted or unsubstituted divalent biphenyl ether residual group, or a substituted or unsubstituted divalent biphenyl thioether residual group. It may preferably be a substituted or unsubstituted divalent biphenyl residual group, a substituted or unsubstituted divalent bisphenyl residual group or a substituted or unsubstituted divalent biphenyl ether residual group.

Specific examples of the repeating structural unit of the polycarbonate resin are shown below. Examples are by no means limited to these structures.

(PC-1)

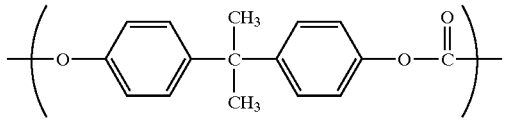

(PC-2)

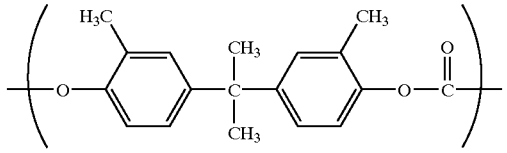

(PC-3)

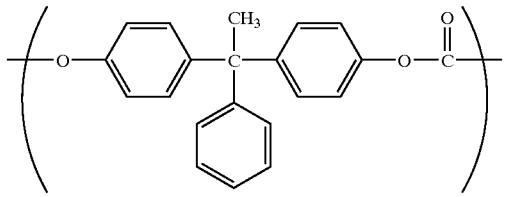

(PC-4)

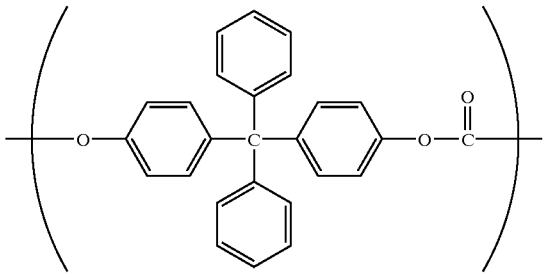

(PC-5)

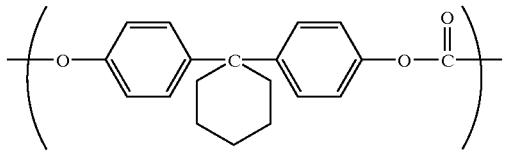

(PC-6)

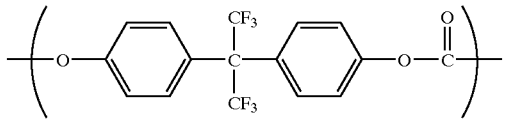

In order to improve productivity, a copolymer-resin may also be used in which a divalent organic residual group of a different type is used in the divalent organic residual group moiety of the polycarbonate resin. In order to efficiently bring out the effect of blending, the blending proportion may preferably be from 5/95 to 95/5, and more preferably from 20/80 to 80/20.

The polyarylate resin may preferably have a weight-average molecular weight (Mw) of from 50,000 to 200,000, and from the viewpoint of strength, productivity and so forth, more preferably from 80,000 to 150,000.

In regard to the structure of a phthalic-acid moiety used in the polyarylate resin, isophthalic acid and/or terephthalic acid may be used. The isophthalic acid and terephthalic acid in the resin may be in a proportion (isophthalic acid/ terephthalic acid) of from 0/100 to 100/0 in weight ratio. From the viewpoint of strength of the polyarylate resin, the proportion of isophthalic acid/terephthalic acid may more preferably be from 30/70 to 70/30.

The divalent organic residual group moiety included in the polyarylate resin may have any structure as long as it is a divalent organic residual group such as a substituted or unsubstituted divalent biphenyl residual group, a substituted or unsubstituted divalent bisphenyl residual group, a substituted or unsubstituted divalent biphenyl ether residual group, or a substituted or unsubstituted divalent biphenyl thioether residual group. It may preferably be a substituted or unsubstituted divalent biphenyl residual group, a substituted or unsubstituted divalent bisphenyl residual group or a substituted or unsubstituted divalent biphenyl ether residual group.

Specific examples of the repeating structural unit of the polyarylate resin are shown below. Examples are by no means limited to these structures.

(PA-1)

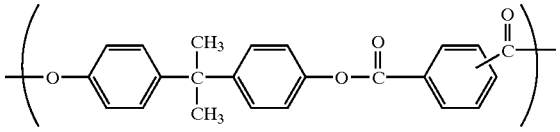

(PA-2)

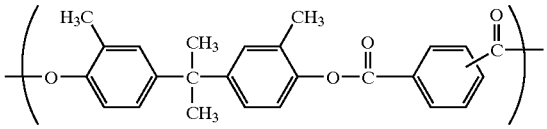

(PA-3)

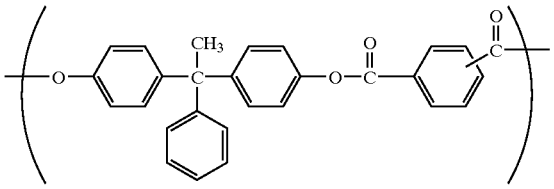

(PA-4)

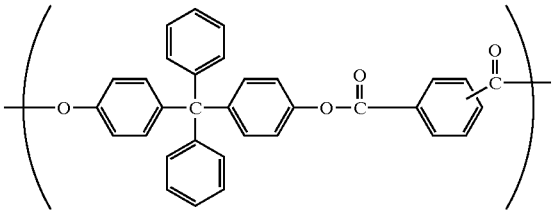

(PA-5)

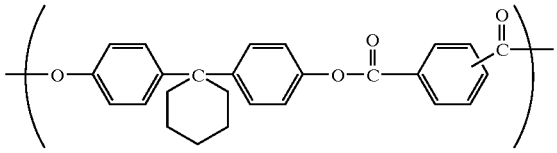

(PA-6)

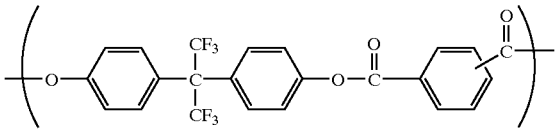

-continued (PA-7)

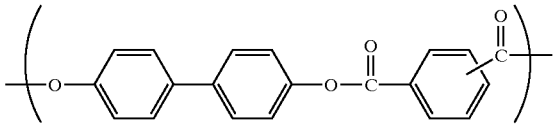

(PA-8)

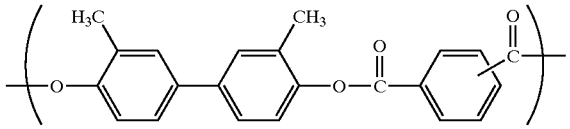

(PA-9)

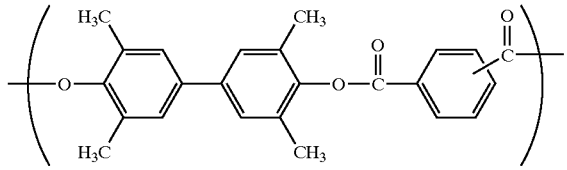

(PA-10)

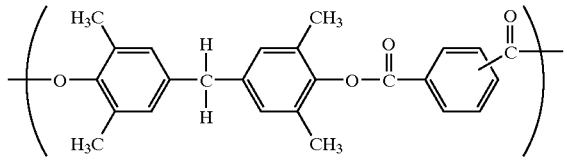

In order to improve solubility, a copolymer resin may also be used in which a divalent organic residual group of a different type is used in the divalent organic residual group moiety in the polyarylate resin. In order to efficiently bring out the effect of blending, the blending proportion may preferably be from 5/95 to 95/5, and more preferably from 20/80 to 80/20.

In addition, in order to improve productivity, a polyarylate resin or polycarbonate resin with a different structure may be blended in the above polyarylate resin or polycarbonate resin. In order to efficiently bring out the effect of blending, the blending proportion may preferably be from 5/95 to 95/5, and more preferably from 20/80 to 80/20.

In the charge transport layer, an antioxidant, a heat stabilizer, an ultraviolet absorber and a plasticizer may optionally be incorporated.

In the case when the charge transport layer is the surface layer of the electrophotographic photosensitive member, a lubricant or fine particles may optionally be used. Such a lubricant or fine particles may include fine resin particles such as fine polytetrafluroethylene particles and fine polystyrene particles, fine metal oxide particles such as fine silica particles, fine alumina particles and fine tin oxide particles, fine particles obtained by subjecting any of these fine particles to surface treatment, solid lubricants such as zinc stearate, silicones substituted with an alkyl group, aliphatic oils having a fluorinated alkyl group, and varnishes.

The charge transport layer may preferably have a layer thickness of from 5 $\mu$m to 40 $\mu$m, and more preferably from 15 $\mu$m to 30 $\mu$m.

A layer for protecting the photosensitive layer, i.e., a protective layer may additionally be provided on the photosensitive layer as a surface layer of the electrophotographic photosensitive member.

As resins used in the protective layer, thermoplastic resins or thermosetting resins and photo-curable resins are preferred. Further, more preferred are polycarbonate resin, polyarylate resin, phenolic resins, acrylic resins and epoxy resins. For the purpose of reducing residual potential or improving film strength, the protective layer may also be incorporated with conductive particles or a lubricant.

In forming the protective layer, a wet coating may be cured by heat, light or electron rays, and may optionally be incorporated with a polymerization initiator and an antioxidant.

The solvent used in the steps of forming the respective layers of the electrophotographic photosensitive member may include chlorobenzene, tetrahydrofuran, 1,4-dioxane, toluene and xylene, any of which may be used alone or a plurality of which may be used in combination.

As methods for applying the above layers, conventionally know methods may be used, such as dip coating, spray coating and bar coating.

An electrophotographic apparatus having a process cartridge having the electrophotographic photosensitive member of the present invention is described below.

Figure 4:
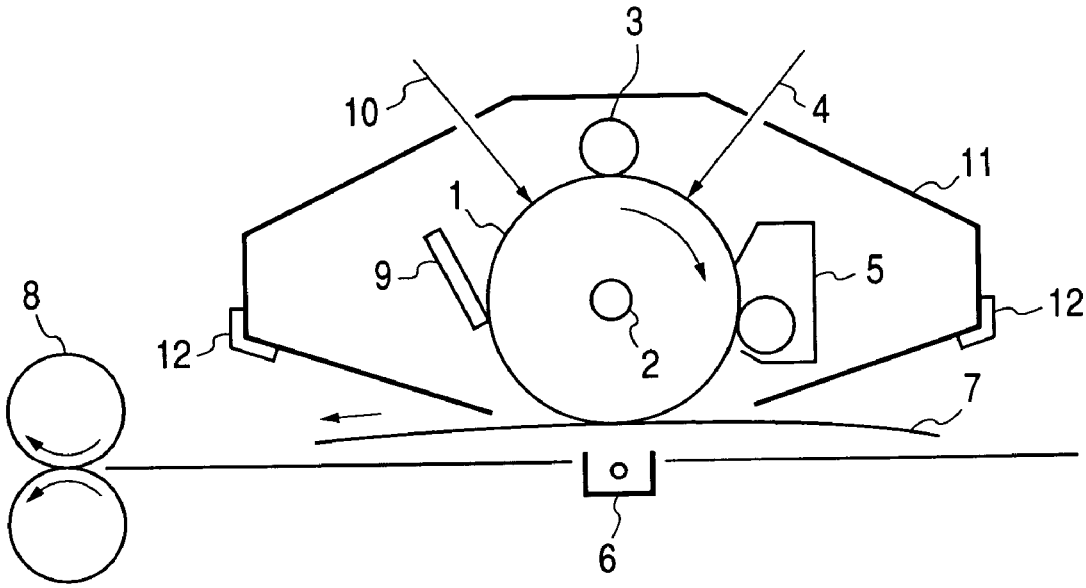
FIG. 4 is a schematic view showing an example of the construction of an electrophotographic apparatus having the electrophotographic photosensitive member of the present invention.

FIG. 4 schematically illustrates the construction of such an electrophotographic apparatus having a process cartridge having the electrophotographic photosensitive member of the present invention.

In FIG. 4, reference numeral 1 denotes a drum-shaped electrophotographic photosensitive member of the present invention, which is rotatively driven around an axis 2 in the direction of an arrow at a stated peripheral speed. The electrophotographic photosensitive member 1 is, in the course of its rotation, uniformly electrostatically charged on its periphery to a positive or negative, given potential through a primary charging means 3. The electrophotographic photosensitive member thus charged is then exposed to imagewise exposure light 4 emitted from an exposure means (not shown) for slit exposure or laser beam scanning exposure. In this way, electrostatic latent images are successively formed on the periphery of the electrophotographic photosensitive member 1.

The electrostatic latent images thus formed are subsequently developed with toner by the operation of a developing means 5. The toner images thus formed by development are then successively transferred by the operation of a transfer means 6, to a transfer material 7 fed from a paper feed section (not shown) to the part between the electrophotographic photosensitive member 1 and the transfer means 6 in such a manner as synchronized with the rotation of the electrophotographic photosensitive member 1.

The transfer material 7 onto which the toner images have been transferred is separated from the surface of the electrophotographic photosensitive member, is led through an image fixing means 8, where the toner images are fixed, and is then put out of the apparatus as an image-formed material (a print or copy).

The surface of the electrophotographic photosensitive member 1 from which images have been transferred is brought to removal of the toner remaining after the transfer, through a cleaning means 9. Thus, the surface is cleaned. The electrophotographic photosensitive member is further subjected to charge elimination by pre-exposure light 10 emitted from a pre-exposure means (not shown), and then repeatedly used for the formation of images. Incidentally, where the primary charging means 3 is a contact charging means making use of a charging roller or the like as shown in FIG. 4, the pre-exposure is not necessarily required.

In the present invention, the apparatus may be constituted of a combination of plural components integrally combined as a process cartridge from among the constituents such as the above electrophotographic photosensitive member 1, primary charging means 3, developing means 5 and cleaning means 9 so that the process cartridge is detachably mountable on the main body of an electrophotographic apparatus such as a copying machine or a laser beam printer. For example, at least one of the primary charging means 3, the developing means 5 and the cleaning means 9 may integrally be supported in a cartridge together with the electrophotographic photosensitive member 1 to form a process cartridge 11 that is detachably mountable on the main body of the apparatus through a guide means 12 such as rails provided in the main body of the apparatus.

In the case when the electrophotographic apparatus is a copying machine or a printer, the exposure light 4 is light reflected from, or transmitted through, an original, or light irradiated by the scanning of a laser beam, the driving of an LED array or the driving of a liquid-crystal shutter array according to signals obtained by reading an original through a sensor and converting the information into signals.

The electrophotographic photosensitive member of the present invention may be not only applied to electrophotographic copying machines, but also widely applicable in the fields where electrophotography is applied, e.g., laser beam printers, CRT printers, LED printers, liquid-crystal printers, and laser plate making.

The present invention is described below in greater detail by giving Examples. Note, however, that the present invention is by no means limited to these Examples. In the following Examples and Comparative Examples, "part(s)" refers to "part(s) by weight".

EXAMPLE 1

An aluminum cylinder of 30 mm in diameter and 357 mm in length was coated thereon by dip coating with a coating dispersion made up of the following materials, followed by heat curing at 140° C. for 30 minutes to form a conductive layer with a layer thickness of 15 $\mu$m.

| | |
|---|---|
| Conductive pigment: $SnO_2$-coated barium sulfate | 10 parts |
| Resistance-adjusting pigment: Titanium oxide | 2 parts |
| Binder resin: Phenol resin | 6 parts |
| Leveling agent: Silicone oil | 0.001 part |
| Solvent: Methanol/methoxypropanol = 2/8 | 20 parts |

Next, on the conductive layer, a solution prepared by dissolving 3 parts of N-methoxymethylated nylon and 3 parts of copolymer nylon in a mixed solvent of 65 parts of methanol and 30 parts of n-butanol was applied by dip coating, followed by drying to form an intermediate layer with a layer thickness of 0.7 $\mu$m.

Next, 4 parts of hydroxygallium phthalocyanine having strong peaks at Bragg's angles (2θ±0.2°) of 7.4° and 28.2° in the CuKα characteristic X-ray diffraction, 2 parts of polyvinyl butyral resin (trade name: S-LEC BX-1; available from Sekisui Chemical Co., Ltd.) and 60 parts of cyclohexanone were subjected to dispersion for 4 hours by means of a sand mill making use of glass beads of 1 mm in diameter, followed by addition of 100 parts of ethyl acetate to prepare a charge generation layer coating dispersion. This was coated on the intermediate layer by dip coating, followed by drying to form a charge generation layer with a layer thickness of 0.25 $\mu$m.

Next, 4 parts of the charge-transporting material shown as the exemplary compound (CT-1) and 10 parts of polycarbonate resin (repeating structural unit example (PC-5); trade name: IUPILON Z-400; available from Mitsubishi Engineering Plastics Co., Ltd.) were dissolved in a mixed solvent of 80 parts of monochlorobenzene and 20 parts of dimethoxymehtane to prepare a charge transport layer coating solution. This was applied on the charge generation layer by dip coating, followed by drying at 120° C. for 1 hour to form a charge transport layer with a layer thickness of 25 μm. Thus, an electrophotographic photosensitive member used in Example 1 was produced.

Next, the electrophotographic photosensitive member produced was evaluated as described below.

An evaluation apparatus used was a remodeled machine of a laser beam printer LBP-950, manufactured by CANON INC., (process speed 144.5 mm/sec; contact charging system). The printer was so remodeled that the control of primary charging is changed from constant-current control to constant-voltage control (potential at non-image areas on the photosensitive member: always −680 V). Evaluation was made in a normal temperature and high humidity (23° C., 90% RH) environment.

The light-area potential (Vl) of the electrophotographic photosensitive member produced and variations in light-area potential (ΔVl) were evaluated, setting the light source of the apparatus in such a way that the amount of imagewise exposure light came to be 0.5 $\mu J/cm^2$ as the amount of light on the electrophotographic photosensitive member surface. To evaluate variations in potential characteristics as a result of repeated use of the electrophotographic photosensitive member, images were continuously reproduced on 10,000 sheets of A4-size plain paper, and the surface potential before and after measurement. To measure the surface potential of the electrophotographic photosensitive member, the developing assembly was changed for a jig which was so fastened that a probe for measuring the potential was positioned at a position of 180 mm from the upper end of the electrophotographic photosensitive member. The surface potential was measured at the position of the developing assembly.

Images were also reproduced on 40,000 sheets of A4-size plain paper in an intermittent mode in which printing was stopped once for each image reproduction on one sheet. Images were evaluated every 1,000 sheets, and a point in time at which image quality was seen to deteriorate (smeared images or scratch images) was regarded as the limit of running (extensive operation).

After the image reproduction on 40,000 sheets, evaluation was further made on any scratches on the electrophotographic photosensitive member. To make evaluation on the scratches, evaluation according to the ten-point average roughness (Rzjis) evaluation prescribed in JIS B-0601:2001 was made (evaluation length: 8 mm) using a surface roughness measuring instrument (SURFCOADER SE-3400, manufactured by Kosaka Laboratory Ltd.).

The results of evaluation are shown in Table 1.

EXAMPLES 2 TO 18

Electrophotographic photosensitive members were produced in the same manner as in Example 1 except that charge-transporting materials shown in Table 1 were used as the charge-transporting material. Evaluation was made in the same way. The results are shown in Table 1.

EXAMPLES 19 TO 25

Electrophotographic photosensitive members were produced in the same manner as in Example 1 except that charge-transporting materials shown in Table 1 were used as the charge-transporting material and a resin shown as the repeating structural unit example (PA-2) (weight-average molecular weight Mw: 120,000; weight ratio of terephthalic acid to isophthalic acid in resin: terephthalic acid/isophthalic acid=50/50) was used as the binder resin. Evaluation was made in the same way. The results are shown in Table 1.

EXAMPLES 26 TO 30

Electrophotographic photosensitive members were produced in the same manner as in Example 1 except that charge-transporting materials shown in Table 1 were used as the charge-transporting material and a resin shown as the repeating structural unit example (PA-10) (weight-average molecular weight Mw: 130,000; weight ratio of terephthalic acid to isophthalic acid in resin: terephthalic acid/isophthalic acid=70/30) was used as the binder resin. Evaluation was made in the same way. The results are shown in Table 1.

EXAMPLES 31 TO 37

Electrophotographic photosensitive members were produced in the same manner as in Example 1 except that charge-transporting materials shown in Table 1 were used as the charge-transporting material and a copolymer resin having the structure represented by the repeating structural unit examples (PA-2) and (PA-9) (weight-average molecular weight Mw: 125,000; weight ratio of terephthalic acid to isophthalic acid in resin: terephthalic acid/isophthalic acid=50/50) was used as the binder resin. Evaluation was made in the same way. The results are shown in Table 1.

EXAMPLE 38

An electrophotographic photosensitive member was produced in the same manner as in Example 1 except that 3.6 parts of the compound represented by the above Formula (CT-10), 0.2 part of a compound represented by the following Formula (CT-10A) and 0.2 part of a compound represented by the following Formula (CT-10B) were used as the charge-transporting material. Evaluation was made in the same way. The results are shown in Table 1.

(CT-10A)

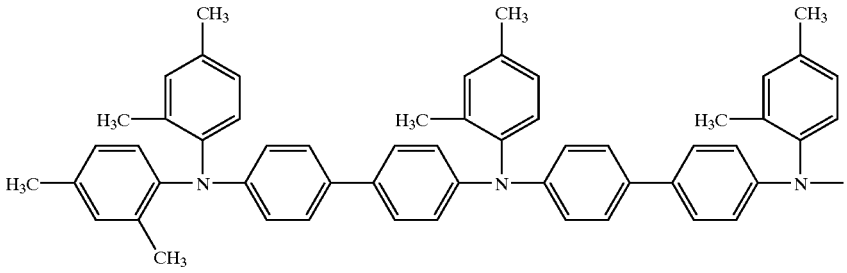

-continued

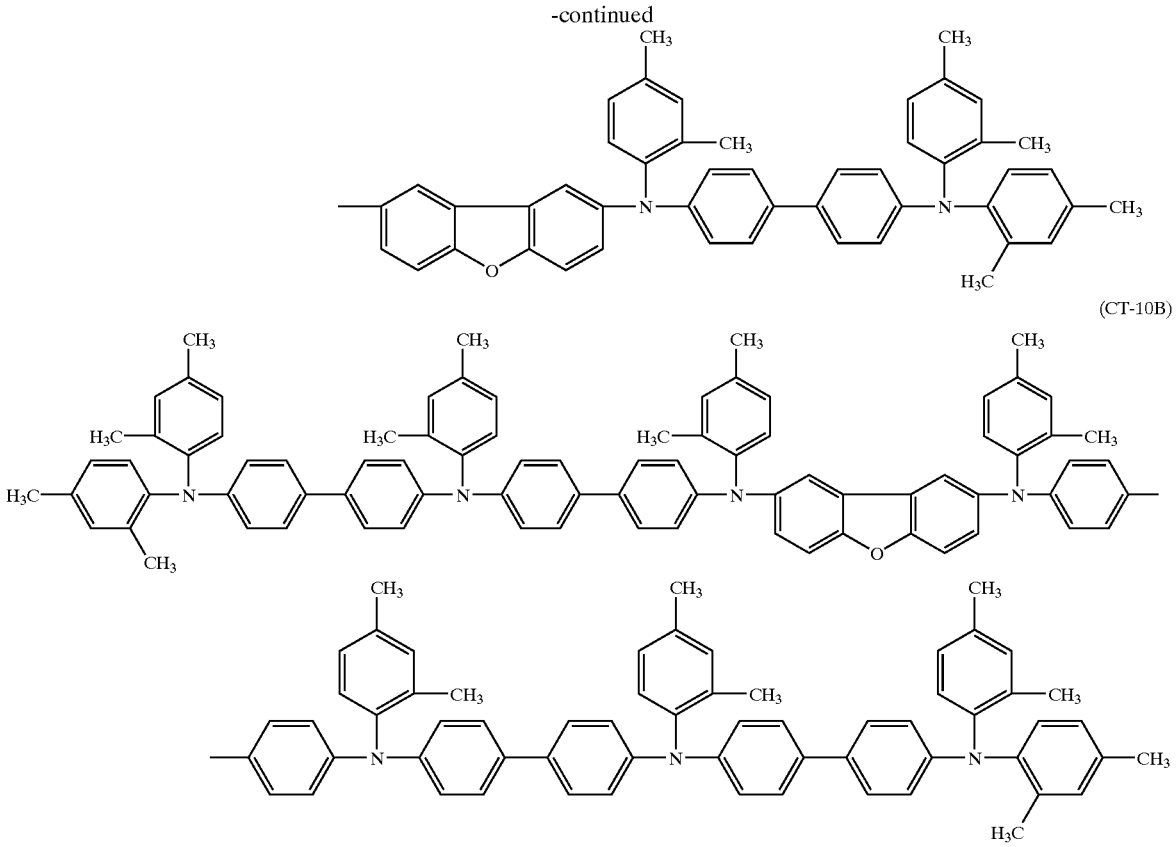

(CT-10B)

EXAMPLE 39

An electrophotographic photosensitive member was produced in the same manner as in Example 1 except that 3.8 parts of the compound represented by the above Formula (CT-10), 0.1 part of the compound represented by the above Formula (CT-10A) and 0.1 part of the compound represented by the above Formula (CT-10B) were used as the charge-transporting material. Evaluation was made in the same way. The results are shown in Table 1.

EXAMPLE 40

An electrophotographic photosensitive member was produced in the same manner as in Example 1 except that 3.9 parts of the compound represented by the above Formula (CT-10), 0.05 part of the compound represented by the above Formula (CT-10A) and 0.05 part of the compound represented by the above Formula (CT-10B) were used as the charge-transporting material. Evaluation was made in the same way. The results are shown in Table 1.

EXAMPLE 41

An electrophotographic photosensitive member was produced in the same manner as in Example 1 except that 3.6 parts of the compound represented by the above Formula (CT-17), 0.2 part of a compound represented by the following Formula (CT-17A) and 0.2 part of a compound represented by the following Formula (CT-17B) were used as the charge-transporting material. Evaluation was made in the same way. The results are shown in Table 1.

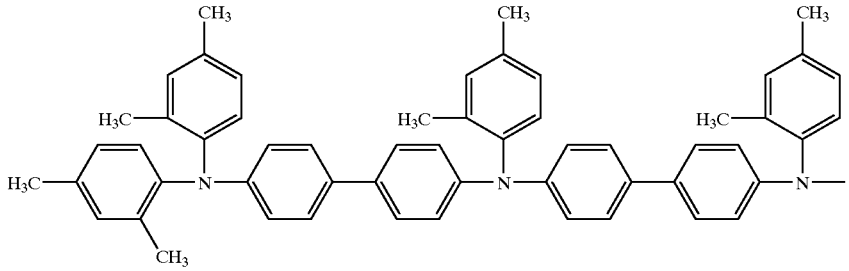

(CT-17A)

-continued

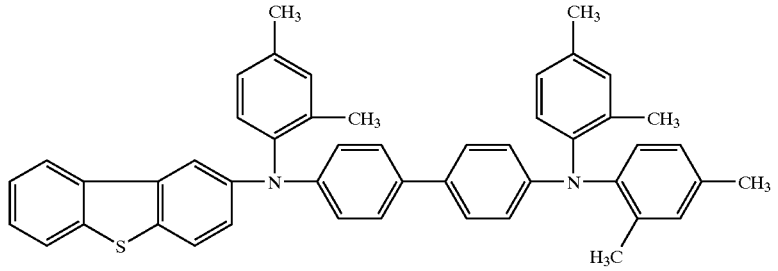

(CT-17B)

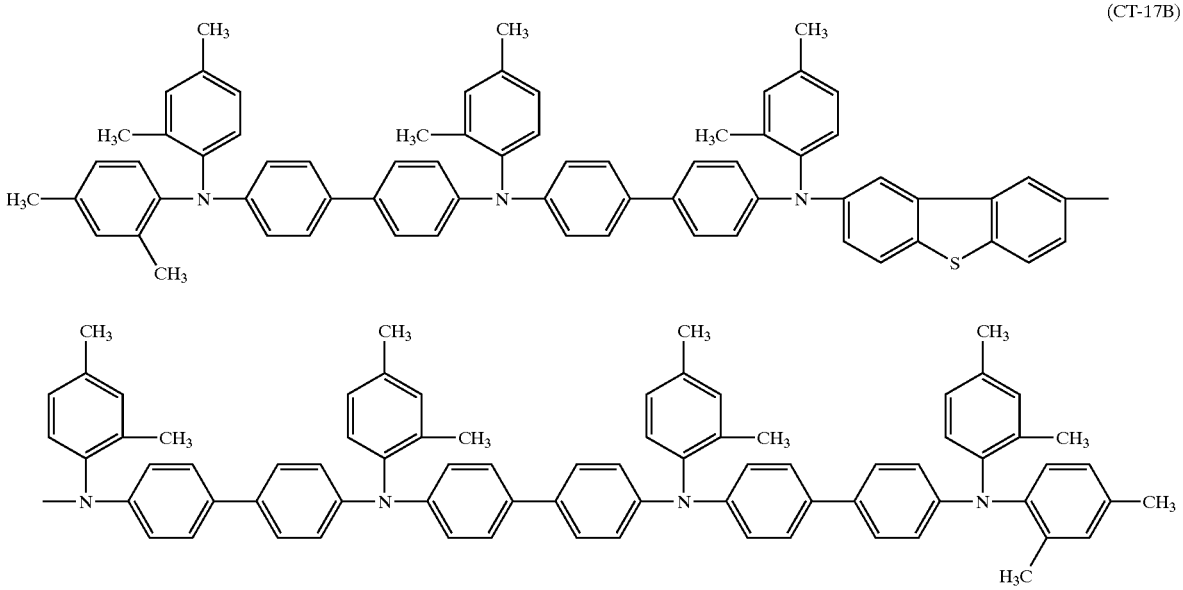

EXAMPLE 42

An electrophotographic photosensitive member was produced in the same manner as in Example 1 except that 3.8 parts of the compound represented by the above Formula (CT-17), 0.1 part of the compound represented by the above Formula (CT-17A) and 0.1 part of the compound represented by the above Formula (CT-17B) were used as the charge-transporting material. Evaluation was made in the same way. The results are shown in Table 1.

EXAMPLE 43

An electrophotographic photosensitive member was produced in the same manner as in Example 1 except that 3.9 parts of the compound represented by the above Formula (CT-17), 0.05 part of the compound represented by the above Formula (CT-17A) and 0.05 part of the compound represented by the above Formula (CT-17B) were used as the charge-transporting material. Evaluation was made in the same way. The results are shown in Table 1.

COMPARATIVE EXAMPLE 1

An electrophotographic photosensitive member was produced in the same manner as in Example 1 except that a compound represented by the following Formula (6) was used as the charge-transporting material. Evaluation was made in the same way. The results are shown in Table 1.

(6)

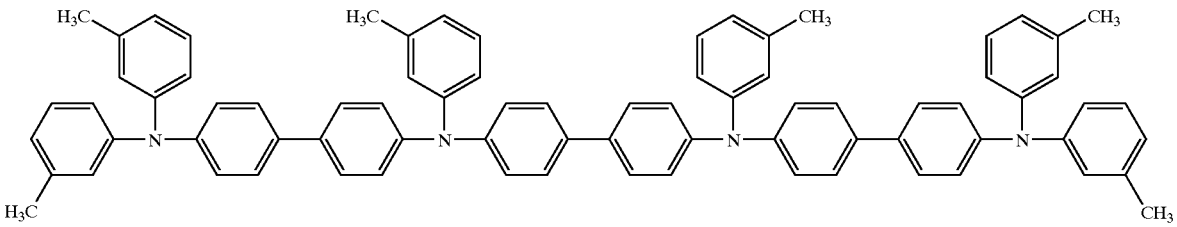

COMPARATIVE EXAMPLE 2

An electrophotographic photosensitive member was produced in the same manner as in Example 1 except that a compound represented by the following Formula (7) was used as the charge-transporting material. Evaluation was made in the same way. The results are shown in Table 1.

(7)

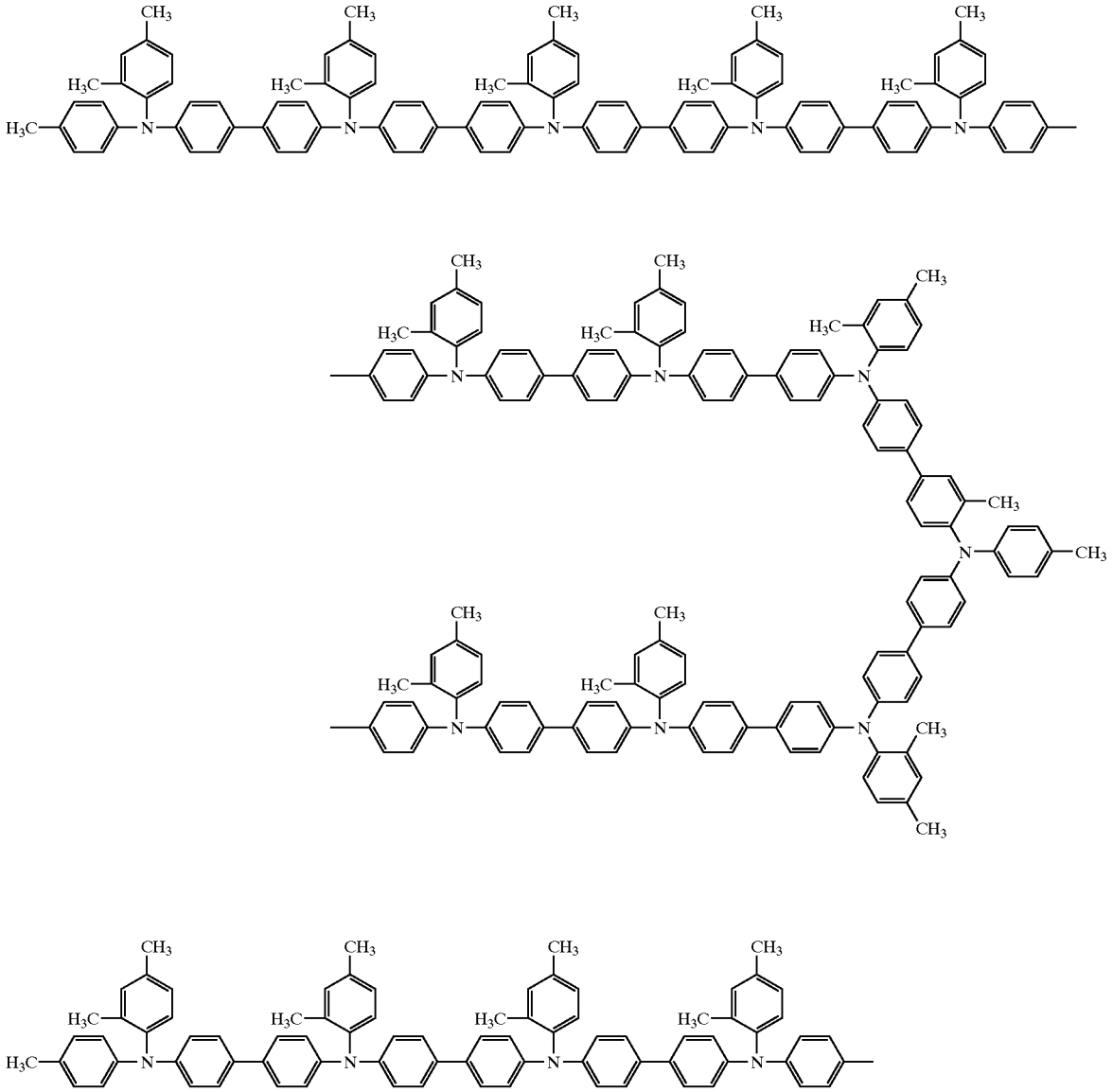

COMPARATIVE EXAMPLE 3

A compound represented by the following Formula (8A) was produced by polymerization reaction disclosed in International Publication No. WO00/078843. The compound represented by the following Formula (8A) was a charge-transporting material composed of a mixture of compounds having repeating structural units n=4:n=5:n=6:n=7:n=8 in a proportion of 7:23:50:17:3, as found by the peak area ratio in measurement by usual GPC (gel permeation chromatography; column used: KF-802, available from Showa Denko K.K.; development solvent: methanol/tetrahydrofuran=7/3; detector: IR detector; molecular weight of sample: determined in terms of polystyrene). An electrophotographic photosensitive member was produced in the same manner as in Example 1 except that this compound represented by the following Formula (8A) was used as the charge-transporting material. Evaluation was made in the same way. The results are shown in Table 1.

(8A)

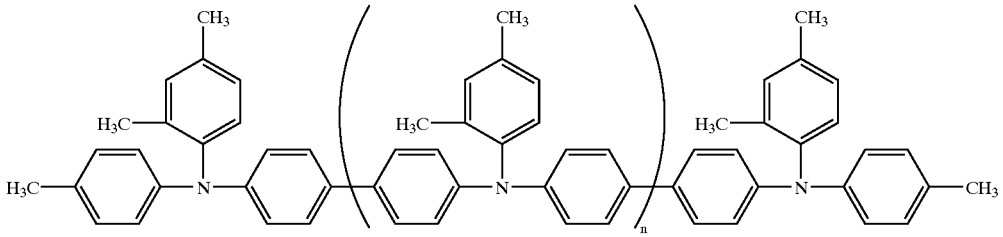

COMPARATIVE EXAMPLE 4

The compound used in Comparative Example 3, represented by Formula (8A), was purified by preparative gel permeation chromatography mainly for the compound the number n of repeating structural unit of which was 6, to obtain a compound (8B) composed of a mixture of compounds having repeating structural units n=5:n=6:n=7 in a proportion of 16:74:10, as found by the peak area ratio in the above measurement by GPC. An electrophotographic photosensitive member was produced in the same manner as in Example 1 except that this compound (8B) was used as the charge-transporting material. Evaluation was made in the same way. The results are shown in Table 1.

COMPARATIVE EXAMPLE 5

A compound represented by the following Formula (9) was produced by the process disclosed in Japanese Patent Application Laid-open No. S61-151545. The compound represented by the following Formula (9) was a charge-transporting material composed of a mixture of compounds having repeating structural units n=5:n=6:n=7 in a proportion of 13:68:19, as found by the peak area ratio in the above measurement by GPC. An electrophotographic photosensitive member was produced in the same manner as in Example 1 except that this compound represented by the following Formula (9) was used as the charge-transporting material. Evaluation was made in the same way. The results are shown in Table 1.

(9)

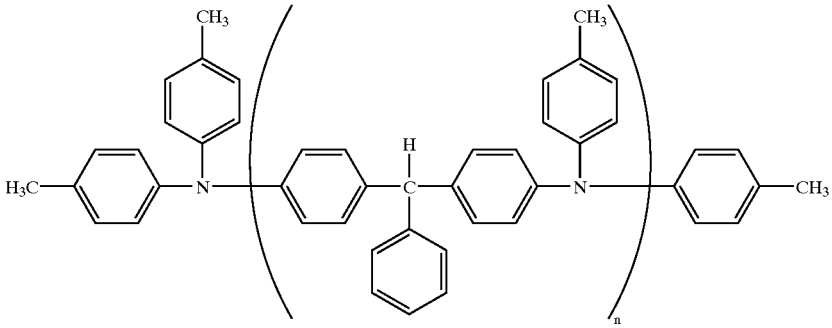

COMPARATIVE EXAMPLES 6 TO 10

Electrophotographic photosensitive members were produced in the same manner as in Example 1 except that the charge-transporting materials used in Comparative Examples 1 to 5 were used as the charge-transporting material and the resin used in Example 26 was used as the binder resin. Evaluation was made in the same way. The results are shown in Table 1.

According to the present invention, the use of the electrophotographic photosensitive member described above makes it possible to provide an electrophotographic photosensitive member which can form images with good quality even in repeated use over a long period of time, as having high mechanical strength, high wear resistance and good electrophotographic performance.

TABLE 1

| | Charge-transporting material | Proportion of compound(s)* (wt. %) | Vl (−V) | ΔVl (V) | Image evaluation (sheets) | Rzjis (μm) |
|---|---|---|---|---|---|---|
| Example: | | | | | | |
| 1 | (CT-1) | 100 | 200 | −12 | No problem after 40,000. | 1.8 |
| 2 | (CT-2) | 100 | 198 | −12 | No problem after 40,000. | 1.8 |
| 3 | (CT-3) | 100 | 198 | −13 | No problem after 40,000. | 1.8 |
| 4 | (CT-9) | 100 | 200 | −8 | No problem after 40,000. | 1.7 |
| 5 | (CT-10) | 100 | 198 | −8 | No problem after 40,000. | 1.7 |
| 6 | (CT-13) | 100 | 203 | −12 | No problem after 40,000. | 1.6 |
| 7 | (CT-15) | 100 | 203 | −12 | No problem after 40,000. | 1.6 |
| 8 | (CT-16) | 100 | 198 | −8 | No problem after 40,000. | 1.7 |
| 9 | (CT-17) | 100 | 198 | −8 | No problem after 40,000. | 1.6 |
| 10 | (CT-20) | 100 | 200 | −10 | No problem after 40,000. | 1.6 |
| 11 | (CT-34) | 100 | 203 | −12 | No problem after 40,000. | 1.8 |
| 12 | (CT-39) | 100 | 198 | −15 | Smeared i. after 34,000. | 1.9 |
| 13 | (CT-45) | 100 | 205 | −13 | Smeared i. after 36,000. | 1.8 |
| 14 | (CT-48) | 100 | 200 | −10 | Smeared i. after 34,000. | 1.8 |
| 15 | (CT-54) | 100 | 200 | −15 | Smeared i. after 32,000. | 1.8 |
| 16 | (CT-58) | 100 | 215 | −15 | Smeared i. after 34,000. | 1.8 |
| 17 | (CT-59) | 100 | 210 | −14 | Smeared i. after 38,000. | 1.9 |
| 18 | (CT-60) | 100 | 212 | −15 | Smeared i. after 34,000. | 1.8 |
| 19 | (CT-2) | 100 | 203 | −7 | No problem after 40,000. | 1.2 |
| 20 | (CT-3) | 100 | 203 | −8 | No problem after 40,000. | 1.2 |
| 21 | (CT-10) | 100 | 200 | −5 | No problem after 40,000. | 1.1 |
| 22 | (CT-17) | 100 | 200 | −5 | No problem after 40,000. | 1.1 |
| 23 | (CT-41) | 100 | 198 | −10 | Smeared i. after 32,000. | 1.2 |
| 24 | (CT-58) | 100 | 213 | −12 | Smeared i. after 32,000. | 1.3 |
| 25 | (CT-59) | 100 | 213 | −10 | Smeared i. after 36,000. | 1.2 |
| 26 | (CT-7) | 100 | 210 | −13 | Smeared i. after 39,000. | 1.3 |
| 27 | (CT-8) | 100 | 213 | −10 | Smeared i. after 38,000. | 1.3 |
| 28 | (CT-10) | 100 | 208 | −8 | No problem after 40,000. | 1.2 |
| 29 | (CT-52) | 100 | 213 | −13 | Smeared i. after 34,000. | 1.3 |
| 30 | (CT-56) | 100 | 220 | −13 | Smeared i. after 32,000. | 1.3 |
| 31 | (CT-2) | 100 | 205 | −3 | No problem after 40,000. | 1.1 |
| 32 | (CT-3) | 100 | 205 | −3 | No problem after 40,000. | 1.1 |
| 33 | (CT-10) | 100 | 203 | −2 | No problem after 40,000. | 1.0 |
| 34 | (CT-17) | 100 | 203 | −2 | No problem after 40,000. | 1.0 |
| 35 | (CT-41) | 100 | 203 | −5 | Smeared i. after 32,000. | 1.1 |
| 36 | (CT-58) | 100 | 218 | −12 | Smeared i. after 32,000. | 1.2 |
| 37 | (CT-59) | 100 | 218 | −10 | Smeared i. after 32,000. | 1.1 |
| 38 | (CT-10):(CT-10A):(CT-10B) | 90:5:5 | 205 | −16 | No problem after 40,000. | 1.7 |
| 39 | (CT-10):(CT-10A):(CT-10B) | 95:2.5:2.5 | 200 | −10 | No problem after 40,000. | 1.7 |
| 40 | (CT-10):(CT-10A):(CT-10B) | 90:0.5:0.5 | 198 | −8 | No problem after 40,000. | 1.7 |
| 41 | (CT-17):(CT-17A):(CT-17B) | 90:5:5 | 205 | −16 | No problem after 40,000. | 1.7 |
| 42 | (CT-17):(CT-17A):(CT-17B) | 95:2.5:2.5 | 200 | −10 | No problem after 40,000. | 1.7 |
| 43 | (CT-17):(CT-17A):(CT-17B) | 99:0.5:0.5 | 198 | −8 | No problem after 40,000. | 1.7 |
| Comparative Example: | | | | | | |
| 1 | (6) | 100 | 270 | 40 | Scratch i. after 18,000. | 3.8 |
| 2 | (7) | 100 | 195 | −103 | Smeared i. after 4,000. | 2.0 |
| 3 | (8A) | 7:23:50:17:3 | 225 | −40 | Smeared i. after 9,000. | 2.3 |
| 4 | (8B) | 16:74:10 | 223 | −25 | Smeared i. after 17,000. | 2.1 |
| 5 | (9) | 13:68:19 | 240 | −30 | Smeared i. after 24,000. | 2.3 |
| 6 | (6) | 100 | 293 | 27 | Scratch i. after 23,000. | 3.2 |
| 7 | (7) | 100 | 203 | −140 | Smeared i. after 4,000. | 2.3 |
| 8 | (8A) | 7:23:50:17:3 | 245 | −70 | Smeared i. after 9,000. | 2.5 |
| 9 | (8B) | 16:74:10 | 240 | −43 | Smeared i. after 14,000. | 2.4 |
| 10 | (9) | 13:68:19 | 250 | −50 | Smeared i. after 20,000. | 2.1 |

*based on total weight of charge-transporting material
Scratch i.: Scratch images appeared;
Smeared i.: Smeared images appeared

What is claimed is:

1. An electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge transporting material having a structure represented by the following Formula (1) and having a molecular weight of from 1,500 to 4,000; and the charge-transporting material having a structure represented by the following Formula (1) and having a molecular weight of from 1,500 to 4,000 is held in a proportion of from 90% by weight to 100% by weight based on the total weight of the charge transporting material contained in said photosensitive layer:

(1)

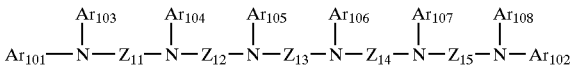

wherein $Ar_{101}$ to $Ar_{108}$ each independently represent a substituted or unsubstituted monovalent aromatic carbocyclic group or a substituted or unsubstituted monovalent aromatic heterocyclic group, and $Z_{11}$ to $Z_{15}$ each independently represent a substituted or unsubstituted divalent aromatic carbocyclic group or a substituted or unsubstituted divalent aromatic heterocyclic group, and wherein one of $Z_{11}$ to $Z_{15}$ in Formula (1) is a substituted or unsubstituted dibenzothiophenylene, and the balance are each a substituted or unsubstituted biphenylene group.

2. The electrophotographic photosensitive member according to claim 1, wherein said charge-transporting material having the structure represented by Formula (1) and having a molecular weight of from 1,500 to 4,000 is held in a proportion of 100% by weight based on the total weight of the charge-transporting material contained in said photosensitive layer.

3. The electrophotographic photosensitive member according to claim 1, wherein said charge-transporting material having the structure represented by Formula (1) and having a molecular weight of from 1,500 to 4,000 is synthesized by successive synthesis.

4. An electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (2) and having a molecular weight of from 1,500 to 4,000; and the charge-transporting material having a structure represented by the following Formula (2) and having a molecular weight of from 1,500 to 4,000 is held in a proportion of from 90% by weight to 100% by weight based on the total weight of the charge-transporting material contained in said photosensitive layer:

(2)

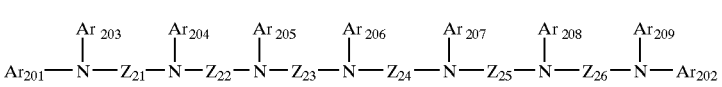

wherein $Ar_{201}$ to $Ar_{209}$ each independently represent a substituted or unsubstituted monovalent aromatic carbocyclic group or a substituted or unsubstituted monovalent aromatic heterocyclic group, and $Z_{21}$ to $Z_{26}$ each independently represent a substituted or unsubstituted divalent aromatic carbocyclic group or a substituted or unsubstituted divalent aromatic heterocyclic group, and wherein one of $Z_{21}$ to $Z_{26}$ in Formula (2) is a substituted or unsubstituted dibenzofuranylene group or a substituted or unsubstituted dibenzothiophenylene group, and the balance are each a substituted or unsubstituted biphenylene group.

5. The electrophotographic photosensitive member according to claim 4, wherein said charge-transporting material having the structure represented by Formula (2) and having a molecular weight of from 1,500 to 4,000 is held in a proportion of 100% by weight based on the total weight of the charge-transporting material contained in said photosensitive layer.

6. The electrophotographic photosensitive member according to claim 4, wherein said charge-transporting material having the structure represented by Formula (2) and having a molecular weight of from 1,500 to 4,000 is synthesized by successive synthesis.

7. An electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (3) and having a molecular weight of from 1,500 to 4,000; and the charge-transporting material having a structure represented by the following Formula (3) and having a molecular weight of from 1,500 to 4,000 is held in a proportion of from 90% by weight to 100% by weight based on the total weight of the charge-transporting material contained in said photosensitive layer:

(3)

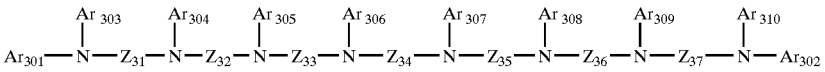

wherein $Ar_{301}$ to $Ar_{310}$ each independently represent a substituted or unsubstituted monovalent aromatic carbocyclic group or a substituted or unsubstituted monovalent aromatic heterocyclic group, and $Z_{31}$ to $Z_{37}$ each independently represent a substituted or unsubstituted divalent aromatic carbocyclic group or a substituted or unsubstituted divalent aromatic heterocyclic group, and wherein one of $Z_{31}$ to $Z_{37}$ in Formula (3) is a substituted or unsubstituted dibenzofuranylene group or a substituted or unsubstituted dibenzothiophenylene group, and the balance are each a substituted or unsubstituted biphenylene group.

8. The electrophotographic photosensitive member according to claim 7, wherein said charge-transporting material having the structure represented by Formula (3) and having a molecular weight of from 1,500 to 4,000 is held in a proportion of 100% by weight based on the total weight of the charge-transporting material contained in said photosensitive layer.

9. The electrophotographic photosensitive member according to claim 7, wherein said charge-transporting material having the structure represented by Formula (3) and having a molecular weight of from 1,500 to 4,000 is synthesized by successive synthesis.

10. An electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (4) and having a molecular weight of from 1,500 to 4,000; and the charge-transporting material having a structure represented by the following Formula (4) and having a molecular weight of from 1,500 to 4,000 is held in a proportion of from 90% by weight to 100% by weight based on the total weight of the charge-transporting material contained in said photosensitive layer:

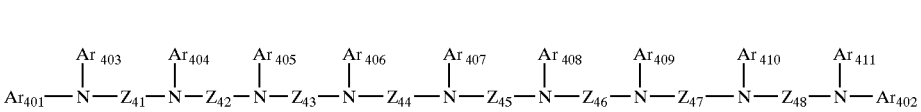

(4)

wherein $Ar_{401}$ to $Ar_{411}$ each independently represent a substituted or unsubstituted monovalent aromatic carbocyclic group or a substituted or unsubstituted monovalent aromatic heterocyclic group, and $Z_{41}$ to $Z_{48}$ each independently represent a substituted or unsubstituted divalent aromatic carbocyclic group or a substituted or unsubstituted divalent aromatic heterocyclic group, and wherein one of $Z_{41}$ to $Z_{48}$ in Formula (4) is a substituted or unsubstituted dibenzofuranylene group or a substituted or unsubstituted dibenzothiophenylene group, and the balance are each a substituted or unsubstituted biphenylene group.

11. The electrophotographic photosensitive member according to claim 10, wherein said charge-transporting material having the structure represented by Formula (4) and having a molecular weight of from 1,500 to 4,000 is held in a proportion of 100% by weight based on the total weight of the charge-transporting material contained in said photosensitive layer.

12. The electrophotographic photosensitive member according to claim 10, wherein said charge-transporting material having the structure represented by Formula (4) and having a molecular weight of from 1,500 to 4,000 is synthesized by successive synthesis.

13. An electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (5) and having a molecular weight of from 1,500 to 4,000; and the charge-transporting material having a structure represented by the following Formula (5) and having a molecular weight of from 1,500 to 4,000 is held in a proportion of from 90% by weight to 100% by weight based on the total weight of the charge-transporting material contained in said photosensitive layer:

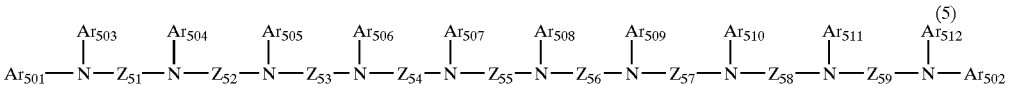

(5)

wherein $A_{501}$ to $A_{512}$ each independently represent a substituted or unsubstituted monovalent aromatic carbocyclic group or a substituted or unsubstituted monovalent aromatic heterocyclic group, and $Z_{51}$ to $Z_{59}$ each independently represent a substituted or unsubstituted divalent aromatic carbocyclic group or a substituted or unsubstituted divalent aromatic heterocyclic group, and wherein one of $Z_{51}$ to $Z_{59}$ in Formula (5) is a substituted or unsubstituted dibenzofuranylene group or a substituted or unsubstituted dibenzothiophenylene group, and the balance are each a substituted or unsubstituted biphenylene group.

14. The electrophotographic photosensitive member according to claim 13, wherein said charge-transporting material having the structure represented by Formula (5) and having a molecular weight of from 1,500 to 4,000 is held in a proportion of 100% by weight based on the total weight of the charge-transporting material contained in said photosensitive layer.

15. The electrophotographic photosensitive member according to claim 13, wherein said charge-transporting material having the structure represented by Formula (5) and having a molecular weight of from 1,500 to 4,000 is synthesized by successive synthesis.

16. A process cartridge comprising an electrophotographic photosensitive member and at least one means selected from the group consisting of a charging means, a developing means and a cleaning means which are integrally supported; and being detachably mountable on the main body of an electrophotographic apparatus; the electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (1) and having a molecular weight of from 1,500 to 4,000; and the charge-transporting material having a structure represented by the following Formula (1) and having a molecular weight of from 1,500 to 4,000 is held in a proportion of from 90% by weight to 100% by weight based on the total weight of the charge-transporting material contained in said photosensitive layer:

(1)

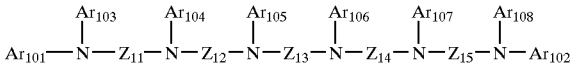

wherein $Ar_{101}$ to $Ar_{108}$ each independently represent a substituted or unsubstituted monovalent aromatic carbocyclic group or a substituted or unsubstituted monovalent aromatic heterocyclic group, and $Z_{11}$ to $Z_{15}$ each independently represent a substituted or unsubstituted divalent aromatic carbocyclic group or a substituted or unsubstituted divalent aromatic heterocyclic group, and wherein one of $Z_{11}$ to $Z_{15}$ in Formula (1) is a substituted or unsubstituted dibenzothiophenylene, and the balance are each a substituted or unsubstituted biphenylene group.

17. A process cartridge comprising an electrophotographic photosensitive member and at least one means selected from the group consisting of a charging means, a developing means and a cleaning means which are integrally supported; and being detachably mountable on the main body of an electrophotographic apparatus; the electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (2) and having a molecular weight of from 1,500 to 4,000; and the charge-transporting material having a structure represented by the following Formula (2) and having a molecular weight of from 1,500 to 4,000 is held in a proportion of from 90% by weight to 100% by weight based on the total weight of the charge-transporting material contained in said photosensitive layer:

(2)

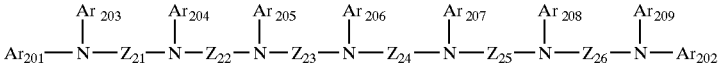

wherein $Ar_{201}$ to $Ar_{209}$ each independently represent a substituted or unsubstituted monovalent aromatic carbocyclic group or a substituted or unsubstituted monovalent aromatic heterocyclic group, and $Z_{21}$ to $Z_{26}$ each independently represent a substituted or unsubstituted divalent aromatic carbocyclic group or a substituted or unsubstituted divalent aromatic heterocyclic group, and wherein one of $Z_{21}$ to $Z_{26}$ in Formula (2) is a substituted or unsubstituted dibenzofuranylene group or a substituted or unsubstituted dibenzothiophenylene group, and the balance are each a substituted or unsubstituted biphenylene group.

18. A process cartridge comprising an electrophotographic photosensitive member and at least one means selected from the group consisting of a charging means, a developing means and a cleaning means which are integrally supported; and being detachably mountable on the main body of an electrophotographic apparatus; the electrophotographic photosensitive member comprising a conductive support and a photosensitive layer provided on the support, wherein;

said photosensitive layer contains at least one of said charge-transporting material;

wherein at least one of said charge-transporting material contained in said photosensitive layer is a charge-transporting material having a structure represented by the following Formula (3) and having a molecular weight of from 1,500 to 4,000; and the charge-transporting material having a structure represented by the following Formula (3) and having a molecular weight of from 1,500 to 4,000 is held in a proportion of from 90% by weight to 100% by weight based on the total weight of the charge-transporting material contained in said photosensitive layer:

(3)

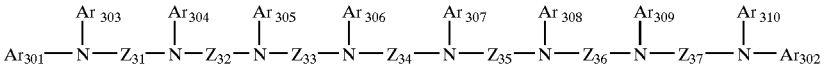

wherein $Ar_{301}$ to $Ar_{310}$ each independently represent a substituted or unsubstituted monovalent aromatic carbocyclic group or a substituted or unsubstituted monovalent aromatic heterocyclic group, and $Z_{31}$ to $Z_{37}$ each independently represent a substituted or unsubstituted divalent aromatic carbocyclic group or a substituted or unsubstituted divalent aromatic heterocyclic group, and wherein one of $Z_{31}$ to $Z_{37}$ in Formula (3) is a substituted or unsubstituted dibenzofuranylene group or a substituted or unsubstituted dibenzothiophenylene group, and the balance are each a substituted or unsubstituted biphenylene group.

19. A process cartridge comprising an electrophotographic photosensitive member and at least one means selected from the group consisting of a charging means, a developing means and a cleaning means which are integrally supported; and being detachably mountable on the main body of an electrophotographic apparatus; the electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (4) and having a molecular weight of from 1,500 to 4,000; and the charge-transporting material having a structure represented by the following Formula (4) and having a molecular weight of from 1,500 to 4,000 is held in a proportion of from 90% by weight to 100% by weight based on the total weight of the charge-transporting material contained in said photosensitive layer:

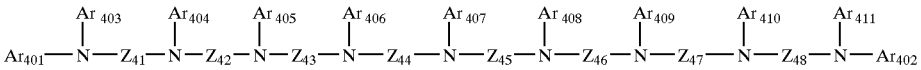

(4)

wherein $Ar_{401}$ to $Ar_{411}$ each independently represent a substituted or unsubstituted monovalent aromatic carbocyclic group or a substituted or unsubstituted monovalent aromatic heterocyclic group, and $Z_{41}$ to $Z_{48}$ each independently represent a substituted or unsubstituted divalent aromatic carbocyclic group or a substituted or unsubstituted divalent aromatic heterocyclic group, and wherein one of $Z_{41}$ to $Z_{48}$ in Formula (4) is a substituted or unsubstituted dibenzofuranylene group or a substituted or unsubstituted dibenzothiophenylene group, and the balance are each a substituted or unsubstituted biphenylene group.

20. A process cartridge comprising an electrophotographic photosensitive member and at least one means selected from the group consisting of a charging means, a developing means and a cleaning means which are integrally supported; and being detachably mountable on the main body of an electrophotographic apparatus; the electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (5) and having a molecular weight of from 1,500 to 4,000; and the charge-transporting material having a structure represented by the following Formula (5) and having a molecular weight of from 1,500 to 4,000 is held in a proportion of from 90% by weight to 100% by weight based on the total weight of the charge-transporting material contained in said photosensitive layer:

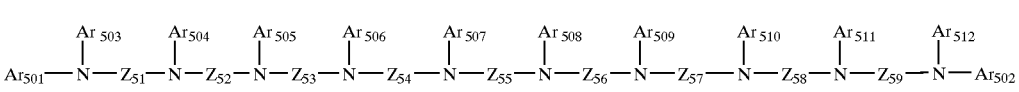

(5)

wherein $A_{501}$ to $A_{512}$ each independently represent a substituted or unsubstituted monovalent aromatic carbocyclic group or a substituted or unsubstituted monovalent aromatic heterocyclic group, and $Z_{51}$ to $Z_{59}$ each independently represent a substituted or unsubstituted divalent aromatic carbocyclic group or a substituted or unsubstituted divalent aromatic heterocyclic group, and wherein one of $Z_{51}$ to $Z_{59}$ in Formula (5) is a substituted or unsubstituted dibenzofuranylene group or a substituted or unsubstituted dibenzothiophenylene group, and the balance are each a substituted or unsubstituted biphenylene group.

21. An electrophotographic apparatus comprising an electrophotographic photosensitive member, a charging means, an exposure means, a developing means and a transfer means; the electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (1) and having a molecular weight of from 1,500 to 4,000; and the charge-transporting material having a structure represented by the following Formula (1) and having a molecular weight of from 1,500 to 4,000 is held in a proportion of from 90% by weight to 100% by weight based on the total weight of the charge-transporting material contained in said photosensitive layer:

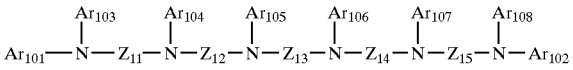

(1)

wherein $Ar_{101}$ to $Ar_{108}$ each independently represent a substituted or unsubstituted monovalent aromatic carbocyclic group or a substituted or unsubstituted monovalent aromatic heterocyclic group, and $Z_{11}$ to $Z_{15}$ each independently represent a substituted or unsubstituted divalent aromatic carbocyclic group or a substituted or unsubstituted divalent aromatic heterocyclic group, and wherein one of $Z_{11}$ to $Z_{15}$ in Formula (1) is a substituted or unsubstituted dibenzothiophenylene, and the balance are each a substituted or unsubstituted biphenylene group.

22. An electrophotographic apparatus comprising an electrophotographic photosensitive member, a charging means, an exposure means, a developing means and a transfer means; the electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (2) and having a molecular weight of from 1,500 to 4,000; and the charge-transporting material having a structure represented by the following Formula (2) and having a molecular weight of from 1,500 to 4,000 is held in a proportion of from 90% by weight to 100% by weight based on the total weight of the charge-transporting material contained in said photosensitive layer:

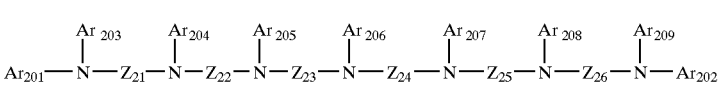

(2)

wherein $Ar_{201}$ to $Ar_{209}$ each independently represent a substituted or unsubstituted monovalent aromatic carbocyclic group or a substituted or unsubstituted monovalent aromatic heterocyclic group, and $Z_{21}$ to $Z_{26}$ each independently represent a substituted or unsubstituted divalent aromatic carbocyclic group or a substituted or unsubstituted divalent aromatic heterocyclic group, and wherein one of $Z_{21}$ to $Z_{26}$ in Formula (2) is a substituted or unsubstituted dibenzofuranylene group or a substituted or unsubstituted dibenzothiophenylene group, and the balance are each a substituted or unsubstituted biphenylene group.

23. An electrophotographic apparatus comprising an electrophotographic photosensitive member, a charging means, an exposure means, a developing means and a transfer means; the electrophotographic photosensitive member comprising a conductive support and a photosensitive layer provided on the support, wherein;

said photosensitive layer contains at least one of charge-transport material;

wherein at least one of said charge-transporting material contained in said photosensitive layer is a charge-transporting material having a structure represented by the following Formula (3) and having a molecular weight of from 1,500 to 4,000; and the charge-transporting material having a structure represented by the following Formula (3) and having a molecular weight of from 1,500 to 4,000 is held in a proportion of from 90% by weight to 100% by weight based on the total weight of the charge-transporting material contained in said photosensitive layer:

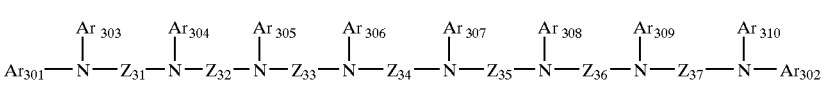

(3)

wherein $Ar_{301}$ to $Ar_{310}$ each independently represent a substituted or unsubstituted monovalent aromatic carbocyclic group or a substituted or unsubstituted monovalent aromatic heterocyclic group, and $Z_{31}$ to $Z_{37}$ each independently represent a substituted or unsubstituted divalent aromatic carbocyclic group or a substituted or unsubstituted divalent aromatic heterocyclic group, and wherein one of $Z_{31}$ to $Z_{37}$ in Formula (3) is a substituted or unsubstituted dibenzofuranylene group or a substituted or unsubstituted dibenzothiophenylene group, and the balance are each a substituted or unsubstituted biphenylene group.

24. An electrophotographic apparatus comprising an electrophotographic photosensitive member, a charging means, an exposure means, a developing means and a transfer means; the electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (4) and having a molecular weight of from 1,500 to 4,000; and the charge-transporting material having a structure represented by the following Formula (4) and having a molecular weight of from 1,500 to 4,000 is held in a proportion of from 90% by weight to 100% by weight based on the total weight of the charge-transporting material contained in said photosensitive layer:

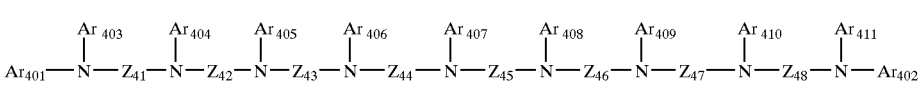

(4)

wherein $Ar_{401}$ to $Ar_{411}$ each independently represent a substituted or unsubstituted monovalent aromatic carbocyclic group or a substituted or unsubstituted monovalent aromatic heterocyclic group, and $Z_{41}$ to $Z_{48}$ each independently represent a substituted or unsubstituted divalent aromatic carbocyclic group or a substituted or unsubstituted divalent aromatic heterocyclic group, and wherein one of $Z_{41}$ to $Z_{48}$ in Formula (4) is a substituted or unsubstituted dibenzofuranylene group or a substituted or unsubstituted dibenzothiophenylene group, and the balance are each a substituted or unsubstituted biphenylene group.

25. An electrophotographic apparatus comprising an electrophotographic photosensitive member, a charging means, an exposure means, a developing means and a transfer means; the electrophotographic photosensitive member comprising a conductive support and a photosensitive layer provided on the support, wherein;

said photosensitive layer contains at least one charge-transporting material;

wherein at least one of said charge-transporting material contained in said photosensitive layer is a charge-transporting material having a structure represented by the following Formula (5) and having a molecular weight of from 1,500 to 4,000; and the charge-transporting material having a structure represented by the following Formula (5) and having a molecular weight of from 1,500 to 4,000 is held in a proportion of from 90% by weight to 100% by weight based on the total weight of the charge-transporting material contained in said photosensitive layer:

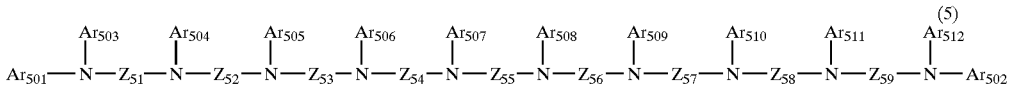

(5)

wherein $A_{501}$ to $A_{512}$ each independently represent a substituted or unsubstituted monovalent aromatic carbocyclic group or a substituted or unsubstituted monovalent aromatic heterocyclic group, and $Z_{51}$ to $Z_{59}$ each independently represent a substituted or unsubstituted divalent aromatic carbocyclic group or a substituted or unsubstituted divalent aromatic heterocyclic group, and wherein one of $Z_{51}$ to $Z_{59}$ in Formula (5) is a substituted or unsubstituted dibenzofuranylene group or a substituted or unsubstituted dibenzothiophenylene group, and the balance are each a substituted or unsubstituted biphenylene group.

* * * * *